US011118376B1

(12) United States Patent
Liang et al.

(10) Patent No.: US 11,118,376 B1
(45) Date of Patent: Sep. 14, 2021

(54) COMBINATION SASH LOCK AND TILT LATCH AND SLIDABLE WINDOW VENT STOP

(71) Applicant: Vision Industries Group, Inc., So. Plainfield, NJ (US)

(72) Inventors: Luke Liang, So. Plainfield, NJ (US); David Chen, Guangzhou (CN); Glen Paesano, Point Pleasant Beach, NJ (US)

(73) Assignee: Vision Industries Group, Inc., So. Plainfield, NJ (US)

( * ) Notice: Subject to any disclaimer, the term of this patent is extended or adjusted under 35 U.S.C. 154(b) by 593 days.

(21) Appl. No.: 16/019,742

(22) Filed: Jun. 27, 2018

Related U.S. Application Data

(60) Provisional application No. 62/573,805, filed on Oct. 18, 2017.

(51) Int. Cl.
*E05B 65/08* (2006.01)
*E05B 59/00* (2006.01)
(Continued)

(52) U.S. Cl.
CPC ..... *E05B 65/0823* (2013.01); *E05B 59/00* (2013.01); *E05B 65/0876* (2013.01); *E05C 17/48* (2013.01); *E06B 3/5063* (2013.01)

(58) Field of Classification Search
CPC ..... Y10T 292/1039; Y10T 292/104; Y10T 292/1041; Y10T 292/0802; Y10S 292/20;
(Continued)

(56) References Cited

U.S. PATENT DOCUMENTS 16,228 A 12/1856 Copeland
30,408 A 10/1860 Judd
(Continued)

FOREIGN PATENT DOCUMENTS

DE 3300975 A1 * 7/1984 ..... E05C 17/48
GB 2 286 627 8/1995
(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Kristina R Fulton
*Assistant Examiner* — Yahya I Sidky
(74) *Attorney, Agent, or Firm* — Thomas A. O'Rourke; Bodner & O'Rourke, LLP

(57) ABSTRACT

A sash window fastener includes: a latch assembly; a lock assembly mounted upon the meeting rail; and a stop assembly mounted to the master frame. The lock assembly includes a pivotable cam to engage a keeper on the master frame to lock the window, and a pivotable follower arm, which interconnects with the latch assembly within the meeting rail, so cam rotation that drives arm rotation also causes translation of the latch. The cam occupies: an extended position to secure the cam to the keeper, with the latch tongue engaging the master frame to prevent tilting, also being positioned below a stop assembly protrusion to redundantly lock the window; a first retracted position permitting sliding of the window; and a second retracted position permitting tilting of the sash window. A slidable stop on the stop assembly dampens sliding sash window movement and subsequently acts as a vent stop.

10 Claims, 51 Drawing Sheets

(51) Int. Cl.
*E06B 3/50* (2006.01)
*E05C 17/48* (2006.01)

(58) Field of Classification Search
CPC ..... Y10S 292/47; E05B 65/0876; E05B 65/0823; E05B 3/5063; E05B 59/00; E05C 17/48; E05C 17/60
See application file for complete search history.

(56) References Cited

U.S. PATENT DOCUMENTS 36,524 A 9/1862 Minor
51,222 A 11/1865 Ridell
108,778 A 11/1870 Gorman
115,781 A 6/1871 Steele
126,872 A 5/1872 Buckman
148,857 A 3/1874 Smith
163,008 A 5/1875 Gillespie
166,842 A 8/1875 Berryman
178,360 A 6/1876 Cooper
190,074 A 4/1877 Penfield
192,614 A 7/1877 Andrews
192,919 A 7/1877 Hoyt
201,146 A 3/1878 Adler
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
368,595 A 8/1887 King
369,885 A 9/1887 Shaw
375,656 A 12/1887 Shaw
376,252 A 1/1888 McIntyre
379,910 A 3/1888 Rosentreter
410,728 A 9/1889 Brown
417,868 A 12/1889 Janes
423,761 A 3/1890 Hasenpflug
426,303 A 4/1890 McGovern
447,068 A 2/1891 Dixon
452,723 A 5/1891 Schmalhausen
471,363 A 3/1892 Sloan
480,148 A 8/1892 Theby
493,159 A 3/1893 Gibson
509,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dillon
551,242 A 12/1895 Wallace
554,448 A 2/1896 Keil
564,426 A 7/1896 Hubbard
572,591 A 12/1896 Woodard
587,424 A 8/1897 Bonine
590,225 A 9/1897 Hill
653,458 A 7/1900 Paquette
666,596 A 1/1901 Breen
683,928 A 10/1901 Geraghty
688,491 A 12/1901 Sigler
695,736 A 3/1902 Kendrick
698,742 A 4/1902 Scharnweber
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,888 A 12/1903 McElwee
749,469 A 1/1904 Assorati
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Hearnshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
913,730 A 3/1909 Kapus
926,899 A 7/1909 Roy
928,408 A 7/1909 Taube
948,628 A 2/1910 Jefferis
959,150 A 5/1910 Morris
963,983 A 7/1910 Bernhard
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilburn
1,051,918 A 2/1913 Rowley
1,059,999 A 4/1913 James
1,069,079 A 7/1913 Voight
1,077,487 A 11/1913 Miller
1,080,172 A 12/1913 Rusk
1,100,820 A 6/1914 Edwards
1,121,228 A 12/1914 Burkhart
1,122,020 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Hoillis
1,243,115 A 10/1917 Shur
1,244,725 A 10/1917 Gadke
1,253,810 A 1/1918 Gianninalo
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditlefsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher

(56) References Cited

U.S. PATENT DOCUMENTS

| | | | |
|---|---|---|---|
| 1,387,302 | A | 8/1921 | Page |
| 1,388,272 | A | 8/1921 | Lawrence |
| 1,393,628 | A | 10/1921 | Leichter |
| 1,398,174 | A | 11/1921 | Carlson |
| 1,399,897 | A | 12/1921 | Singer |
| 1,412,154 | A | 4/1922 | Wollesen |
| 1,439,585 | A | 12/1922 | Trost |
| 1,461,467 | A | 7/1923 | Stuart |
| 1,463,866 | A | 8/1923 | Bourbeau |
| 1,470,858 | A | 10/1923 | Maxwell |
| 1,485,382 | A | 3/1924 | Foley |
| 1,490,874 | A | 4/1924 | Webb |
| 1,516,995 | A | 11/1924 | Trigueiro |
| 1,550,532 | A | 8/1925 | French |
| 1,552,690 | A | 9/1925 | Frantz |
| 1,587,037 | A | 6/1926 | Rudolph |
| 1,601,051 | A | 9/1926 | Wilbert |
| 1,605,717 | A | 11/1926 | Gregg |
| 1,619,031 | A | 3/1927 | Ostrosky |
| 1,622,742 | A | 3/1927 | Shipman |
| 1,656,818 | A | 1/1928 | Dillon |
| 1,692,579 | A | 11/1928 | Schrader |
| 1,704,946 | A | 3/1929 | Lindgren |
| 1,712,792 | A | 5/1929 | Hansen |
| 1,715,957 | A | 6/1929 | Stein |
| 1,724,637 | A | 8/1929 | Bergstrom |
| 1,750,715 | A | 3/1930 | Jeffers |
| 1,794,171 | A | 2/1931 | Grutel |
| 1,812,288 | A | 6/1931 | Drapeau |
| 1,819,824 | A | 8/1931 | McAllister |
| 1,864,253 | A | 6/1932 | McIntyre |
| 1,869,274 | A | 7/1932 | Phillips |
| 1,877,177 | A | 9/1932 | Hinderer |
| 1,891,940 | A | 12/1932 | McAllister |
| 1,900,936 | A | 3/1933 | Huttger |
| 1,901,974 | A | 3/1933 | Macy |
| 1,918,114 | A | 7/1933 | Lorenzen |
| 1,922,062 | A | 8/1933 | Sullivan |
| 1,940,084 | A | 12/1933 | Grasso |
| 1,960,034 | A | 5/1934 | Stewart |
| 1,964,114 | A | 6/1934 | Gerlach |
| 2,095,057 | A | 10/1937 | Corrado |
| 2,122,661 | A | 7/1938 | Rightmyer |
| 2,126,995 | A | 8/1938 | Kingdon |
| 2,136,408 | A | 11/1938 | Bedell |
| 2,158,260 | A | 5/1939 | Stillman |
| 2,202,561 | A | 5/1940 | Lahiere |
| 2,232,965 | A | 2/1941 | Perl |
| 2,272,145 | A | 2/1942 | Anderson |
| 2,326,084 | A | 8/1943 | Westrope |
| 2,369,584 | A | 2/1945 | Lundholm |
| 2,452,521 | A | 10/1948 | Johnson |
| 2,480,016 | A | 8/1949 | Granberg |
| 2,480,988 | A | 9/1949 | Walton |
| 2,500,349 | A | 3/1950 | Menns |
| 2,503,370 | A | 4/1950 | Zanona |
| 2,523,559 | A | 9/1950 | Couture |
| 2,627,278 | A | 10/1950 | Schemansky |
| 2,537,736 | A | 1/1951 | Carlson |
| 2,560,274 | A | 7/1951 | Cantelo |
| 2,581,816 | A | 1/1952 | Schlueter |
| 2,590,624 | A | 3/1952 | James |
| 2,599,196 | A | 6/1952 | Peremi |
| 2,605,125 | A | 7/1952 | Emerson |
| 2,612,398 | A | 9/1952 | Miller |
| 2,613,526 | A | 10/1952 | Holmsten |
| 2,621,951 | A | 12/1952 | Osladal |
| 2,645,515 | A | 7/1953 | Thomas |
| 2,648,967 | A | 8/1953 | Holmsten |
| 2,670,982 | A | 3/1954 | Banham |
| 2,692,789 | A | 10/1954 | Rivard |
| 2,735,707 | A | 2/1956 | Sylvan |
| 2,758,862 | A | 8/1956 | Endter |
| 2,766,492 | A | 10/1956 | Day |
| 2,789,851 | A | 4/1957 | Lickteig |
| 2,818,919 | A | 1/1958 | Sylvan |
| 2,846,258 | A | 8/1958 | Granberg |
| 2,855,772 | A | 10/1958 | Hillgren |
| 2,884,276 | A | 4/1959 | Baptist |
| 2,920,914 | A | 1/1960 | Jenkins |
| 2,941,832 | A | 6/1960 | Grossman |
| 2,997,323 | A | 8/1961 | Riser |
| 3,027,188 | A | 3/1962 | Eichstadt |
| 3,122,387 | A | 2/1964 | Wakelin |
| 3,135,542 | A | 6/1964 | Wilkenson |
| 3,187,526 | A | 6/1965 | Moler |
| 3,267,613 | A | 8/1966 | McQuiston |
| 3,288,510 | A | 11/1966 | Gough |
| 3,352,586 | A | 11/1967 | Hakanson |
| 3,362,740 | A | 1/1968 | Burns |
| 3,422,575 | A | 1/1969 | Armstrong |
| 3,425,729 | A | 2/1969 | Bisbing |
| 3,438,153 | A | 4/1969 | Lemme |
| 3,469,877 | A | 9/1969 | Hutchison |
| 3,599,452 | A | 8/1971 | Maruyama |
| 3,600,019 | A | 8/1971 | Toyota |
| 3,642,315 | A | 2/1972 | Alpern |
| 3,645,573 | A | 2/1972 | Strang |
| 3,683,652 | A | 8/1972 | Halopoff |
| 3,706,467 | A | 12/1972 | Martin |
| 3,762,750 | A | 10/1973 | Orr |
| 3,811,718 | A | 5/1974 | Bates |
| 3,907,348 | A | 9/1975 | Bates |
| 3,919,808 | A | 11/1975 | Simmons |
| 3,927,906 | A | 12/1975 | Mieras |
| 3,930,678 | A | 1/1976 | Alexander |
| 4,063,766 | A | 2/1977 | Grasberg |
| 4,054,308 | A | 10/1977 | Prohaska |
| 4,059,298 | A | 11/1977 | Van Klompenburg |
| 4,068,871 | A | 1/1978 | Mercer |
| 4,095,827 | A | 6/1978 | Stavenau |
| 4,095,829 | A | 6/1978 | Van Klompenburg |
| 4,102,546 | A | 7/1978 | Costello |
| 4,151,682 | A | 5/1979 | Schmidt |
| 4,165,894 | A | 8/1979 | Wojciechowski |
| 4,223,930 | A | 9/1980 | Costello |
| 4,227,345 | A | 10/1980 | Durham |
| 4,235,465 | A | 11/1980 | Costello |
| 4,253,688 | A | 3/1981 | Hosooka |
| 4,261,602 | A | 4/1981 | Anderson |
| 4,274,666 | A | 6/1981 | Peck |
| 4,293,154 | A | 10/1981 | Cassells |
| 4,303,264 | A | 12/1981 | Uehara |
| 4,305,612 | A | 12/1981 | Hunt |
| 4,392,329 | A | 7/1983 | Suzuki |
| 4,429,910 | A | 2/1984 | Anderson |
| 4,470,277 | A | 9/1984 | Uyeda |
| 4,475,311 | A | 10/1984 | Gibson |
| 4,525,952 | A | 7/1985 | Cunningham |
| 4,580,366 | A | 4/1986 | Hardy |
| 4,587,759 | A | 5/1986 | Gray |
| 4,621,847 | A | 11/1986 | Paulson |
| 4,624,073 | A | 11/1986 | Randall |
| 4,639,021 | A | 1/1987 | Hope |
| 4,643,005 | A | 2/1987 | Logas |
| 4,655,489 | A | 4/1987 | Bisbing |
| 4,736,972 | A | 4/1988 | Mosch |
| 4,801,164 | A | 1/1989 | Mosch |
| 4,813,725 | A | 3/1989 | Mosch |
| 4,824,154 | A | 4/1989 | Simpson |
| 4,826,222 | A | 5/1989 | Davis |
| 4,827,685 | A | 5/1989 | Schmidt |
| 4,893,849 | A | 1/1990 | Schlack |
| 4,922,658 | A | 5/1990 | Coddens |
| 4,923,230 | A | 5/1990 | Simpson |
| 4,949,506 | A | 8/1990 | Durham |
| 4,961,286 | A | 10/1990 | Bezubic |
| 4,991,886 | A | 2/1991 | Nolte |
| 5,042,855 | A | 8/1991 | Bennett |
| 5,072,464 | A | 12/1991 | Draheim |
| 5,076,015 | A | 12/1991 | Manzalini |
| 5,087,087 | A | 2/1992 | Vetter |
| 5,087,088 | A | 2/1992 | Milam |
| 5,090,750 | A | 2/1992 | Lindqvist |

(56) References Cited

U.S. PATENT DOCUMENTS 5,090,754 A 2/1992 Thompson
5,092,640 A 3/1992 Plummer
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,217,264 A 6/1993 Fier
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb
5,536,052 A 7/1996 Maier
5,553,903 A 9/1996 Prete
5,560,149 A 10/1996 Lafevre
5,575,116 A 11/1996 Carlson
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian
5,741,032 A 4/1998 Chaput
5,778,602 A 7/1998 Johnsen
5,791,700 A 8/1998 Biro
5,806,900 A 9/1998 Bratcher
5,829,196 A 11/1998 Maier
5,839,767 A 11/1998 Piltingsrud
5,901,499 A 5/1999 Delaske
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon
6,000,735 A 12/1999 Jourdenais
6,086,121 A 7/2000 Buckland
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schulz
6,176,041 B1 1/2001 Roberts
6,178,696 B1 1/2001 Liang
6,183,024 B1 2/2001 Schultz
6,209,931 B1 4/2001 Von Stoutenborough
6,217,087 B1 4/2001 Fuller
6,230,443 B1 5/2001 Schultz
6,250,694 B1 6/2001 Weiland
6,279,266 B1 8/2001 Searcy
6,349,576 B2 2/2002 Subliskey
6,364,375 B1 4/2002 Szapucki
6,450,544 B2 9/2002 Rofondi
6,546,671 B2 4/2003 Mitchell
6,565,133 B1 5/2003 Timothy
6,568,723 B2 5/2003 Murphy
6,588,150 B1 7/2003 Wong
6,592,155 B1 7/2003 Lemley
6,607,221 B1 8/2003 Elliott
6,631,931 B2 10/2003 Magnusson
6,634,683 B1 10/2003 Brannan
6,688,659 B2 2/2004 Kobrehel
6,817,142 B2 11/2004 Marshik
6,848,728 B2 2/2005 Rotondi
6,871,885 B2 3/2005 Goldenberg
6,871,886 B2 3/2005 Coleman
6,877,784 B2 4/2005 Kelley
6,925,758 B2 8/2005 Petit
6,957,513 B2 10/2005 Pettit
6,983,963 B2 1/2006 Eslick
7,000,957 B2 2/2006 Lawrence
7,013,603 B2 3/2006 Eenigenburg
7,017,957 B2 5/2006 Murphy
7,036,851 B2 5/2006 Romig
7,063,361 B1 6/2006 Lawrence
7,070,211 B2 7/2006 Polowinczak
7,070,215 B2 7/2006 Kelley
7,100,951 B2 9/2006 Jien
7,147,255 B2 12/2006 Goldenberg
7,159,908 B2 1/2007 Liang
7,171,784 B2 2/2007 Eenigenburg
7,296,831 B2 11/2007 Generowicz
7,322,619 B2 1/2008 Nolte
7,322,620 B1 1/2008 Lawrence
7,407,199 B2 8/2008 Richardson
7,431,356 B2 10/2008 Liang
7,441,811 B2 10/2008 Lawrence
7,481,470 B2 1/2009 Eenigenburg
7,510,221 B2 3/2009 Eenigenburg
7,530,611 B2 5/2009 Liang
7,559,588 B2 7/2009 Liang
7,607,262 B2 10/2009 Pettit
7,637,544 B2 12/2009 Liang
7,665,775 B1 2/2010 Miller
7,699,365 B2 4/2010 Liang
7,922,223 B2 4/2011 Lawrence
7,976,077 B2 7/2011 Flory
8,205,919 B2 6/2012 Flory
8,205,920 B2 6/2012 Flory
8,220,846 B2 7/2012 Liang
8,231,148 B2 7/2012 Van Der Kooij
8,235,430 B2 8/2012 Liang
8,272,164 B2 9/2012 Albrecht
8,336,930 B2 12/2012 Liang
8,360,484 B2 1/2013 Liang
8,414,039 B2 4/2013 Liang
8,511,724 B2 8/2013 Liang
8,550,507 B2 10/2013 Barton
8,567,830 B2 10/2013 Liang
8,657,347 B2 2/2014 Liang
8,726,572 B2 5/2014 Derham
8,789,857 B2 7/2014 Liang
8,789,862 B2 7/2014 Liang
8,833,809 B2 9/2014 Liang
8,844,985 B2 9/2014 Liang
8,870,244 B2 10/2014 Liang
8,881,461 B2 11/2014 Derham
9,103,144 B2 8/2015 Liang
9,140,033 B2 9/2015 Wolf
9,376,834 B2 6/2016 Liang
9,493,970 B2 11/2016 Campbell
9,816,300 B2 11/2017 Derham
2006/0192391 A1 8/2006 Pettit
2006/0244270 A1 11/2006 Rotondi
2007/0205615 A1 9/2007 Eenigenburg
2008/0012358 A1 1/2008 Liang
2008/0022728 A1 1/2008 Flory
2008/0169658 A1 7/2008 Wolf
2010/0199726 A1 8/2010 Varney
2010/0218425 A1 9/2010 Nolte
2010/0263415 A1 10/2010 Rupsil
2013/0214545 A1 8/2013 Wolf
2013/0283695 A1 10/2013 Hollermann
2015/0252596 A1* 9/2015 Liang ..... E05C 3/045 292/163
2015/0275556 A1* 10/2015 Curtis ..... E05C 17/50 49/449
2016/0069108 A1* 3/2016 Liang ..... E06B 9/02 292/165
2016/0076282 A1 3/2016 Wolf

FOREIGN PATENT DOCUMENTS

GB 2 461 079 12/2009

(56) References Cited

FOREIGN PATENT DOCUMENTS

| | | |
|---|---|---|
| GB | 2 461 107 | 12/2009 |
| GB | 2 461 108 | 12/2009 |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.
"Engineering Fit," available at: https://en.wikipedia.org/wiki/Engineering_fit, Jul. 8, 2019.

* cited by examiner (3rd Retracted Position)

(2nd Retracted Position)

(Extended Lock Position)

(1st Retracted Position)

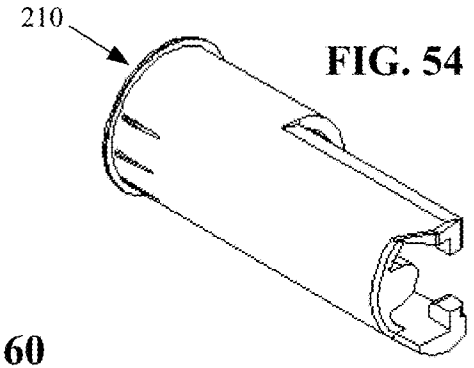
FIG. 54
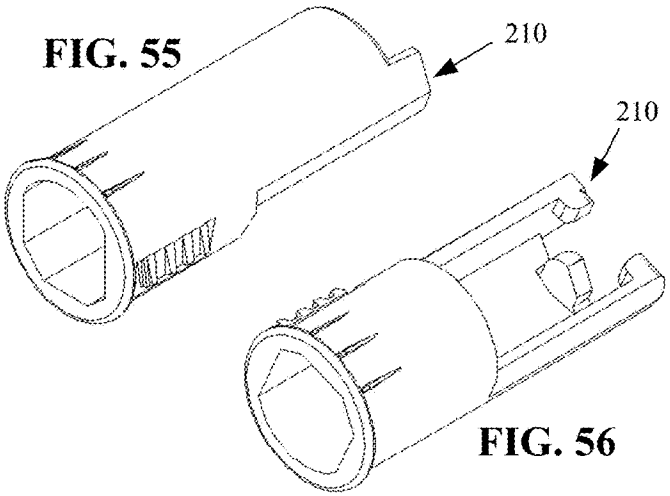
FIG. 55
FIG. 56
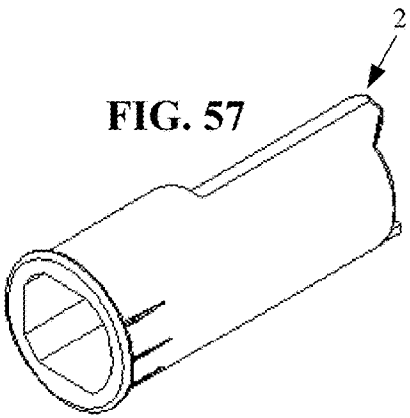
FIG. 57
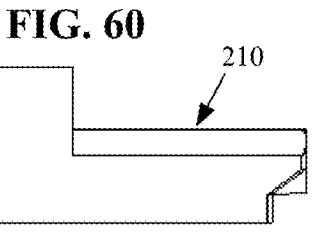
FIG. 60
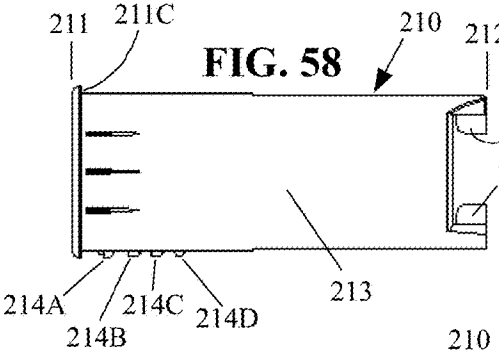
FIG. 58
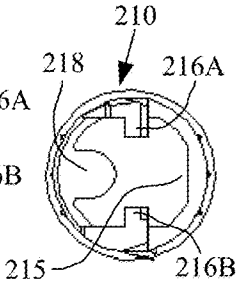
FIG. 62
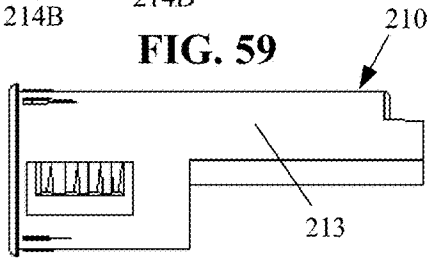
FIG. 59
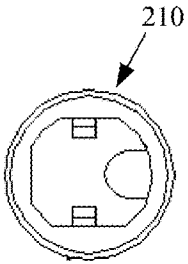
FIG. 61

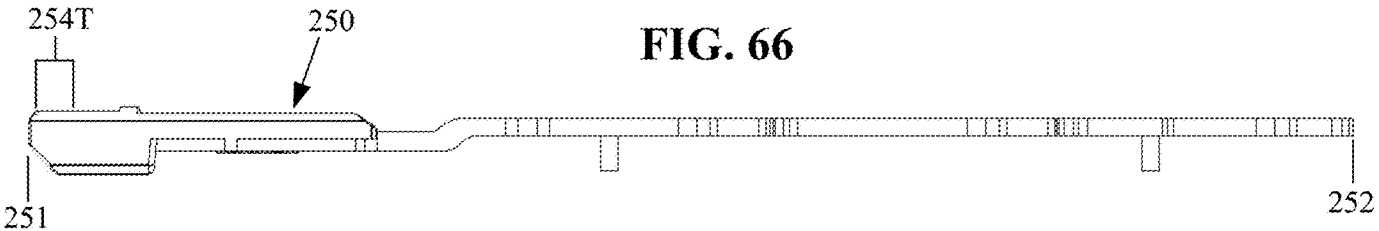
FIG. 66
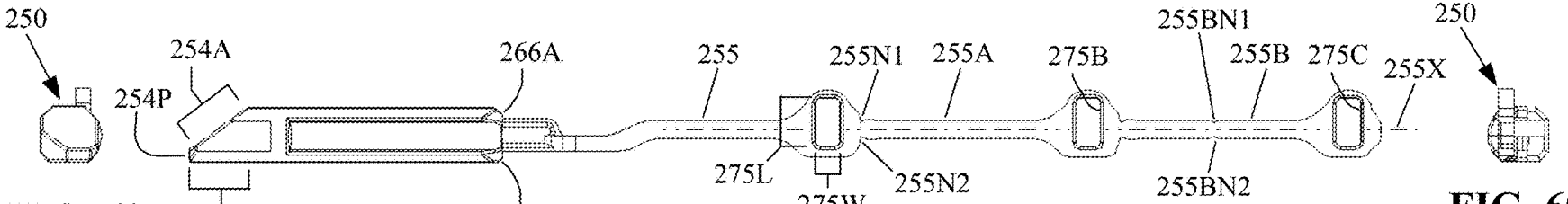
FIG. 69
FIG. 65
FIG. 68
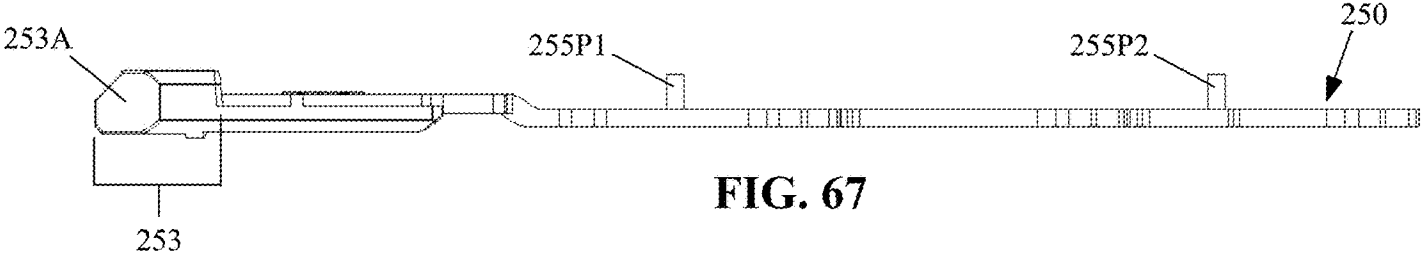
FIG. 67

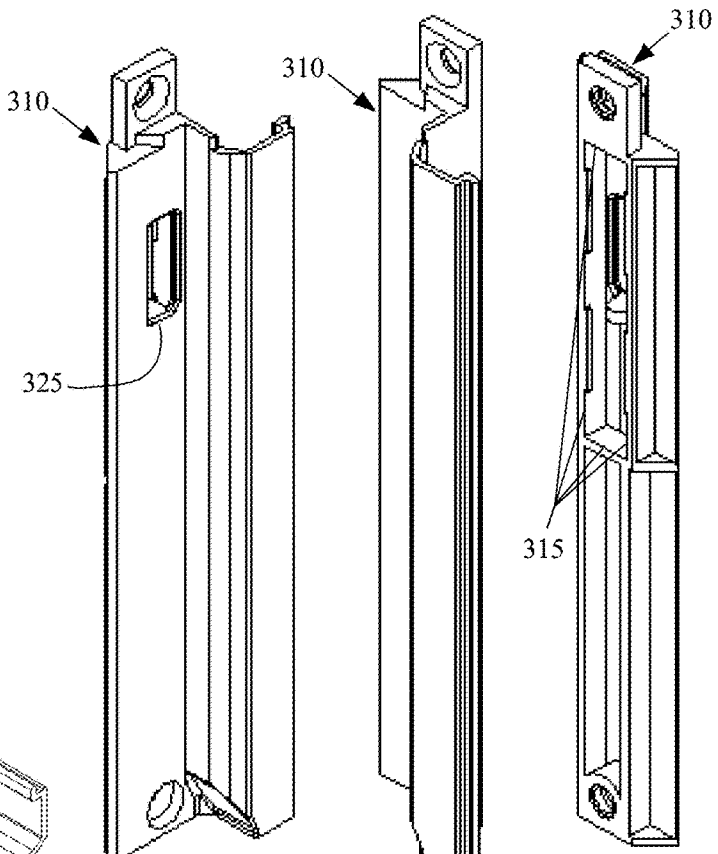
FIG. 84
FIG. 83
FIG. 82
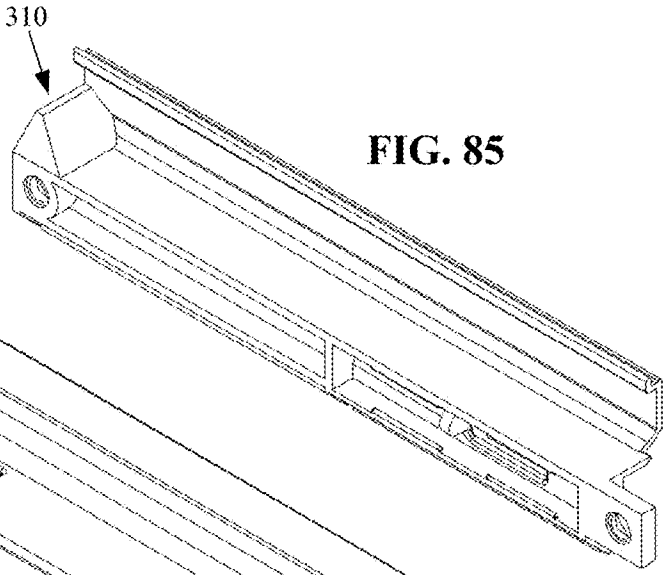
FIG. 85
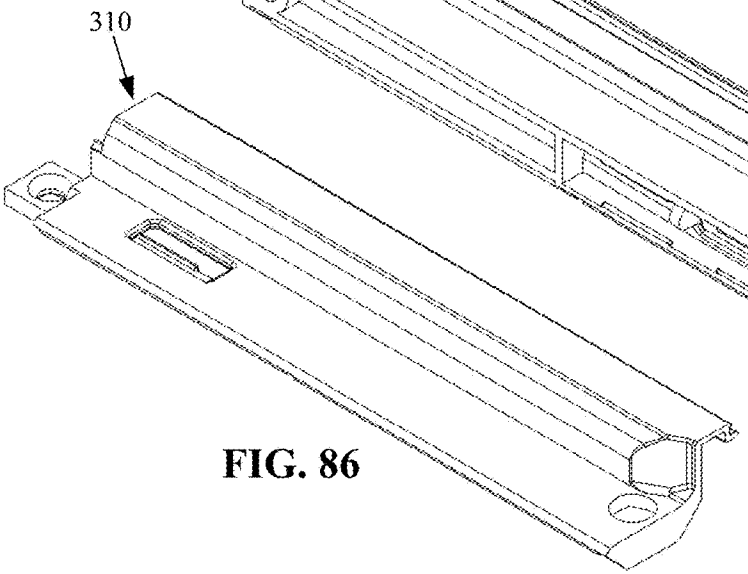
FIG. 86

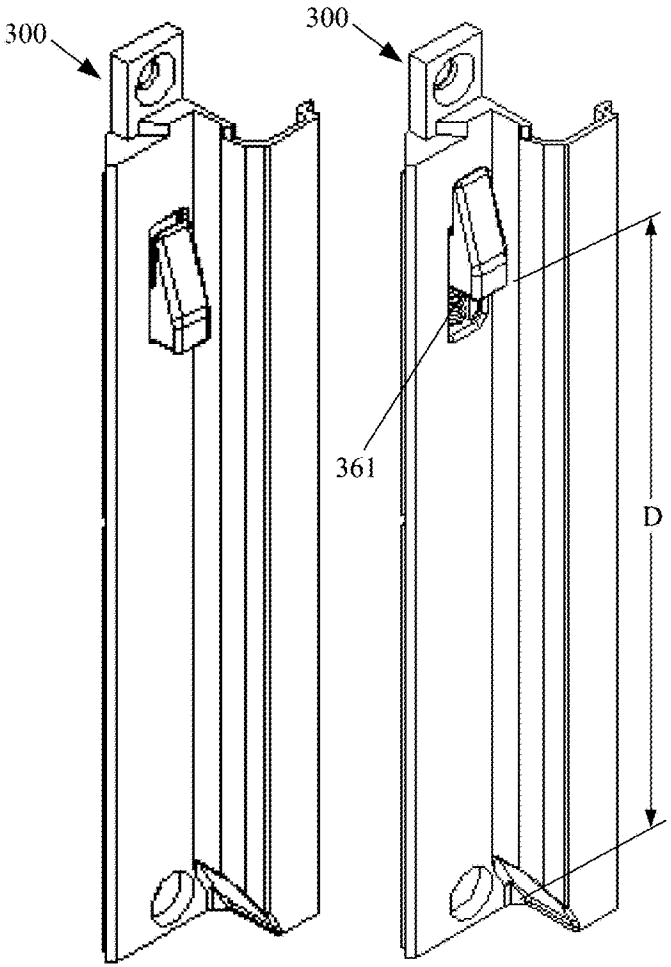
FIG. 105B
FIG. 105A
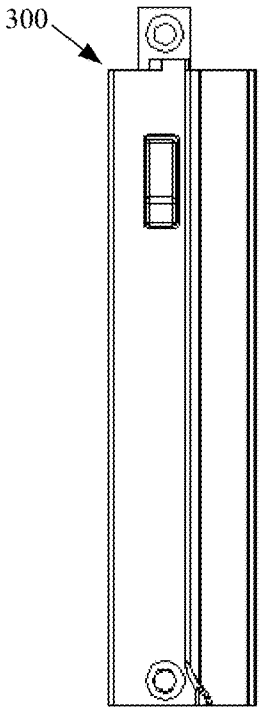
FIG. 110
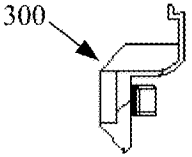
FIG. 108
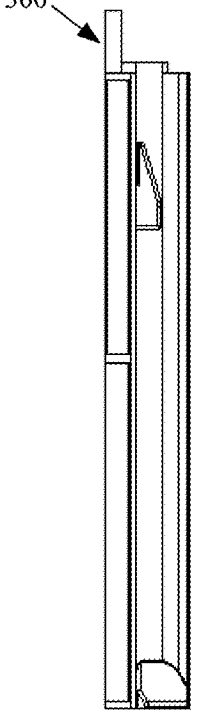
FIG. 106
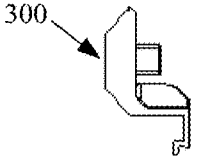
FIG. 107
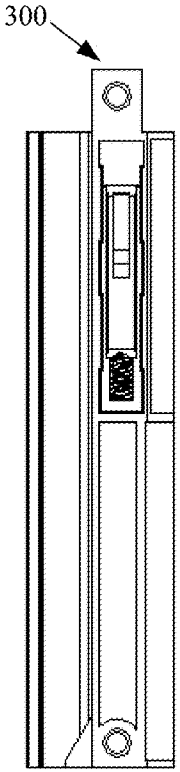
FIG. 109

COMBINATION SASH LOCK AND TILT LATCH AND SLIDABLE WINDOW VENT STOP

CROSS REFERENCES TO RELATED APPLICATIONS

This application claims priority on U.S. Provisional Application Ser. No. 62/573,805 filed on Oct. 18, 2017, having the title "Improved Lock Tilt Combo with WOCD," the disclosures of which are incorporated herein by reference.

FIELD OF THE INVENTION

The present invention relates to improvements in locks and tilt latches for slidable sash windows, and more particularly to improvements to an integral sash lock/tilt latch combination that furthermore includes a window vent stop capability.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of these sliding sash windows, it is common for window manufacturers to incorporate a tilt latch device thereon that permits one end of the sliding sash window to be released from the track of the master window frame. This allows the sash window to be pivoted/tilted into the room, for easy access to the exterior surface of the glazing that is normally exposed to the exterior environment of the building.

The present invention seeks to provide improvements to such window hardware in the form of a new sash lock and tilt latch and stop assembly for single hung or double hung windows.

OBJECTS OF THE INVENTION

It is an object of the invention to provide a sash lock to prevent relative sliding movement of one or both sliding sash windows that is/are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively.

It is another object of the invention to provide a sash lock and tilt latch that may act cooperatively to furthermore limit the travel of a window to provide a vent opening that is too small to permit egress of a small child therefrom.

It is yet another object of the invention to provide a sash lock, tilt latch, and vent stop arrangement that provides for damped movement of the sliding window as it approaches the limited window open (vent) position.

It is also an object of the invention to provide a sash lock that may be blindly coupled to a tilt latch device for cooperative interaction and actuation of the latch.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The arrangement disclosed herein for a sliding sash window or door may include a sash lock assembly that may be interconnected with a tilt latch assembly. The sash lock assembly may be mounted to the top of the meeting rail of the sash window. The sash lock assembly may include a housing and a cam pivotally mounted to the housing, being configured to pivot out from a cavity in the housing to releasably engage a keeper on the master window frame (or on a second sliding sash window) in a "lock" position, to lock the sash window (or windows) and prevent it from sliding and/or tilting. The sash lock assembly may also include a lever arm that may be pivotally mounted to the housing, and which may be configured for a portion thereof to extend beyond the mounting surface of the sash lock housing, and into the hollow of the meeting rail. The cam may have a graspable shaft portion that may protrude upwardly, out from an orifice in the sash lock housing, to permit actuation of the device (cam rotation) by a user. Alternatively, the device may have a separate handle member secured to the cam, where the handle may facilitate easy rotation and counter-rotation of the cam for actuation of the sash lock assembly and the interconnected tilt latch assembly.

The latch assembly may be received through an opening on aside of the sash member. The latch assembly may include a housing, a latch member slidably disposed within the housing, and a spring to bias the latch member. A portion of the latch member is configured to receive the lever arm of the lock assembly, when positioned within the hollow meeting rail, for coupling therebetween. The latch housing, the latch member, and the spring are configured to normally bias the latch member, so that a portion of one end (i.e., a portion of its "tongue") may protrude out from the latch housing, and out of the sash window frame.

With the cam releasably secured in the "lock" position (e.g., using a detent mechanism), the cam may prevent sliding of the sash window through its engagement with the keeper, and the latch member may also be in its fully extended position, which would prevent tilting of the sash window. The sash window may be redundantly locked as to any sliding motion with respect to the master window frame by a first portion of a stop assembly (e.g., a bottom surface of a stop assembly housing), which stop assembly may be secured to the master window frame (e.g., in a track thereof within which the sash member may slide). The first portion of the stop assembly may protrude a first distance away from the wall of the master window frame, and may thereat block sliding movement of the tongue of the latch member that is biased to protrude into the track to provide a secondary lock feature with respect to sliding of the sash window away from its closed position.

When actuation of the shaft/handle member causes the cam to rotate (e.g., 135 degrees from the locked position), it may move the cam from the extended lock position into a first retracted cam position—a position where the cam is disengaged from the keeper on the master window frame, and itself would no longer prevent the sash window from sliding. Rotation of the cam into the first retracted cam position may cause a portion thereof to contact a follower portion of the lever arm and also thereby drive the lever arm to rotate, which rotation may act to oppose the biasing of the latch member to actuate it a discrete amount, through the interconnection therebetween, to move the latch member and its tongue into a corresponding first retracted latch member position. With the latch member in the first retracted latch member position, the end of its tongue may be positioned clear of the first portion of the stop assembly, so that the sash window may slide away from its closed position.

The stop assembly may include a second portion that may protrude a second distance away from the wall of the master window frame, with the second distance being greater than the first distance, and may normally be positioned at a particular height above the first portion. With the tongue of the latch member in the first retracted position, and when sliding of the window away from the closed position, the tongue of the latch member may nonetheless still contact the second portion of the stop assembly to prevent any further sliding movement of the sash window.

This second portion of the stop assembly may provide a vent stop feature (i.e., a window opening control device) that permits sliding of the sash window from its closed position but only up to small elevated position (e.g., 4 inches) that may form an opening small enough to prevent accidental egress by a small child or ingress by an intruder, but which nonetheless provides ventilation. With the latch member in its first retracted position, a portion of its tongue may remain engaged within the track of the master window frame, and may thereat still serve to prevent tilting of the sash member out from the master window frame. Note that the detent mechanism may releasably secure the cam at the first retracted cam position, thereby also releasably securing the latch member at the first retracted latch member position, due to the interconnection therebetween.

In one embodiment, the second portion of the stop assembly may be a separate slidable stop member that may be configured to slide from a first position to a second position, with respect to the housing of the stop assembly. A spring may bias the slidable stop member away from the second position towards the first position. Therefore, initial contact of the tongue of the latch member may be with the slidable stop member in its first position and may not cause any impact loading to the respective parts, as such contact will initially cause the slidable stop member to slide rather than when a fixed stop member is used, which would cause the sliding motion of the sash window to abruptly stop, as the spring biasing will work to oppose the force of such contact. The spring biased slidable stop member may thus serve to damp/cushion such sliding movement of the sash window prior to its movement being terminated at the second position of the slidable stop member, at which point the sash window will be at a limited open (vent) position. This damping action of the spring biased stop member may serve to prolong the life of the relevant vent stop parts, which may be made of plastic, by reducing or eliminating impact loading, and may also provide a tactile indication to the user that the vent feature is engaged, as a user may not be aware of it being activated, and may otherwise be attempting to apply a much larger force in anticipation of sliding the window to a fully open position. The spring biased stop member may also serve another function, as discussed below.

When continued actuation of the shaft/handle member causes the cam to further rotate a discrete amount (e.g., to be at 165 degrees of total rotation from the cam's lock position), to move from the first retracted cam position to a second retracted cam position, the cam may further drive the lever arm to correspondingly rotate a discrete amount, and thus drive the latch member to move into a second retracted latch member position. With the latch member in the second retracted latch member position, the end of the tongue may then be positioned clear of the slidable stop member of the stop assembly, so that the sliding movement of the sash window is no longer limited, and the window may now slide all the way up to the fully open position. However, the tongue may nonetheless remain engaged within the track of the master window frame, and thus still serves to prevent tilting of the sash member out from the master window frame. Also, when the latch member is actuated into the second retracted latch member position, once the end of the tongue is positioned clear of the slidable stop member of the stop assembly, the spring-biased slidable stop member will be biased back to its first (lower) position, and the abrupt stopping of the movement of the low-mass stop member may produce a snapping sound that may serve to audibly alert the user that the window opening control (WOCD) feature is no longer active.

Continued actuation of the shaft/handle member to cause the cam to further rotate yet another discrete amount (e.g., to be at 180 degrees of total rotation from the cam's lock position), to move from the cam from the second retracted position to a third retracted cam position, may cause the cam to further drive the lever arm to correspondingly rotate another discrete amount, and may move the latch member into a third retracted latch member position. With the latch member in the third retracted latch member position, the end of the tongue may then be disengaged from the track of the master window frame, and the sash window is free to be tilted out of the master window frame. Note that a detent mechanism may also releasably secure the cam at the second and/or the third retracted cam positions, thereby also releasably securing the latch member at the corresponding latch member positions.

When the cam/handle member has been moved into the 180 degree position, and is subsequently released, the spring biased latch member may be driven to return to its third retracted position, and the interconnection with the sash lock through the lever arm, may correspondingly cause the lever arm to drive the cam to counter-rotate back to the third retracted (unlock) position. The tongue of the latch member may once again be engaged within the track of the master window frame, to once again permit sliding of the sash window, but prevent tilting. Where no detent is used for the third unlock position of the cam, and the cam/handle is released from the 180 degree position, the spring biased latch member may be driven to return to its second retracted position, and the interconnection with the sash lock through the lever arm may correspondingly cause the lever arm to drive the cam to counter-rotate back to the second retracted (unlock) position.

As the fully opened sash window is moved downward towards its closed window position, a bottom surface of the tongue of the latch member may contact a top surface of the slidable stop member, each of which may be appropriately angled, and thus such contact may operate to cause the latch member to retract against the spring biasing to automatically permit sliding movement of the sash window past the slidable stop member of the stop assembly and into the closed window position. Once clear of (i.e., positioned below) the slidable stop member of the stop assembly, the latch member may again be biased into its first retracted latch position, and its tongue may again restrict upward sliding movement of the window to be at or below the limited open "vent" position. Once the sash window reaches the closed window position, the handle/shaft member may then be actuated to return to zero degrees of rotation to place the cam in the locked position with respect to the keeper, and to extend the latch member for its tongue to again be positioned below the first portion of the housing of the stop assembly, to lock the sash window at two points.

Both a left-hand and right-hand version of the above described sash lock assembly, tilt latching assembly, and corresponding stop assembly may be mounted on a sliding sash window and master frame. The following discussion proceeds with a discussion of installation on one side of the window (i.e., the left side), with the understanding that the left-hand and right-hand arrangements may be used on the window, so that the sash window may be locked at four points—at each of the two cams/keepers, and at each of the two latch/stop assemblies.

BRIEF DESCRIPTION OF THE DRAWINGS

The description of the various example embodiments is explained in conjunction with appended drawings, in which:

FIG. 54 is a first perspective view of a housing used to house the component parts of the latch assembly of FIG. 1;

FIG. 55 is a second perspective view of the housing shown in FIG. 54;

FIG. 56 is a third perspective view of the housing shown in FIG. 54;

FIG. 57 is a fourth perspective view of the housing shown in FIG. 54;

FIG. 58 is a bottom view of the latch housing of FIG. 54;

FIG. 59 is a first side view of the latch housing of FIG. 54;

FIG. 60 is a top view of the latch housing of FIG. 54;

FIG. 61 is a first end view of the latch housing of FIG. 54;

FIG. 62 is a second end view of the latch housing of FIG. 54;

FIG. 65 is a top view of the latch member of FIG. 63;

FIG. 66 is a first side view of the latch member of FIG. 63;

FIG. 67 is a second side view of the latch member of FIG. 63;

FIG. 68 is a first end view of the latch member of FIG. 63;

FIG. 69 is a second end view of the latch member of FIG. 63;

FIG. 82 is a first perspective view of a housing used for the stop assembly of FIG. 1;

FIG. 83 is a second perspective view of the housing of FIG. 82;

FIG. 84 is a third perspective view of the housing of FIG. 82;

FIG. 85 is a fourth perspective view of the housing of FIG. 82;

FIG. 86 is a fifth perspective view of the housing of FIG. 82;

FIG. 105A is a second perspective view of the stop assembly of FIG. 104, showing the slidable stop member after being biased into a first position;

FIG. 105B is a third perspective view of the stop assembly of FIG. 104, with the slidable stop member shown after application of a force to oppose the bias and move it into a second position;

FIG. 106 is a front view of the stop assembly of FIG. 104;

FIG. 107 is a first end view of the stop assembly of FIG. 104;

FIG. 108 is a second end view of the stop assembly of FIG. 104;

FIG. 109 is a rear view of the stop assembly of FIG. 104;

FIG. 110 is a front view of the stop assembly of FIG. 104;

FIG. 113 is a bottom view of the keeper of FIG. 111;

FIG. 114 is a top view of the keeper of FIG. 111;

FIG. 115 is a first end view of the keeper of FIG. 111;

FIG. 116 is a second end view of the keeper of FIG. 111;

Figure 1:
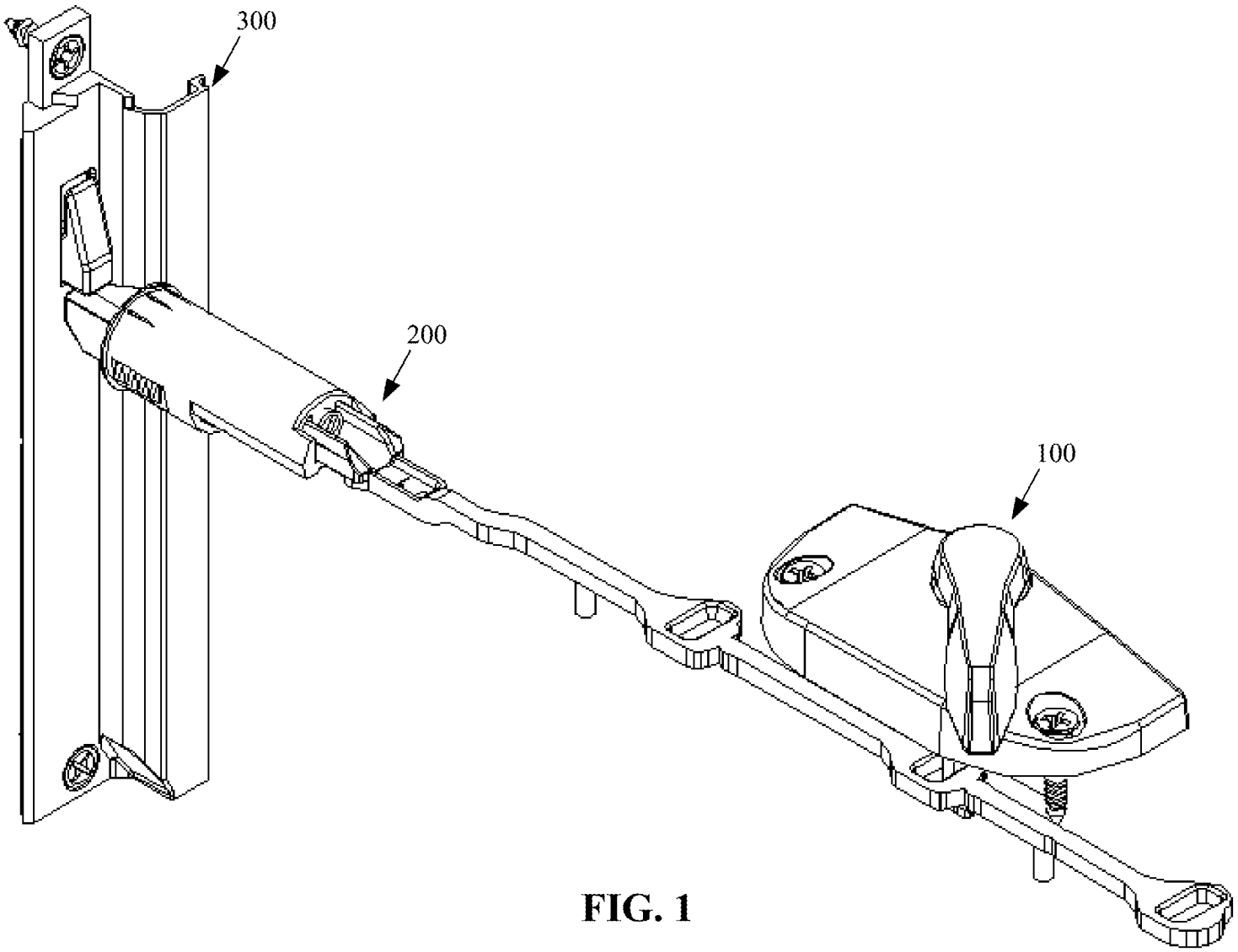
FIG. 1 is a perspective view of a sash lock assembly, a tilt latch assembly, and a stop assembly for use on a sash window.
Figure 2:
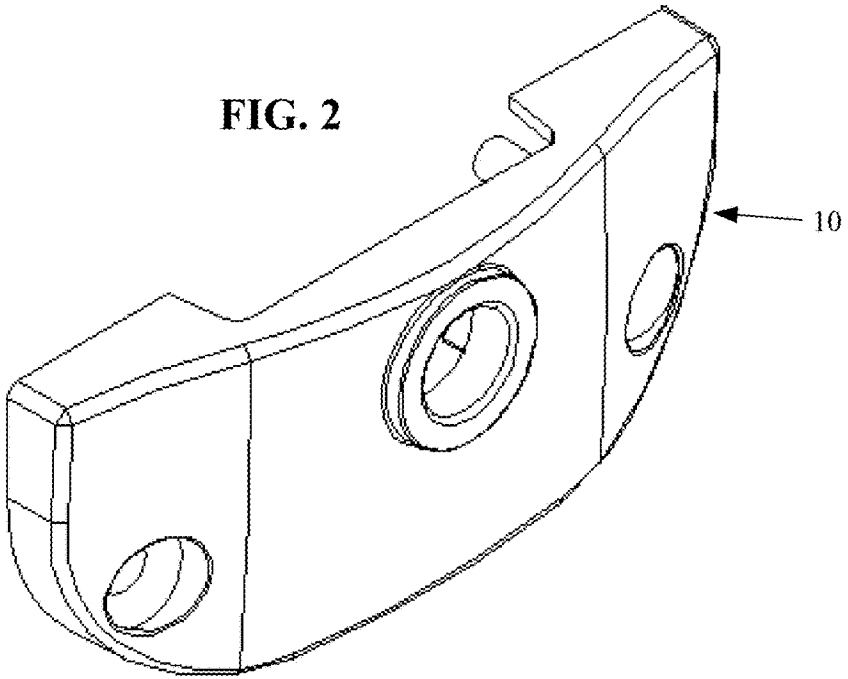
FIG. 2 is a first perspective view of a housing that may be used to house the component parts of the sash lock assembly of FIG. 1.
Figure 3:
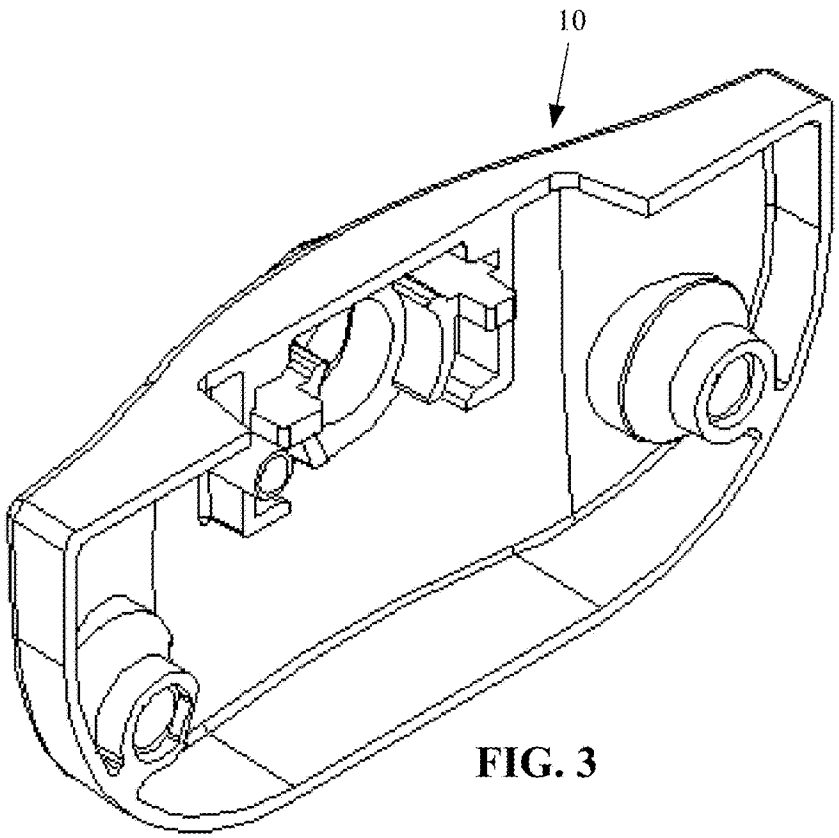
FIG. 3 is a second perspective view of the housing of FIG. 2.
Figure 4:
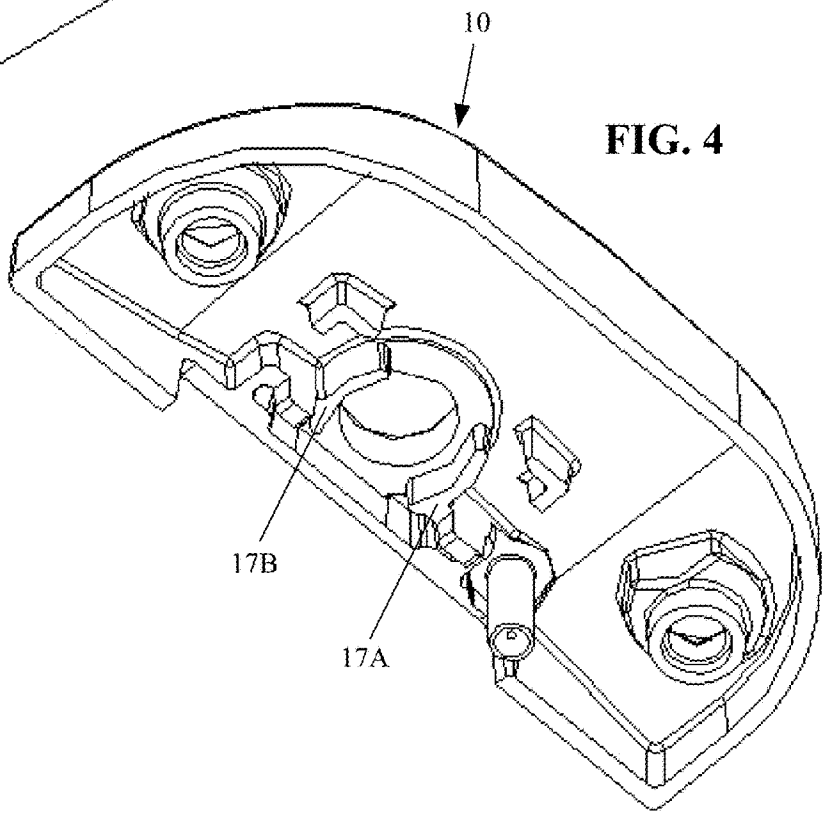
FIG. 4 is a third perspective view of the housing of FIG. 2.
Figure 5:
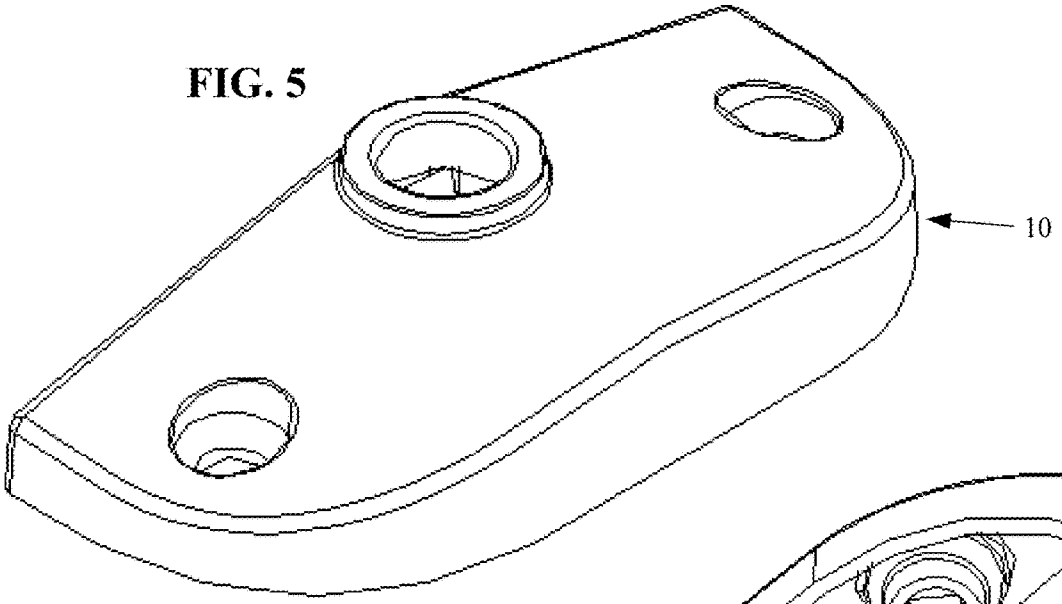
FIG. 5 is a fourth perspective view of the housing of FIG. 2.
Figure 44:
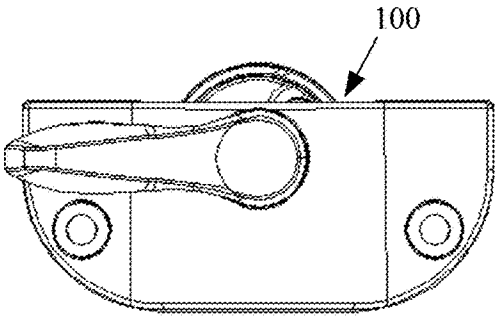
FIG. 44 is a top view of the sash lock assembly of FIG. 1.
Figure 46:
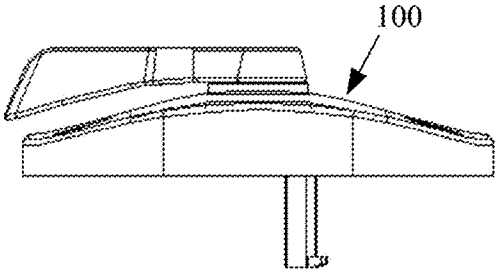
FIG. 46 is a rear view of the sash lock assembly of FIG. 44.
Figure 47:
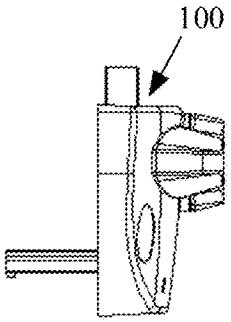
FIG. 47 is a first end view of the sash lock assembly of FIG. 44.
Figure 49A:
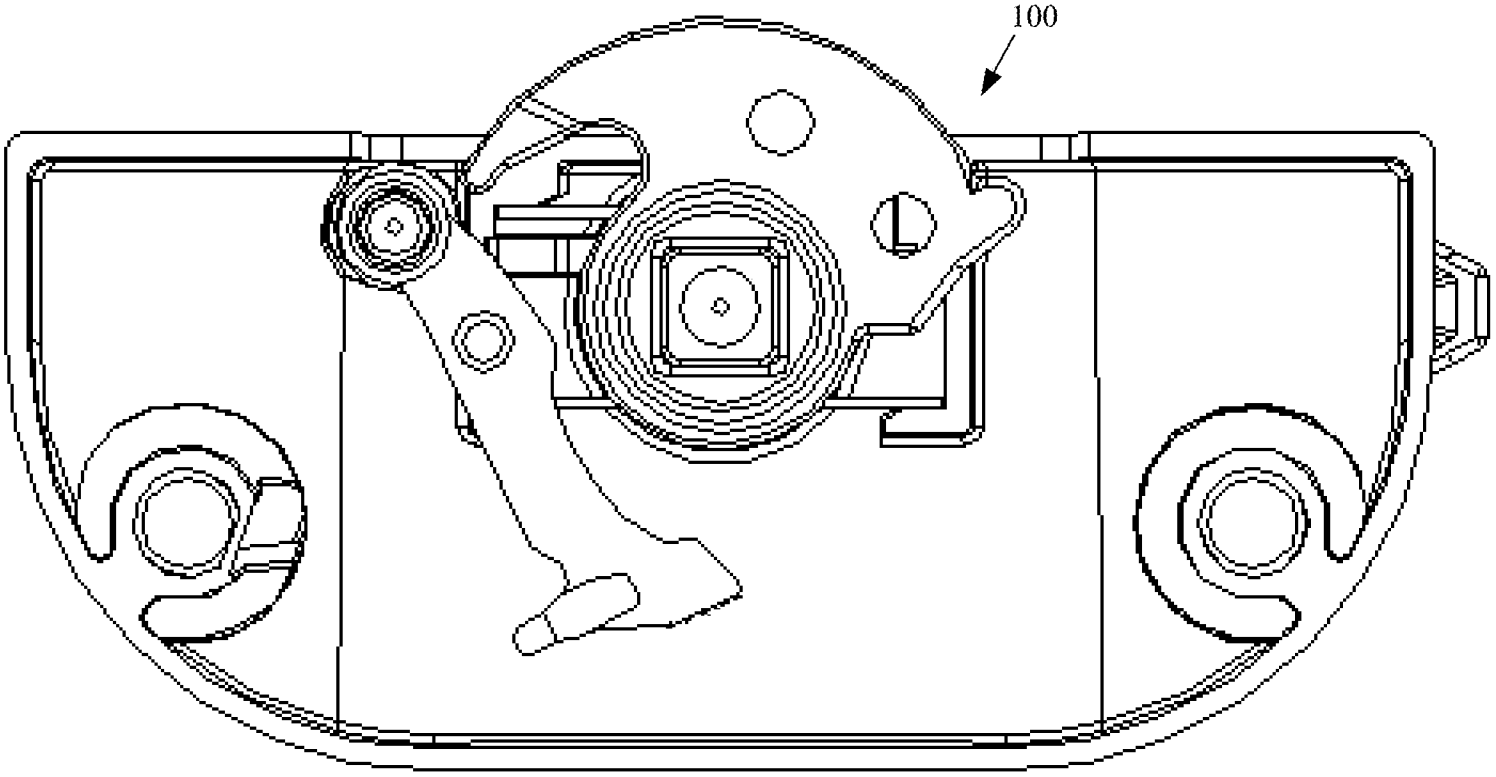
FIG. 49A is the bottom view of FIG. 49 shown enlarged.
Figure 50:
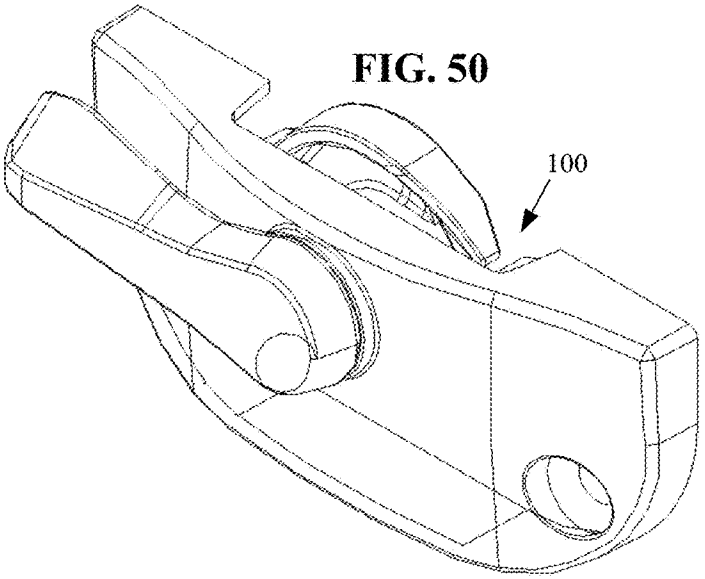
FIG. 50 is a first perspective view of the sash lock assembly of FIG. 44.
Figure 51:
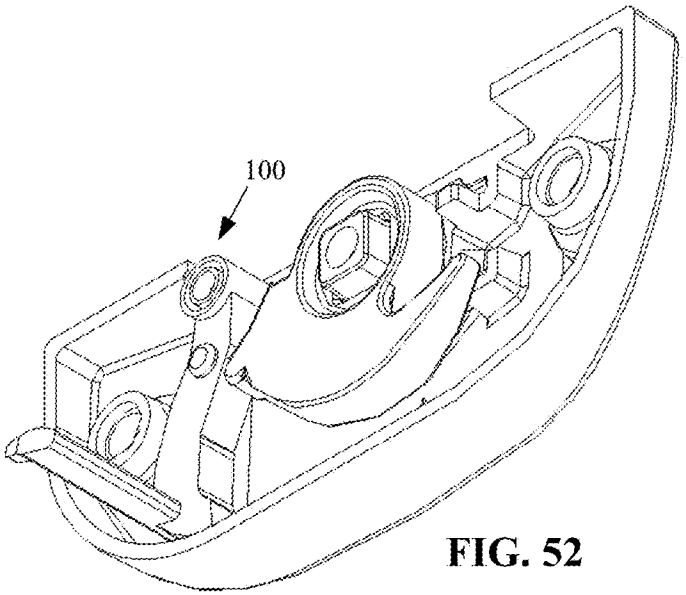
FIG. 51 is a second perspective view of the sash lock assembly of FIG. 44.
Figure 52:
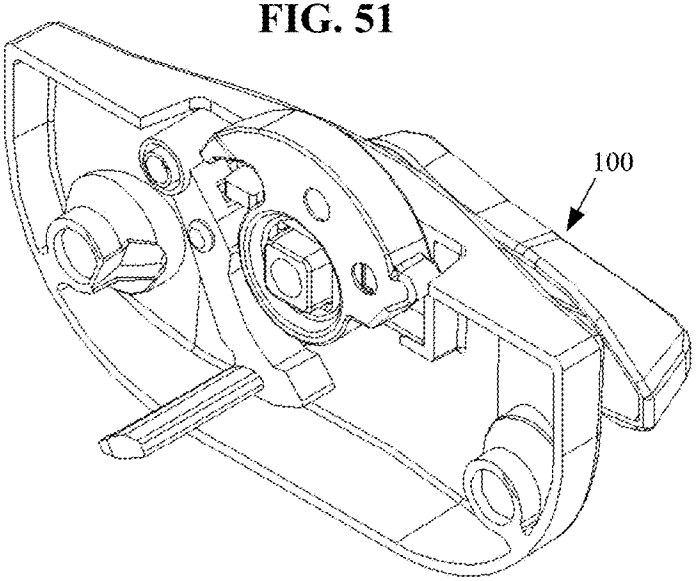
FIG. 52 is a third perspective view of the sash lock assembly of FIG. 44.
Figure 74:
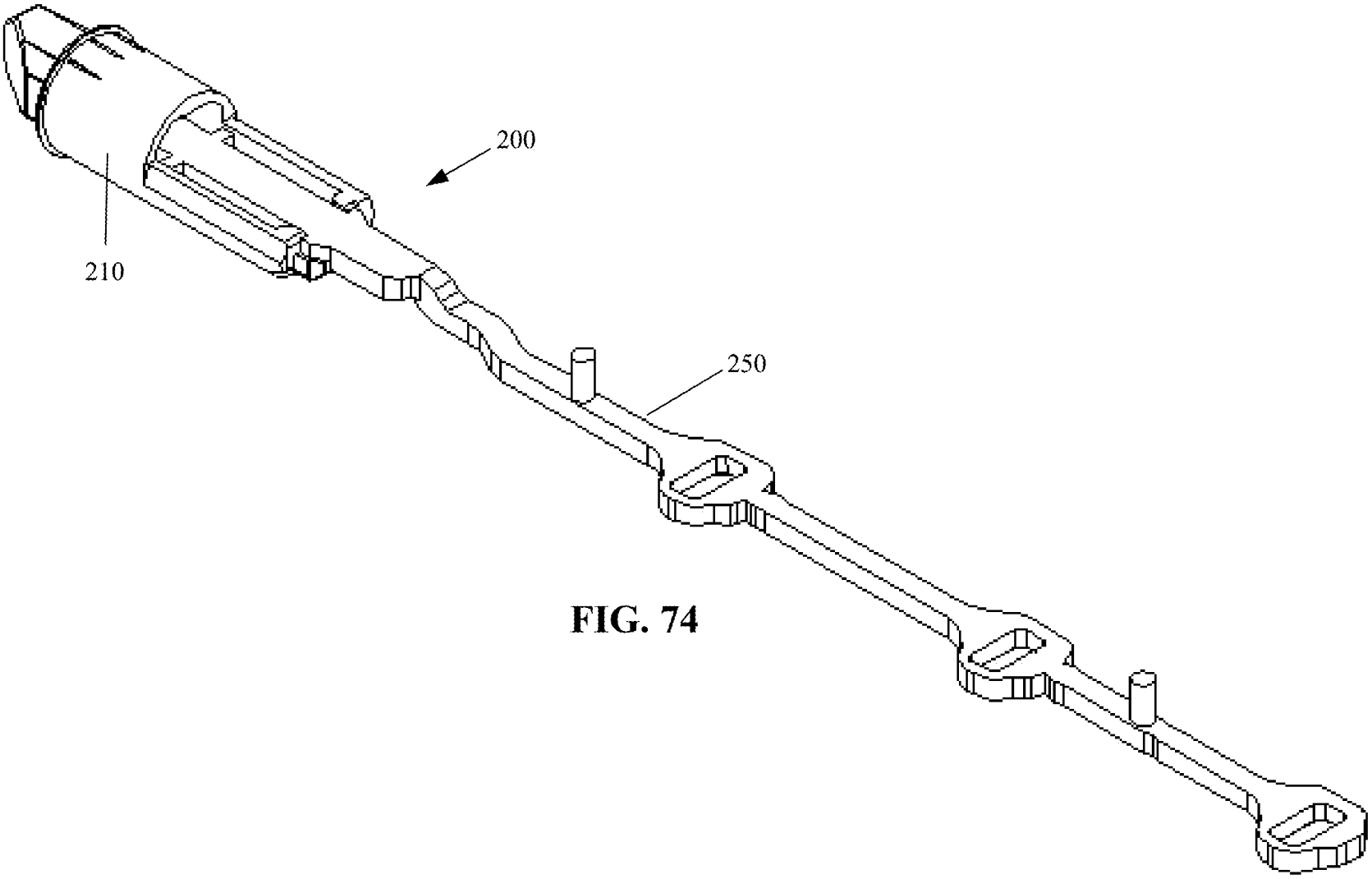
FIG. 74 is a first perspective view of the latch assembly of FIG. 1, shown with the latch member biased into its extended position.
Figure 75:
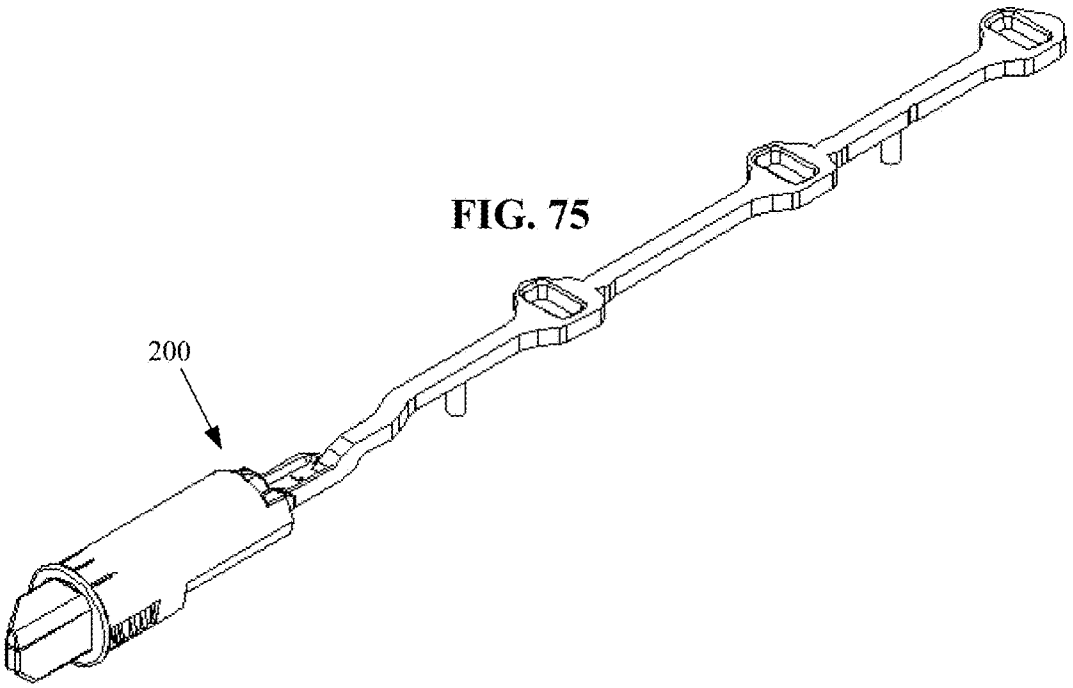
FIG. 75 is a second perspective view of the latch assembly of FIG. 74.
Figure 111:
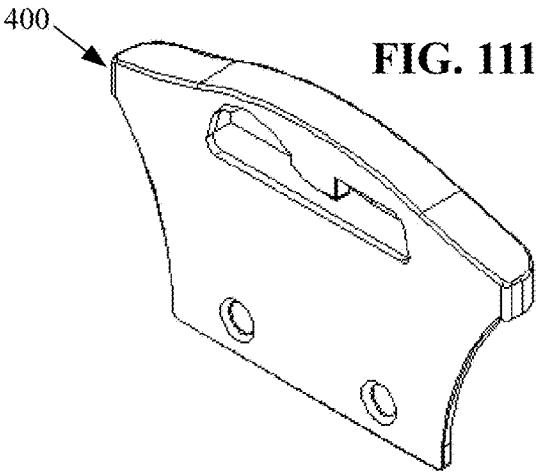
FIG. 111 is a perspective view of a keeper that may be engaged by the locking cam of FIG. 20 of the sash lock of FIG. 44.
Figure 117:
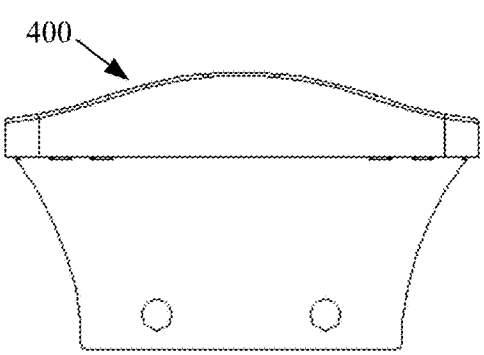
Figure 116:
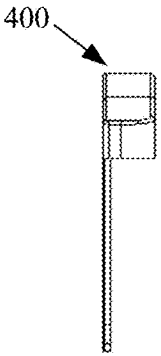
Figure 114:
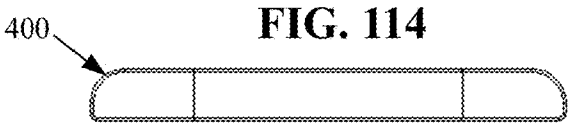
Figure 112:
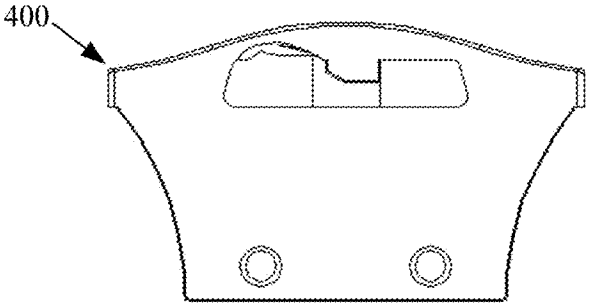
FIG. 112 is a front view of the keeper of FIG. 111.
Figure 113:
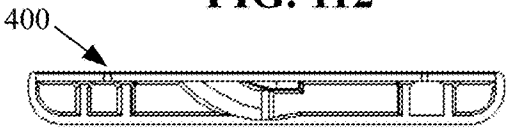
Figure 115:
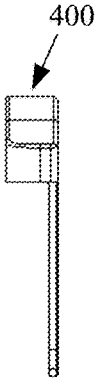
Figure 118:
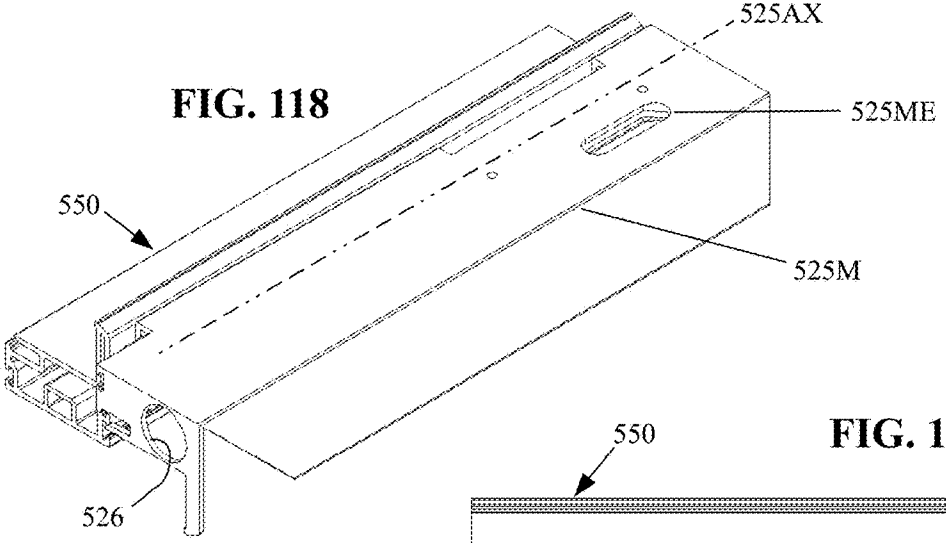
Figure 121:
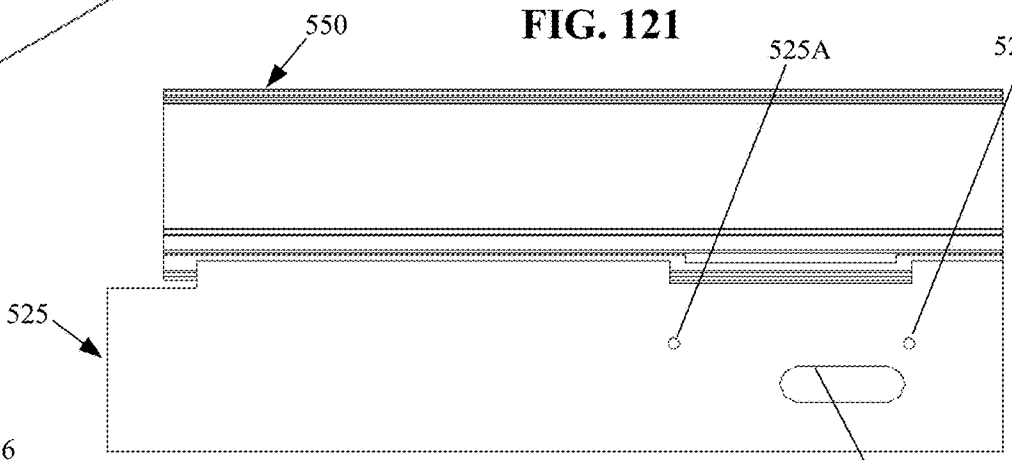
Figure 122:
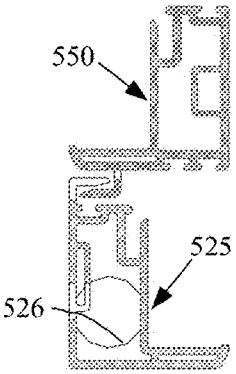
Figure 119:
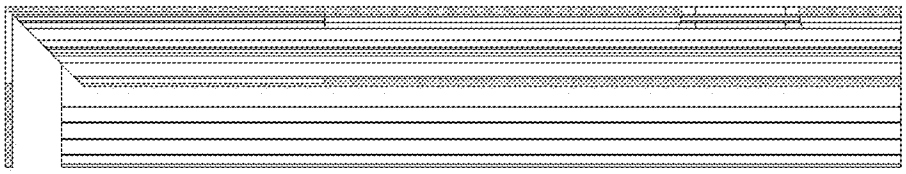
Figure 120:
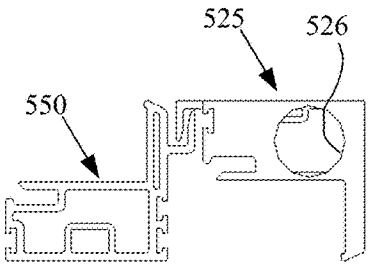
Figure 123:
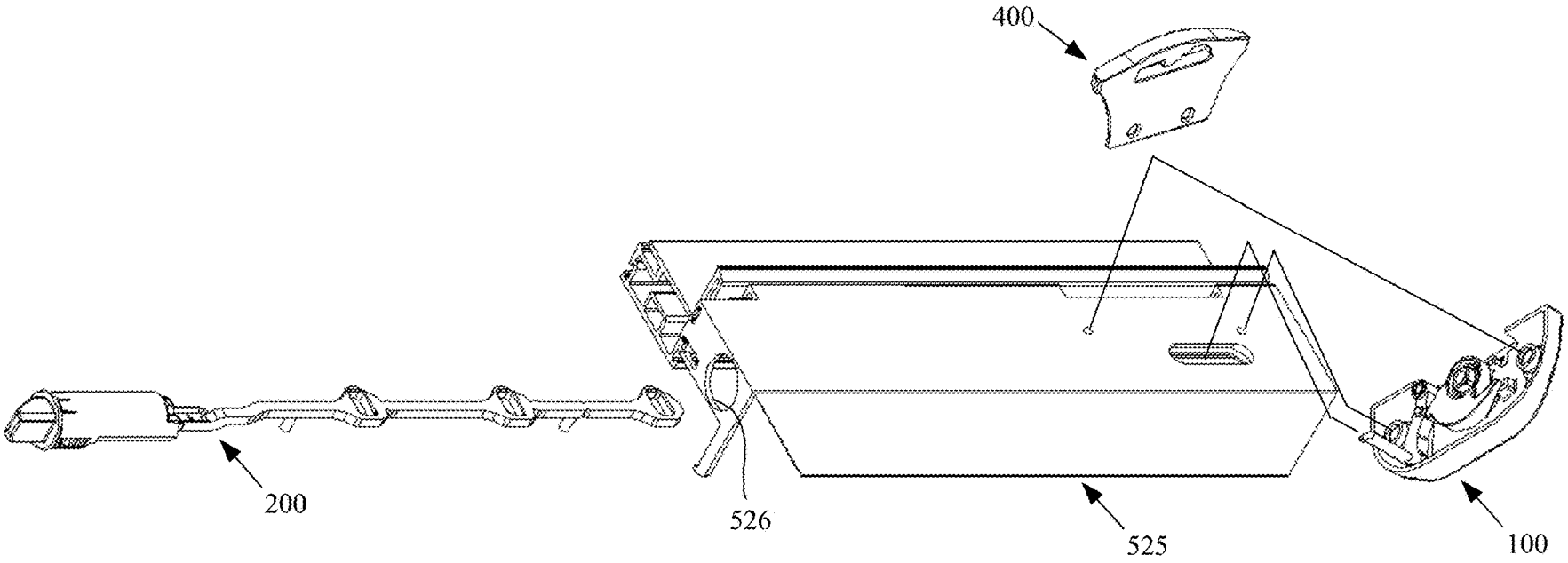
Figure 124:
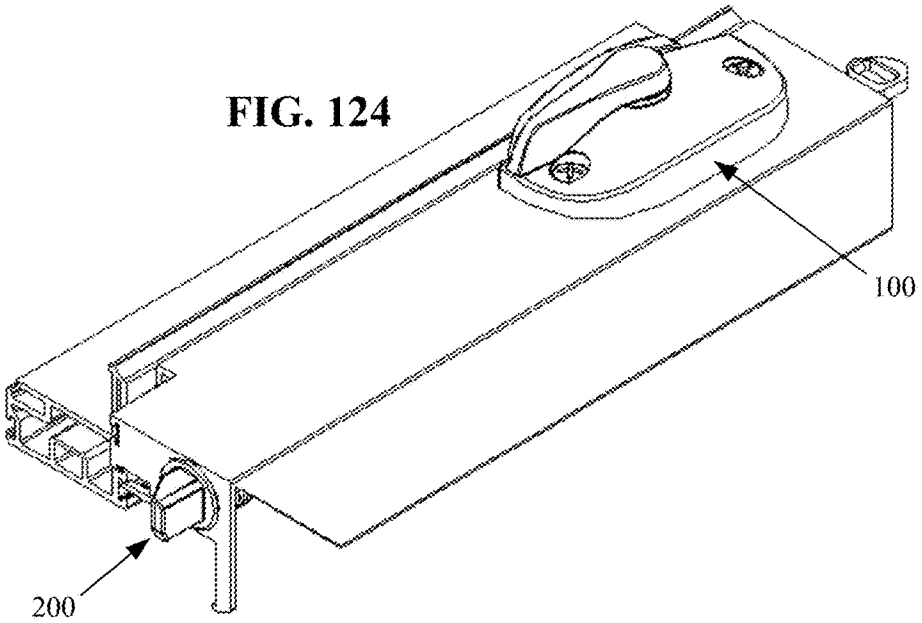
Figure 125:
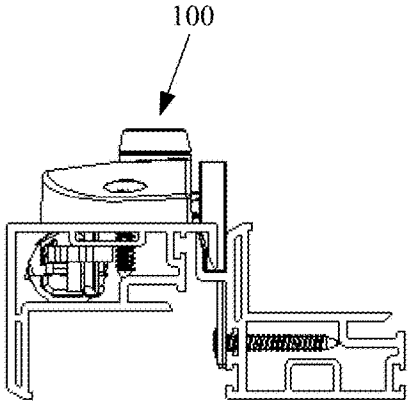
Figure 126:
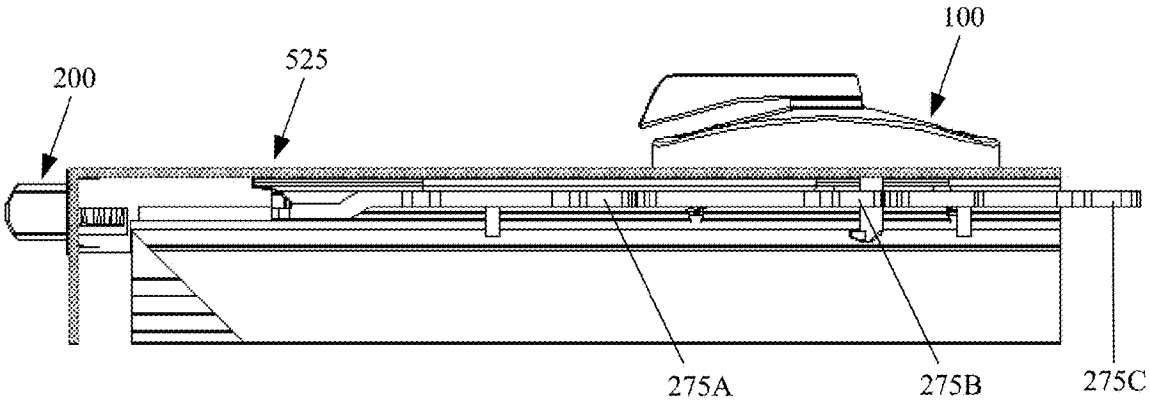
Figure 127:
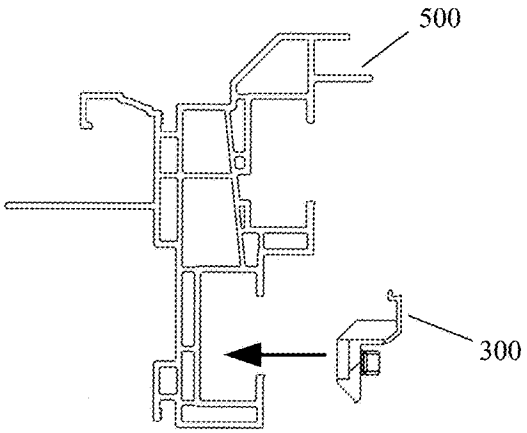
Figure 128:
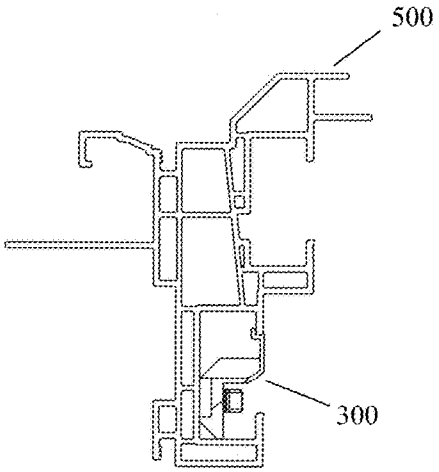
Figure 129:
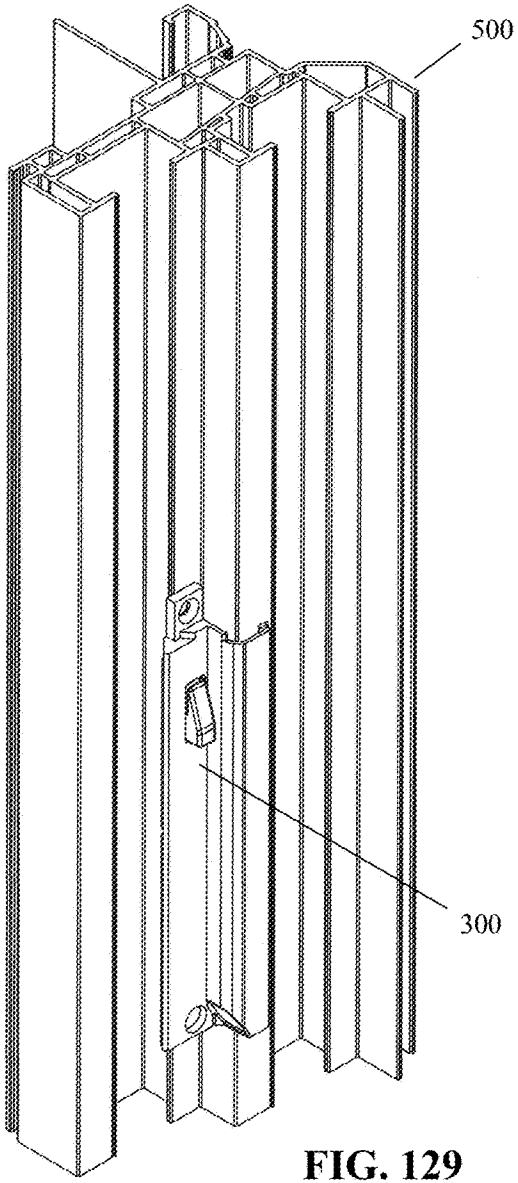
Figure 131:
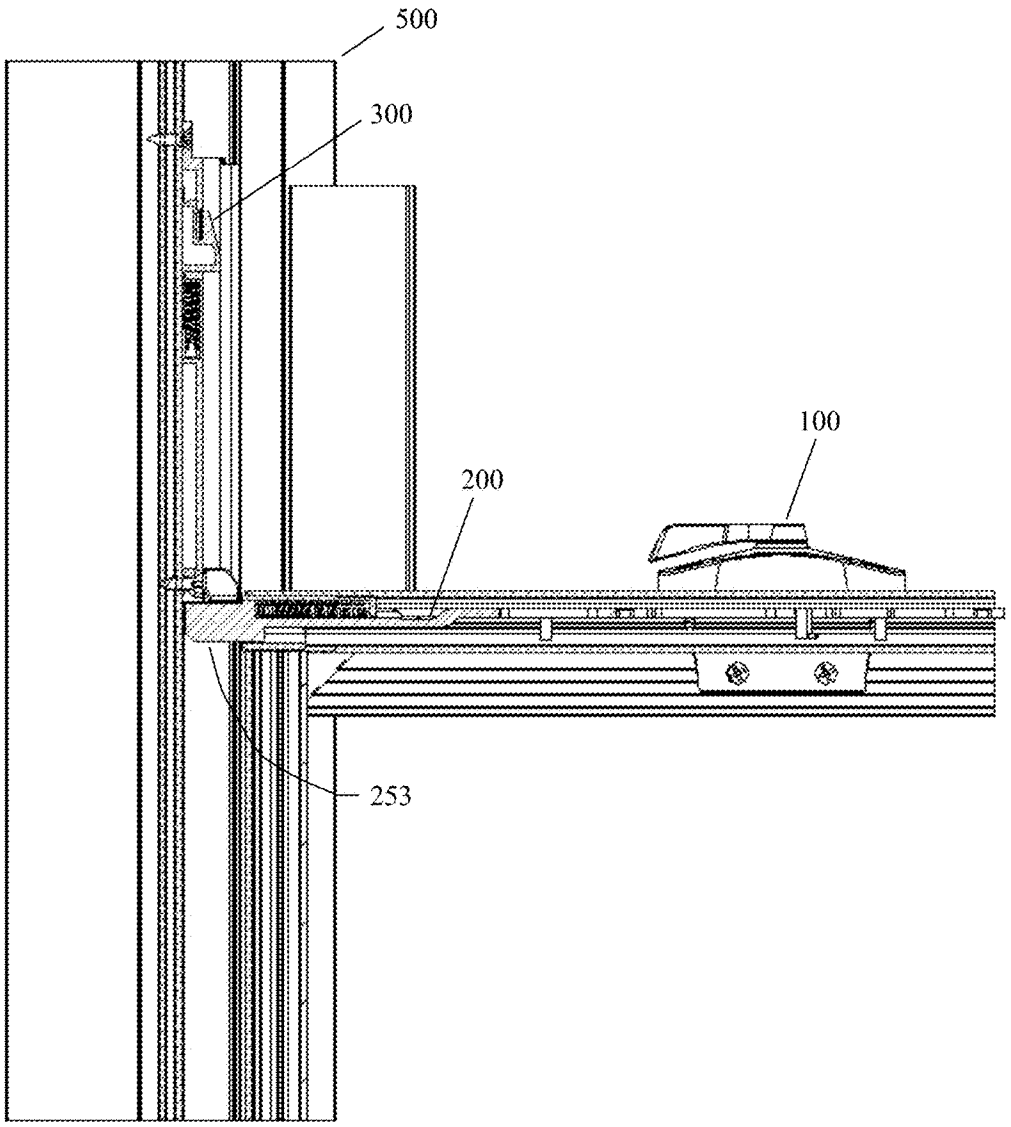
Figure 130:
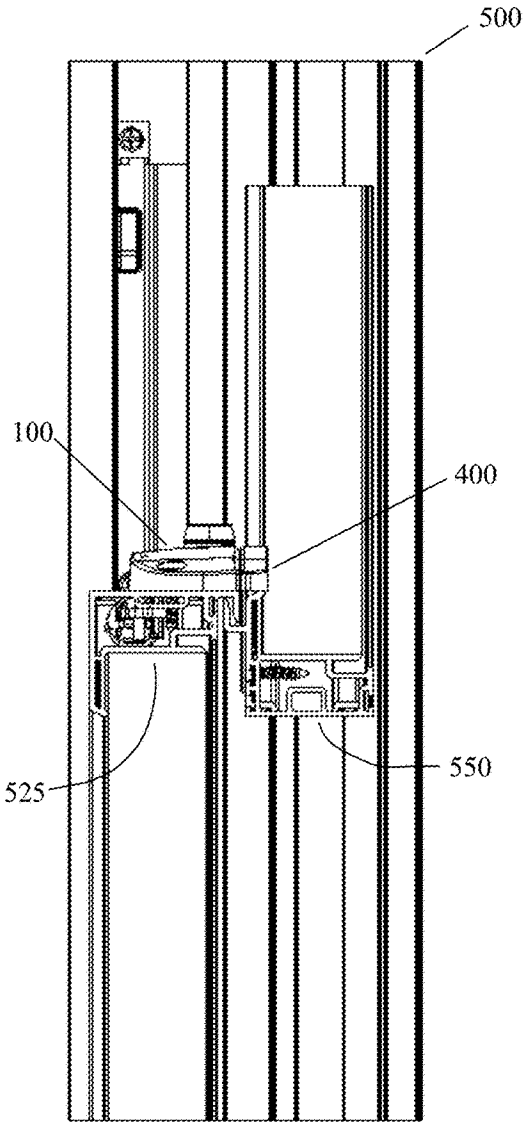
Figure 133:
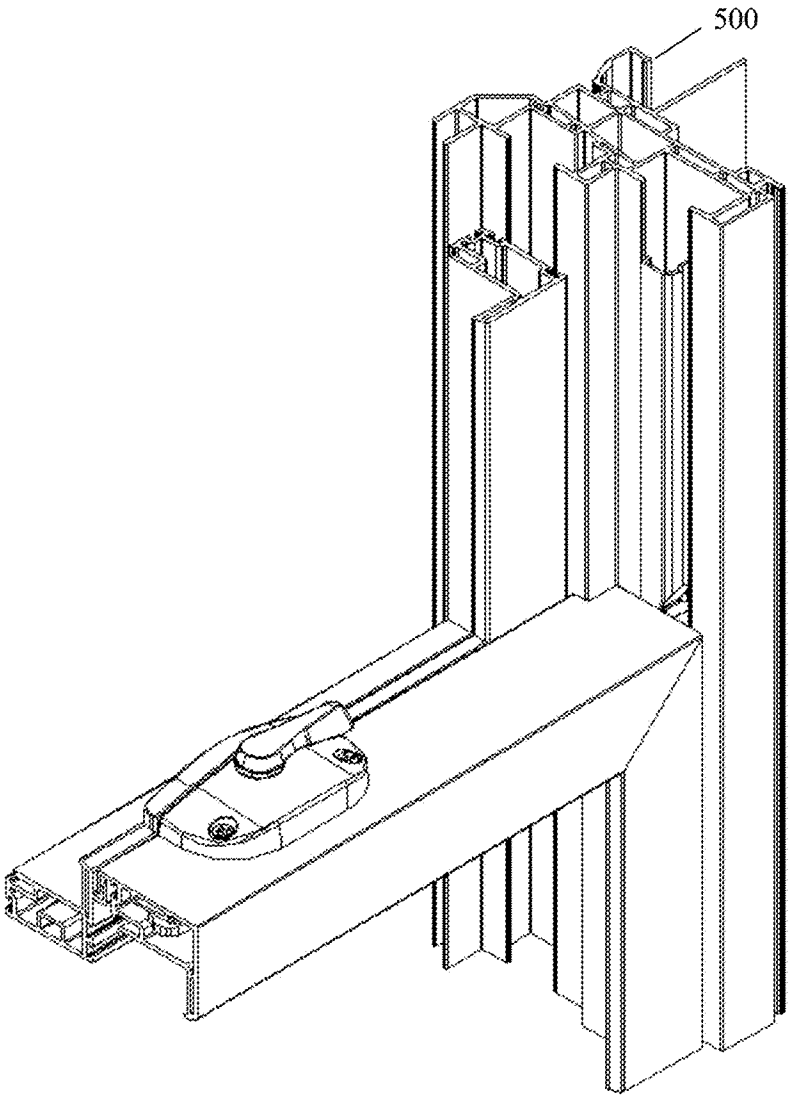
Figure 132:
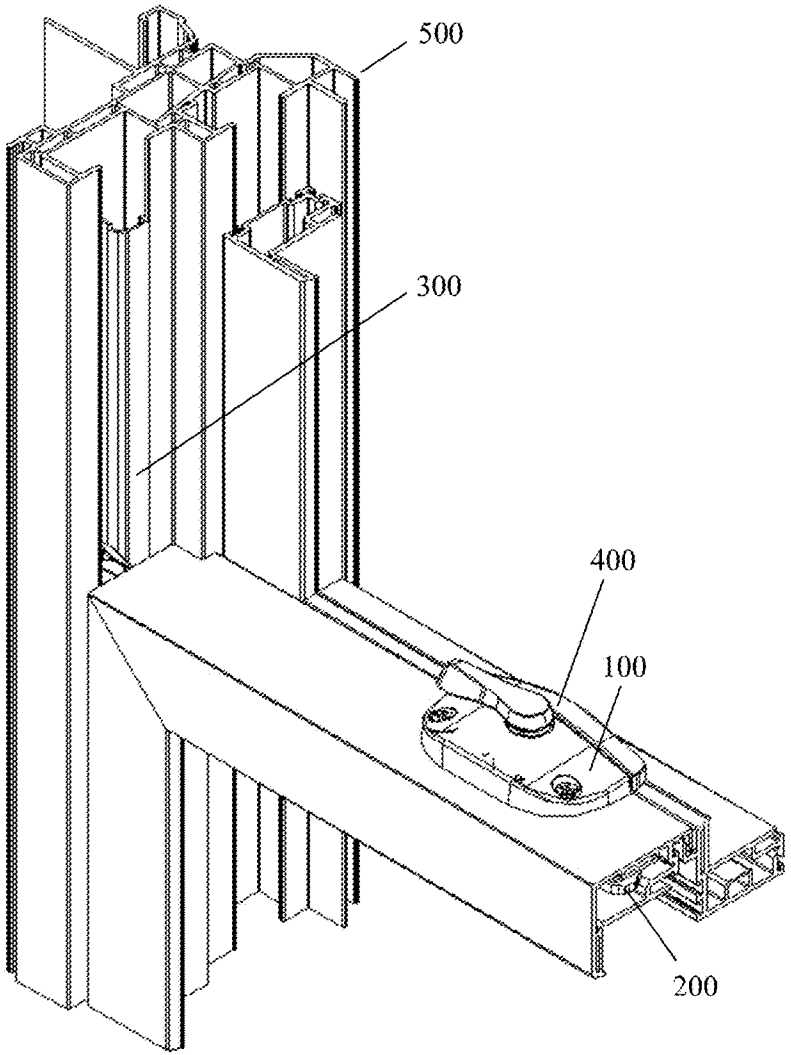
Figure 135:
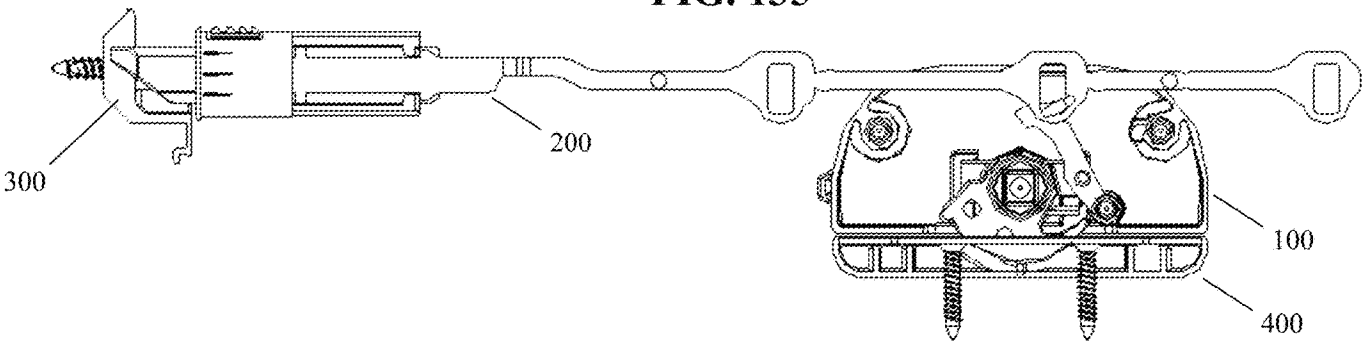
Figure 134:
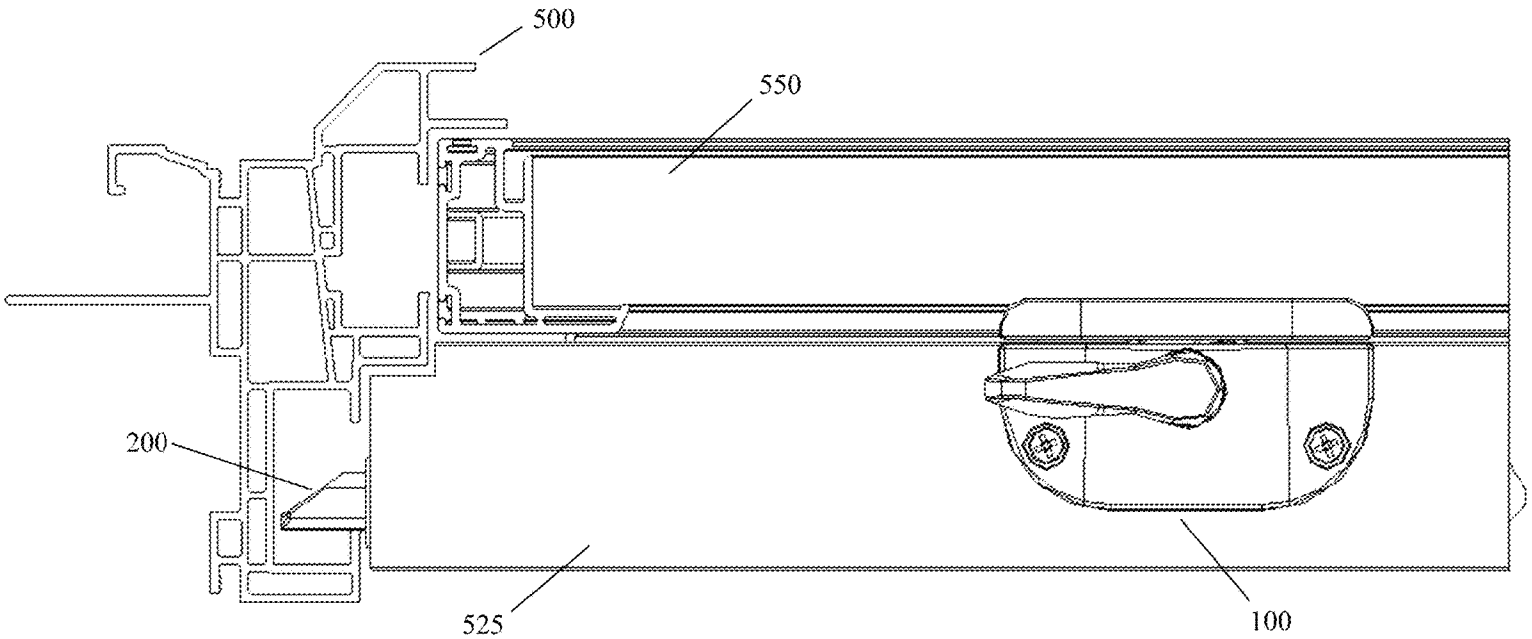
Figure 136:
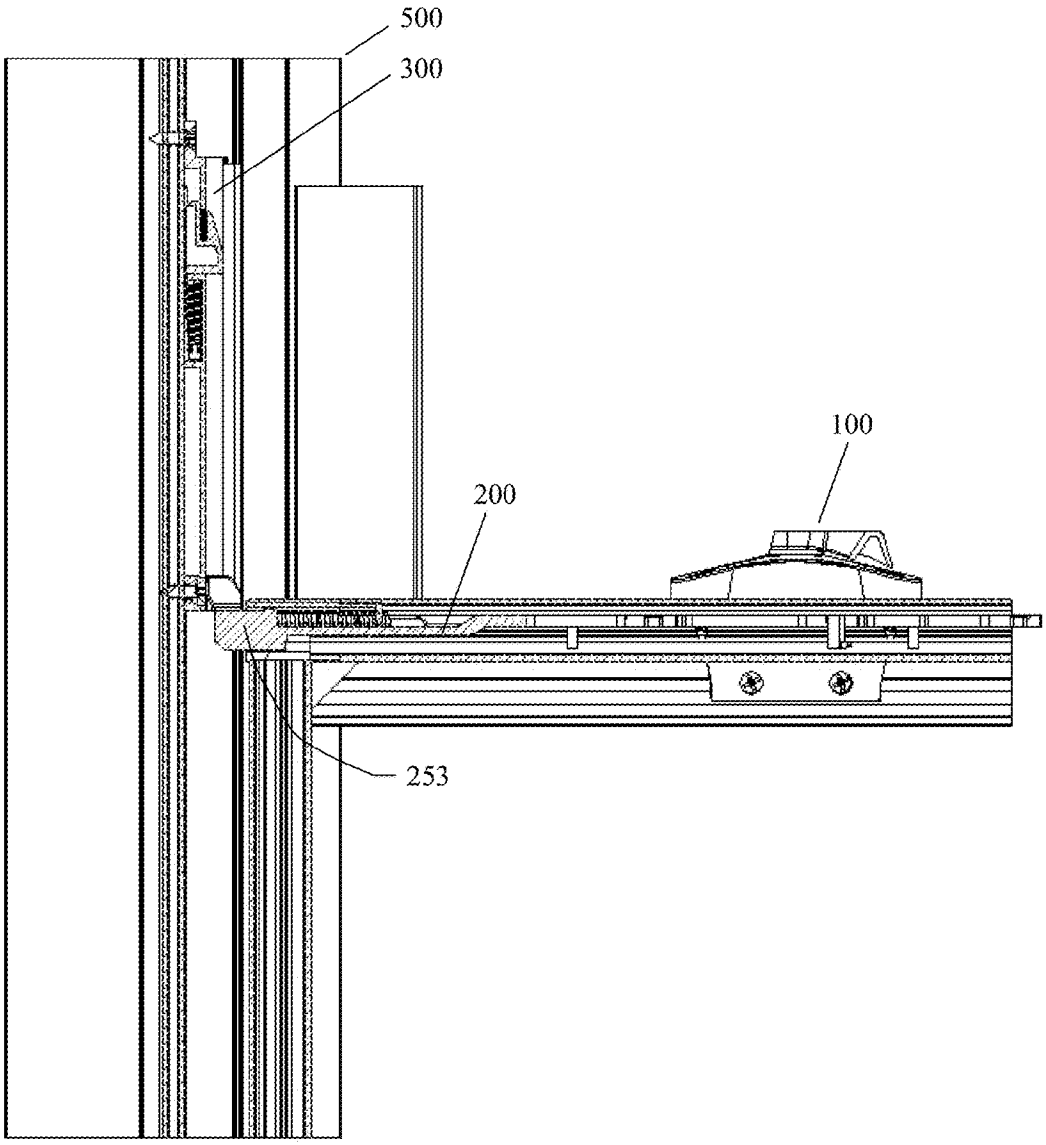
Figure 138:
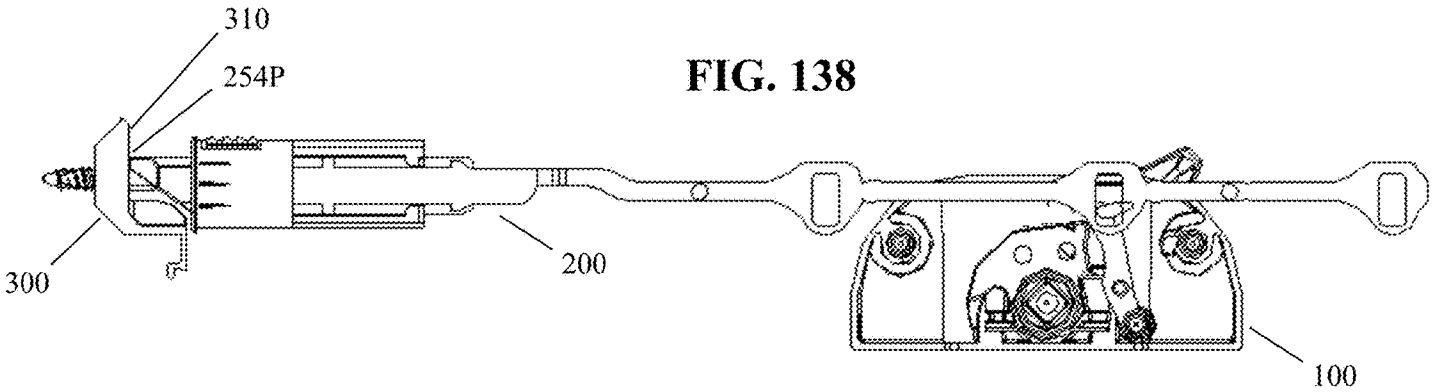
Figure 137:
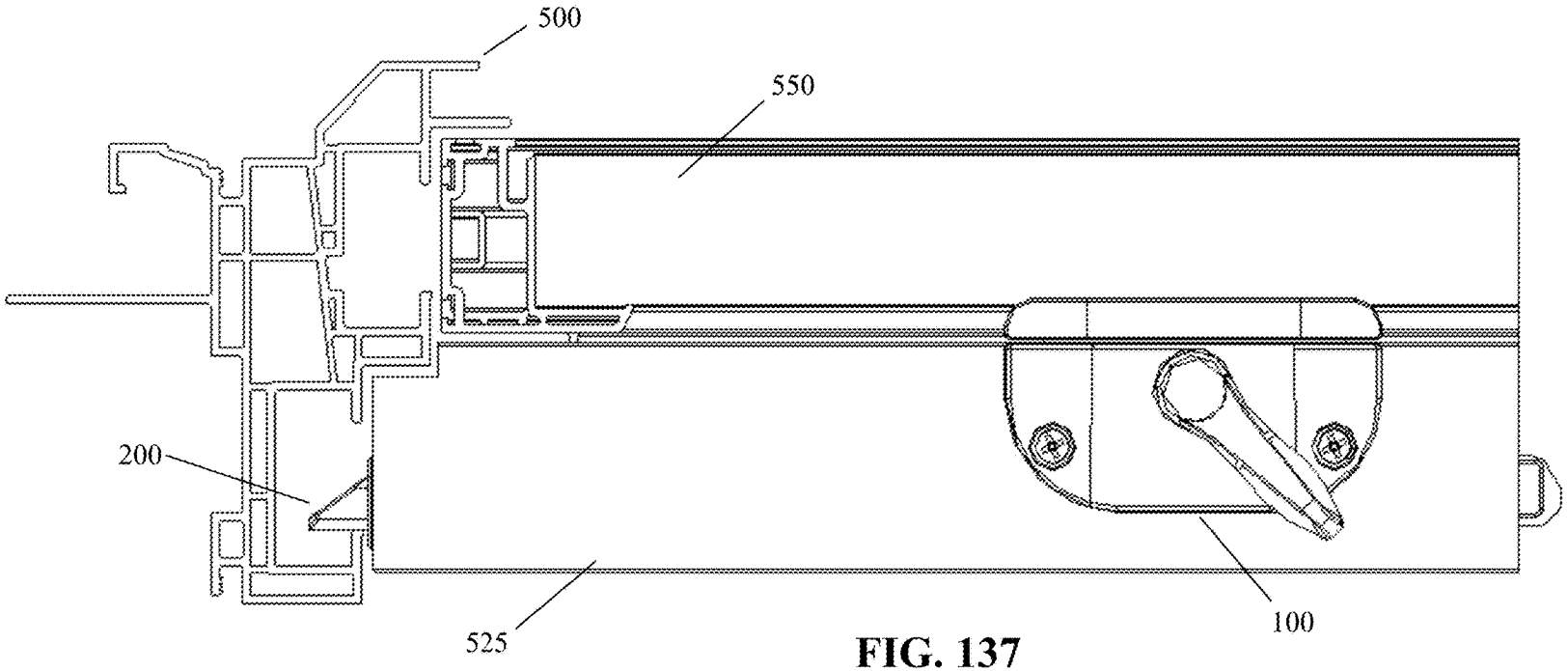
Figure 140A:
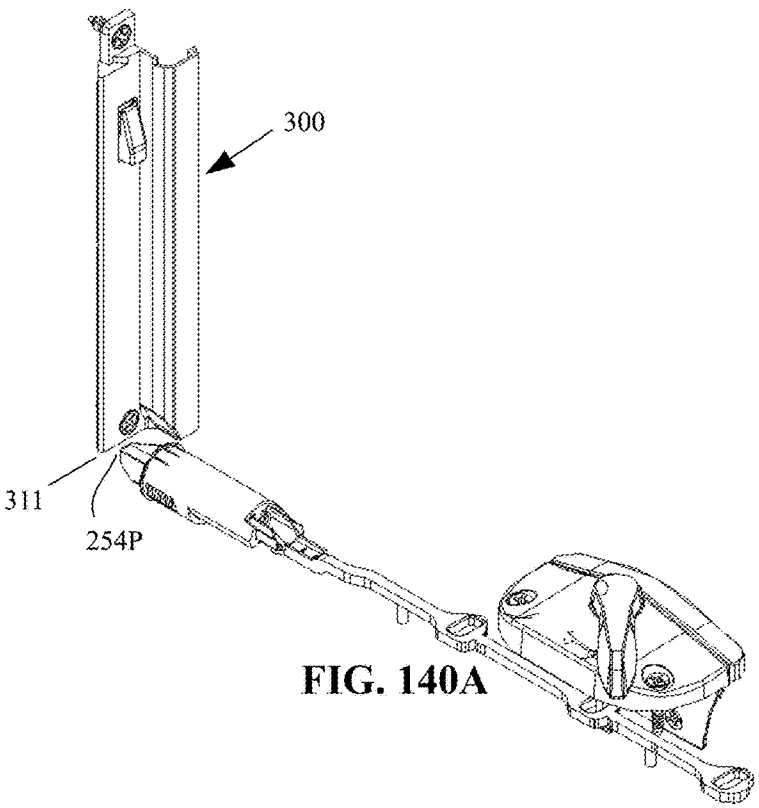
Figure 140B:
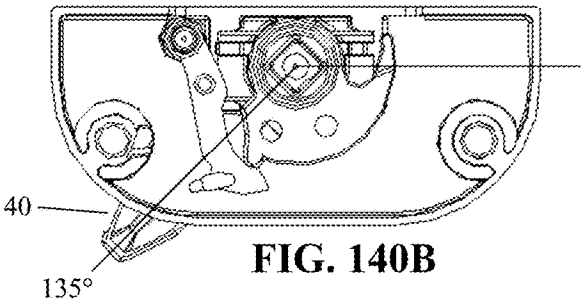
Figure 139A:
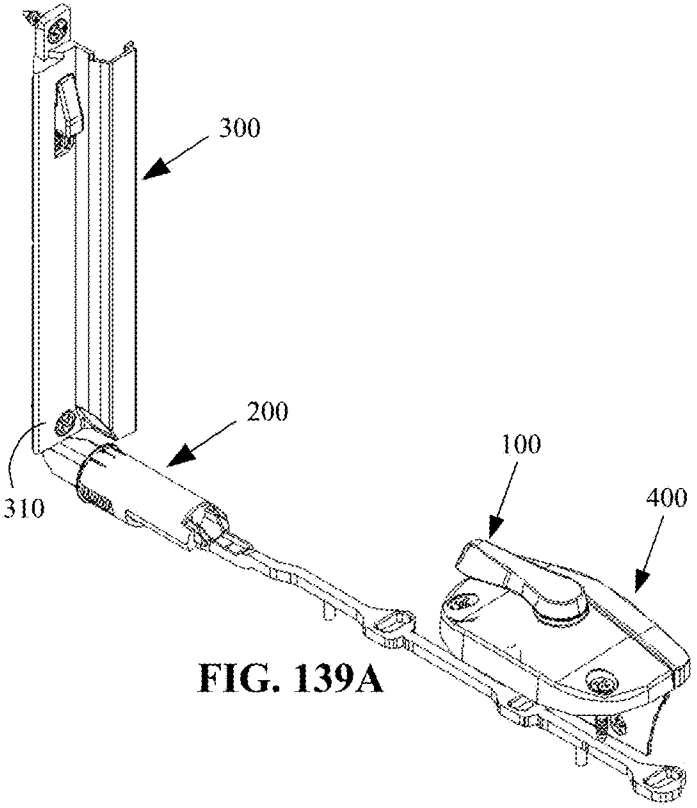
Figure 139B:
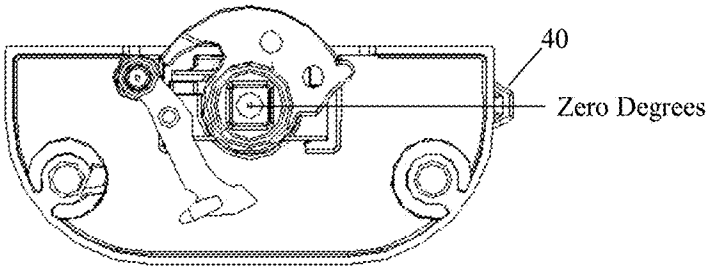
Figure 141:
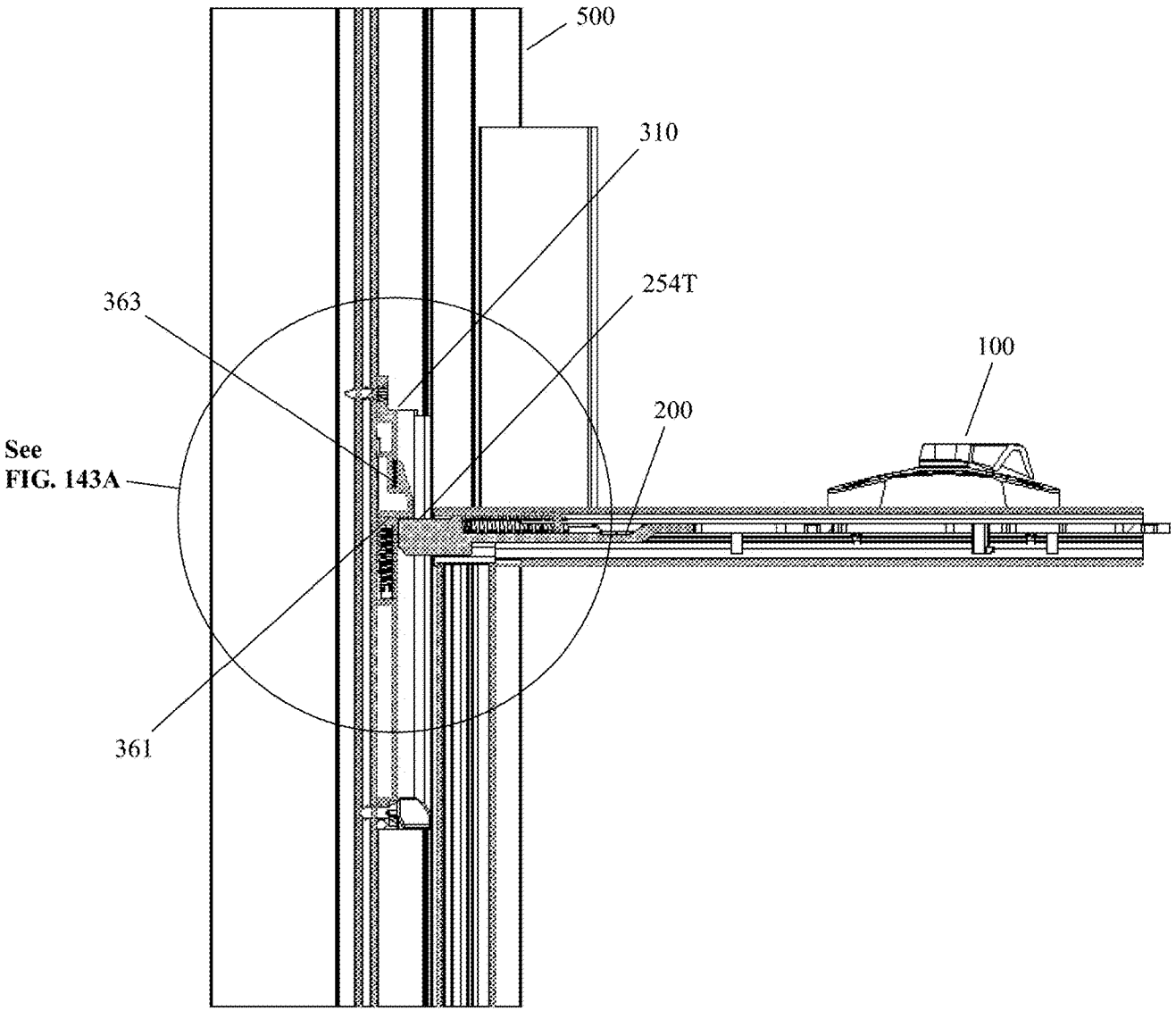
Figure 142:
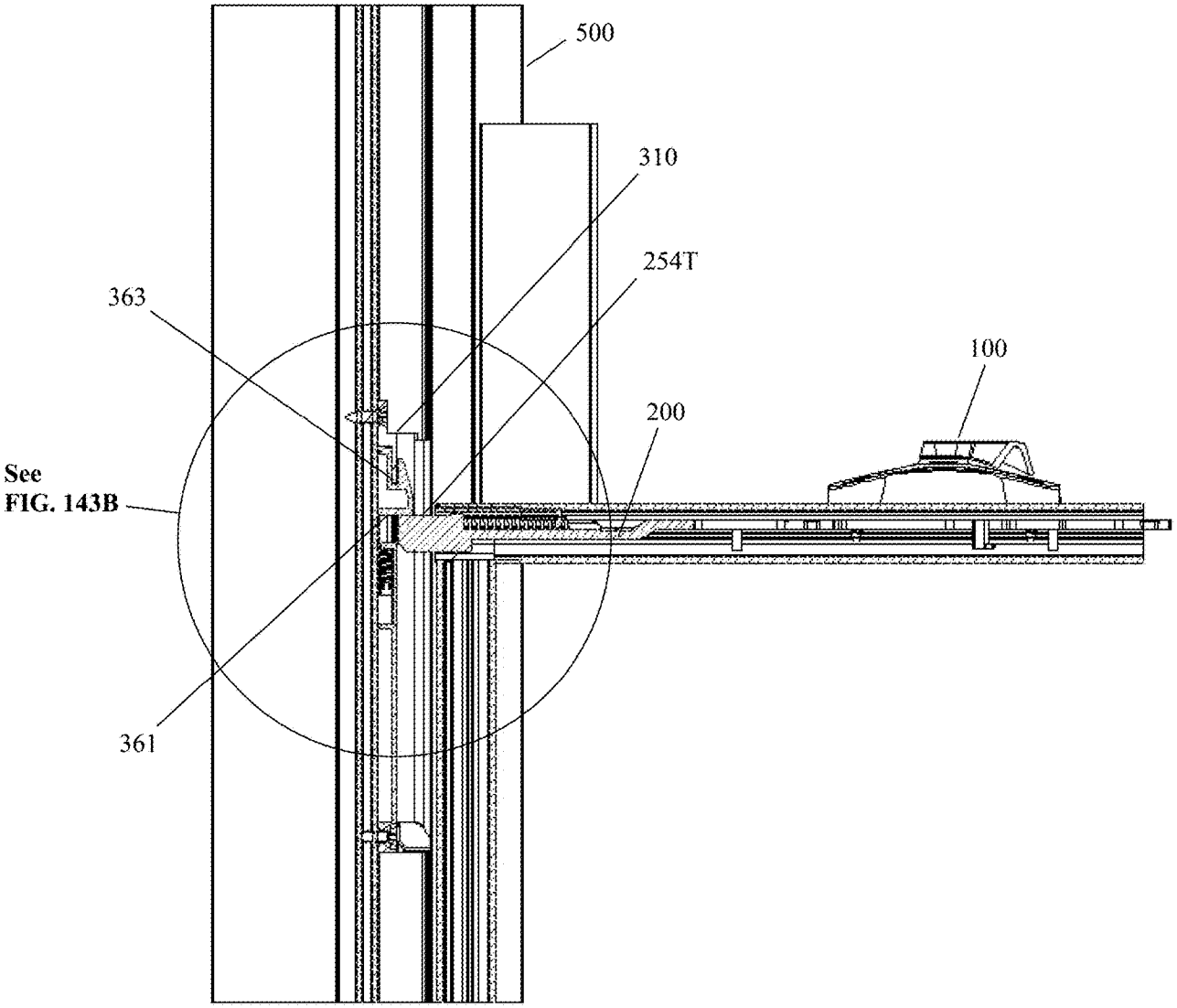
Figure 143B:
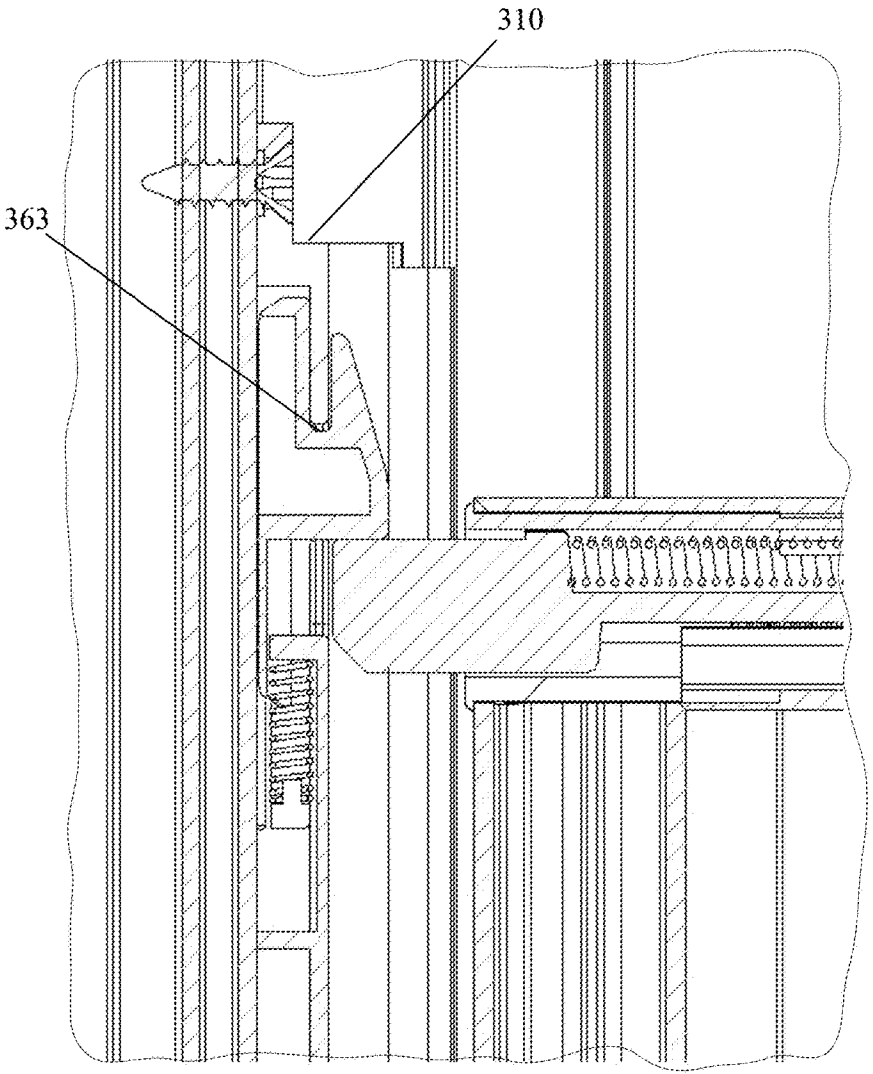
Figure 143A:
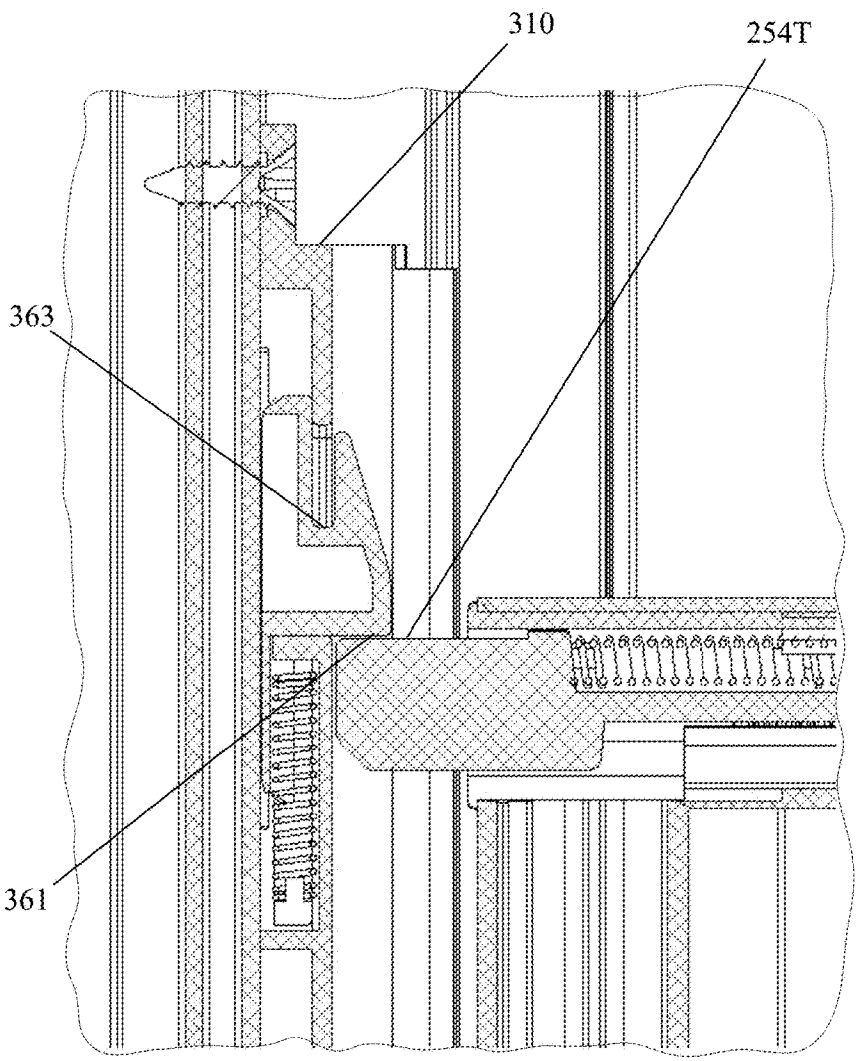
Figure 144B:
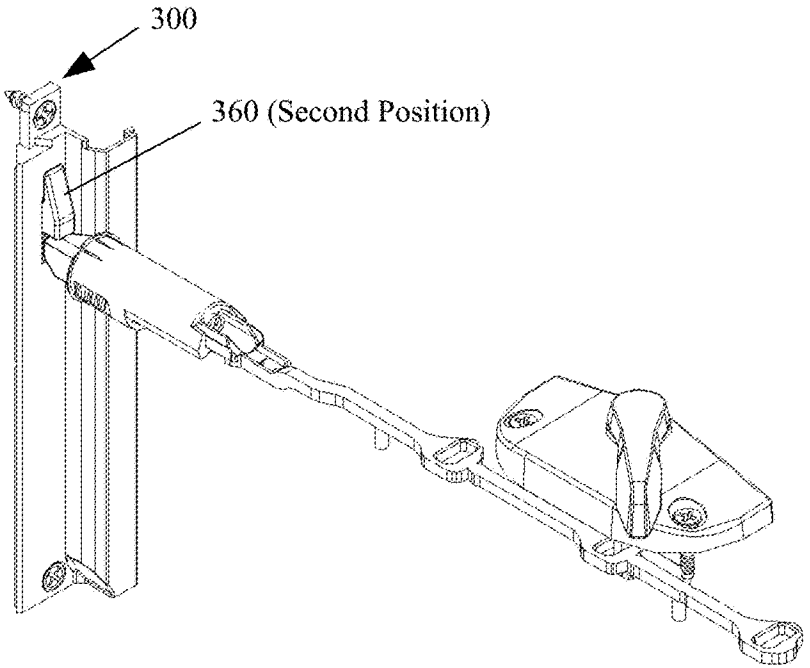
Figure 144A:
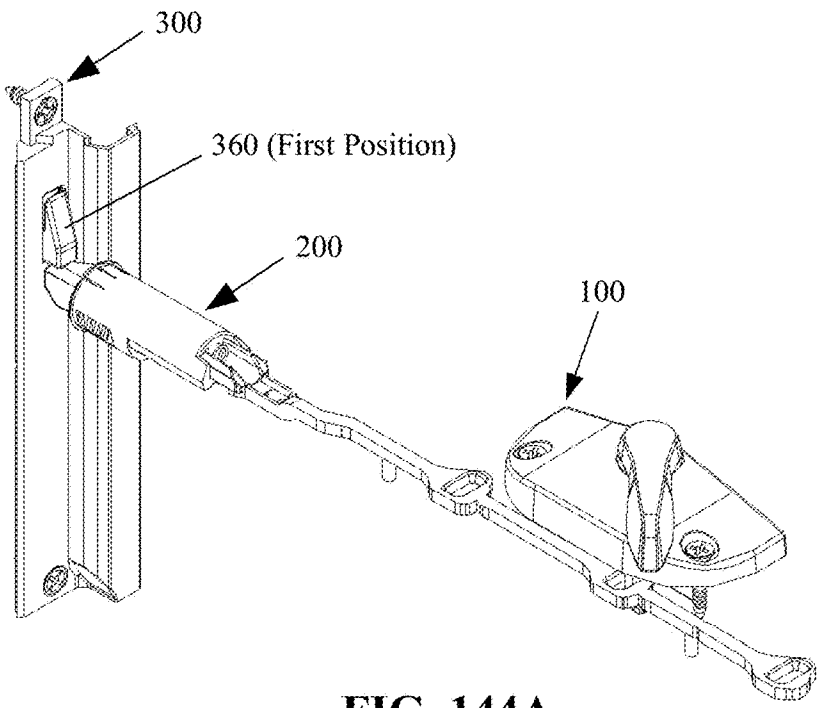
Figure 145:
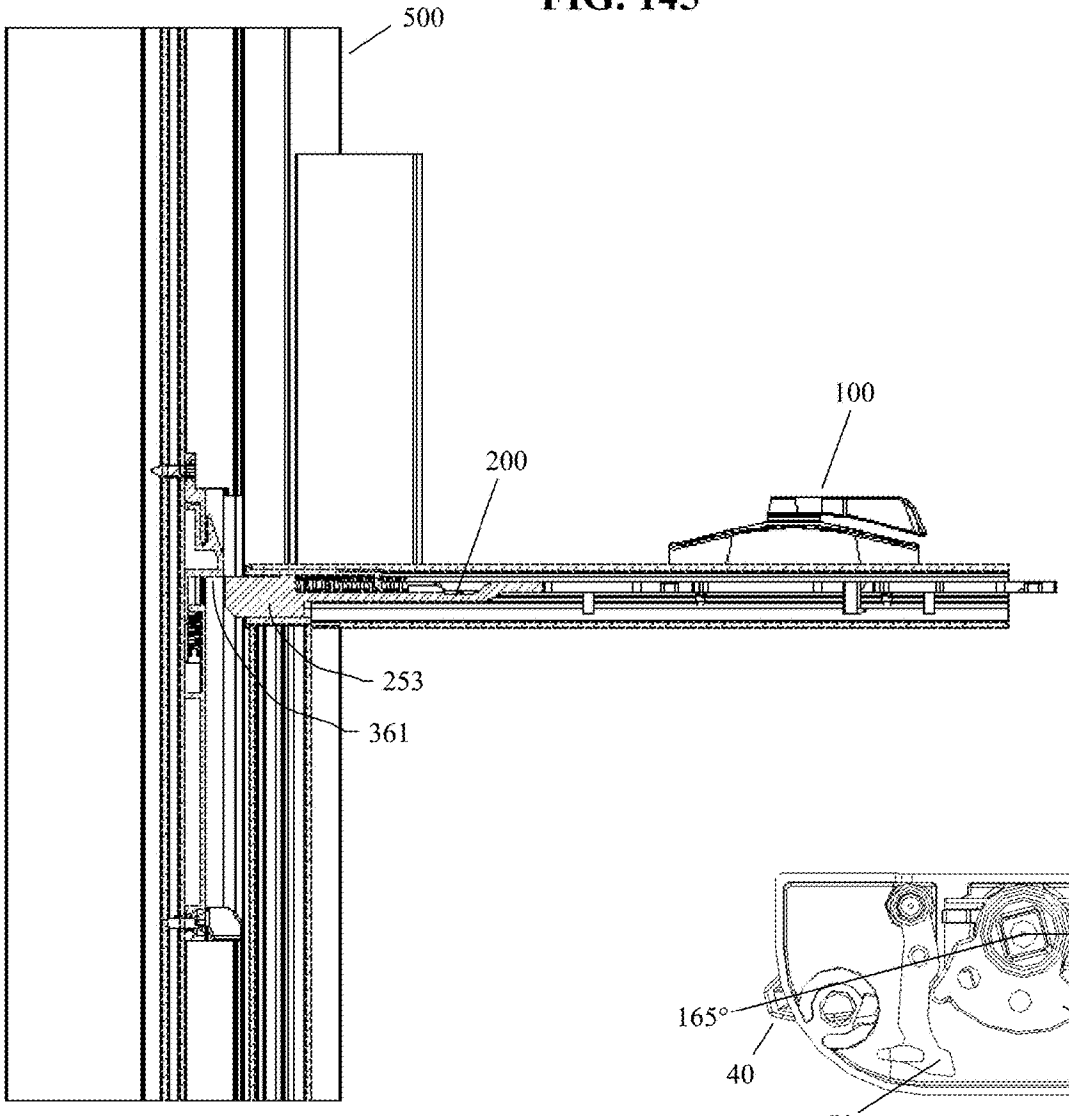
Figure 145A:
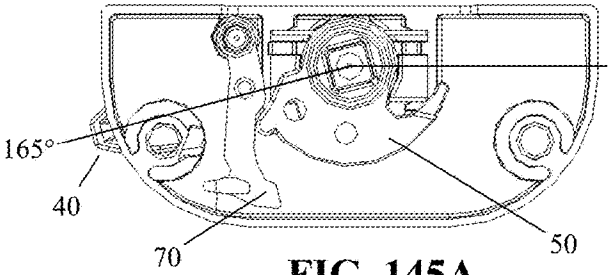
Figure 147:
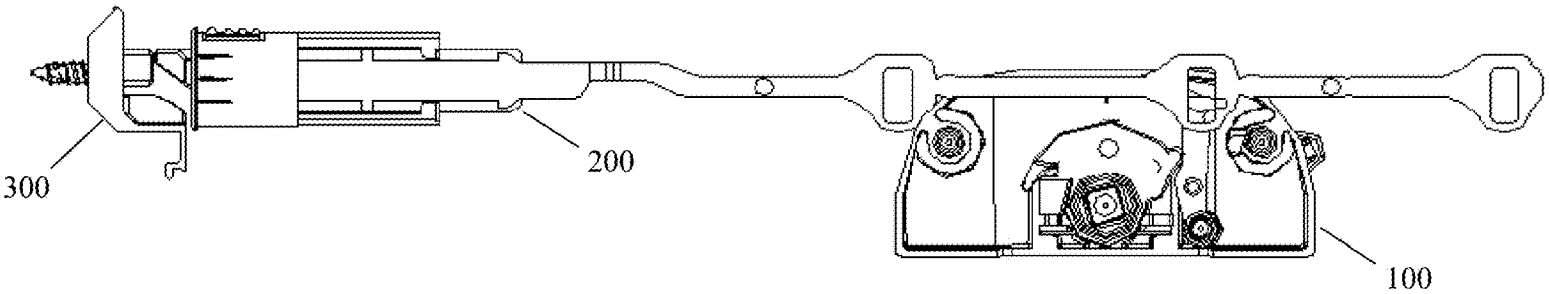
Figure 146:
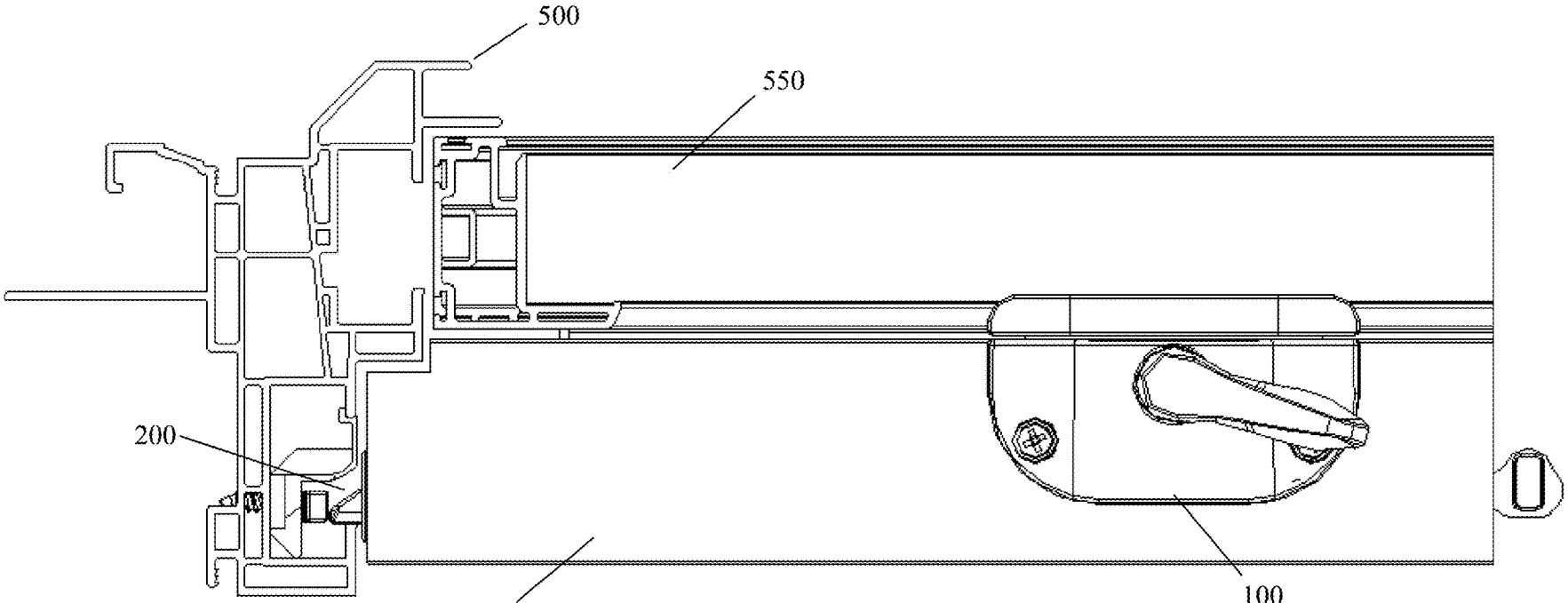
Figure 148:
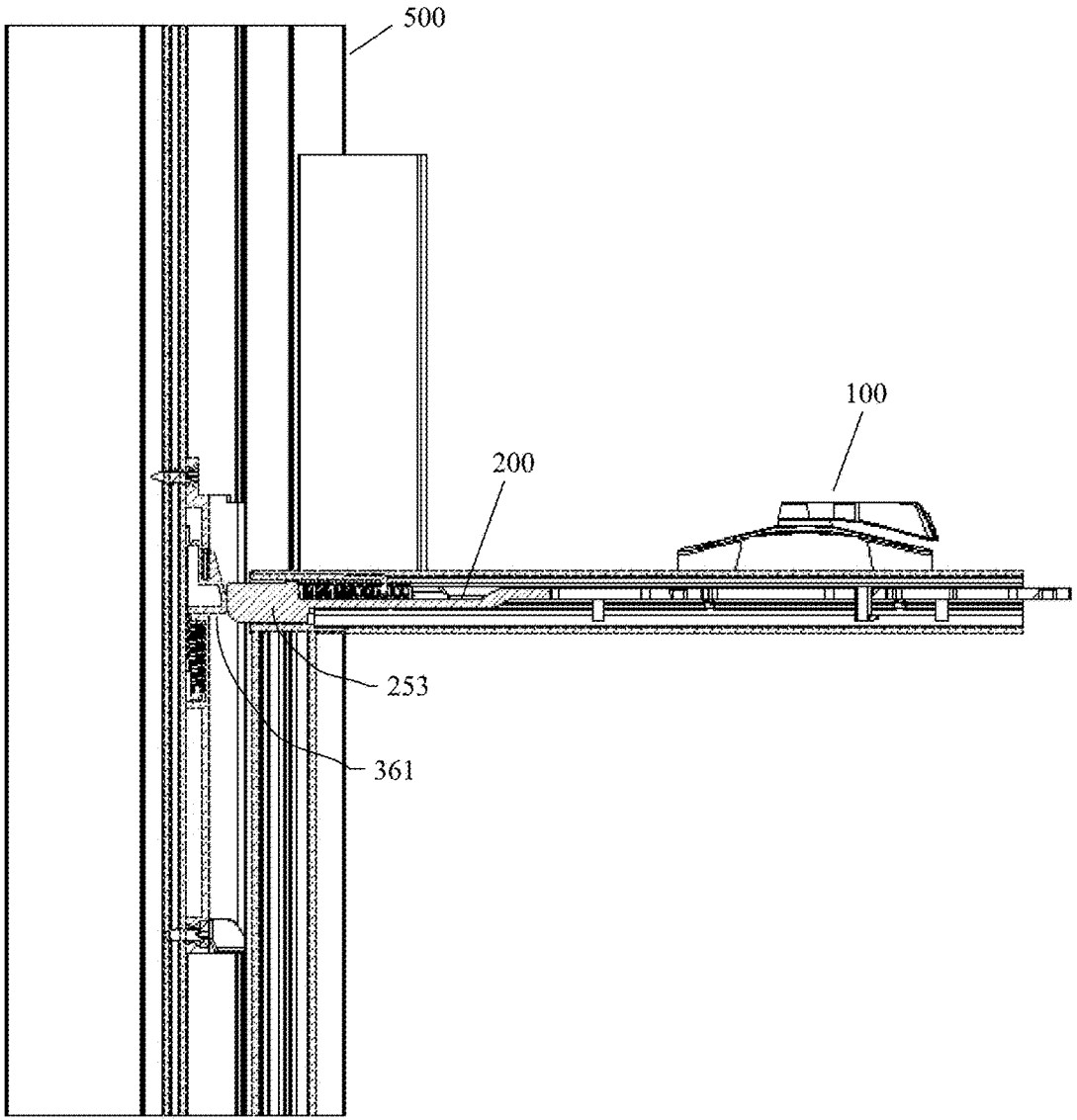
Figure 149B:
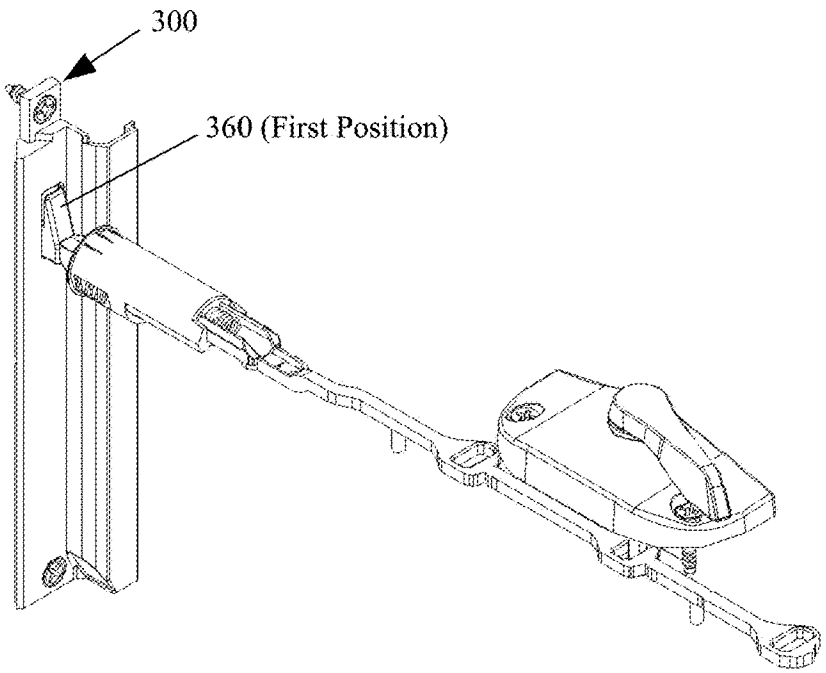
Figure 149A:
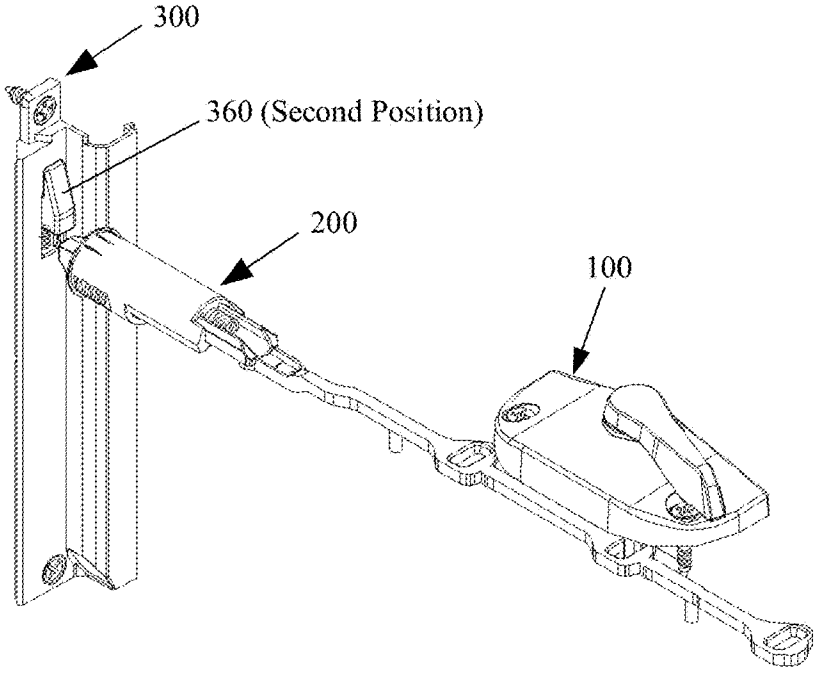
Figure 151:
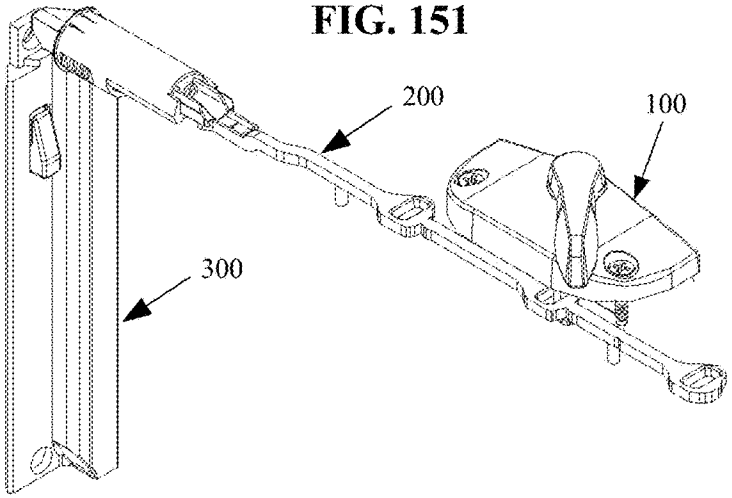
Figure 152:
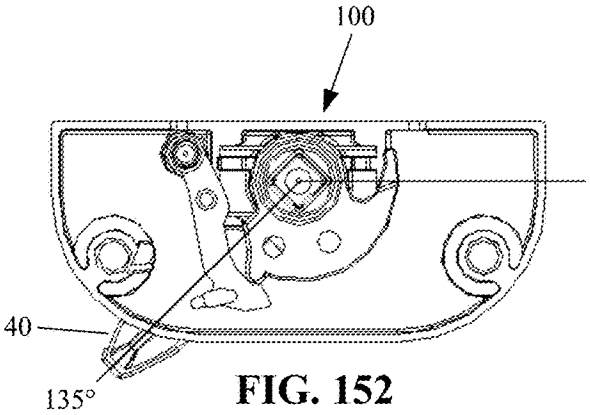
Figure 150:
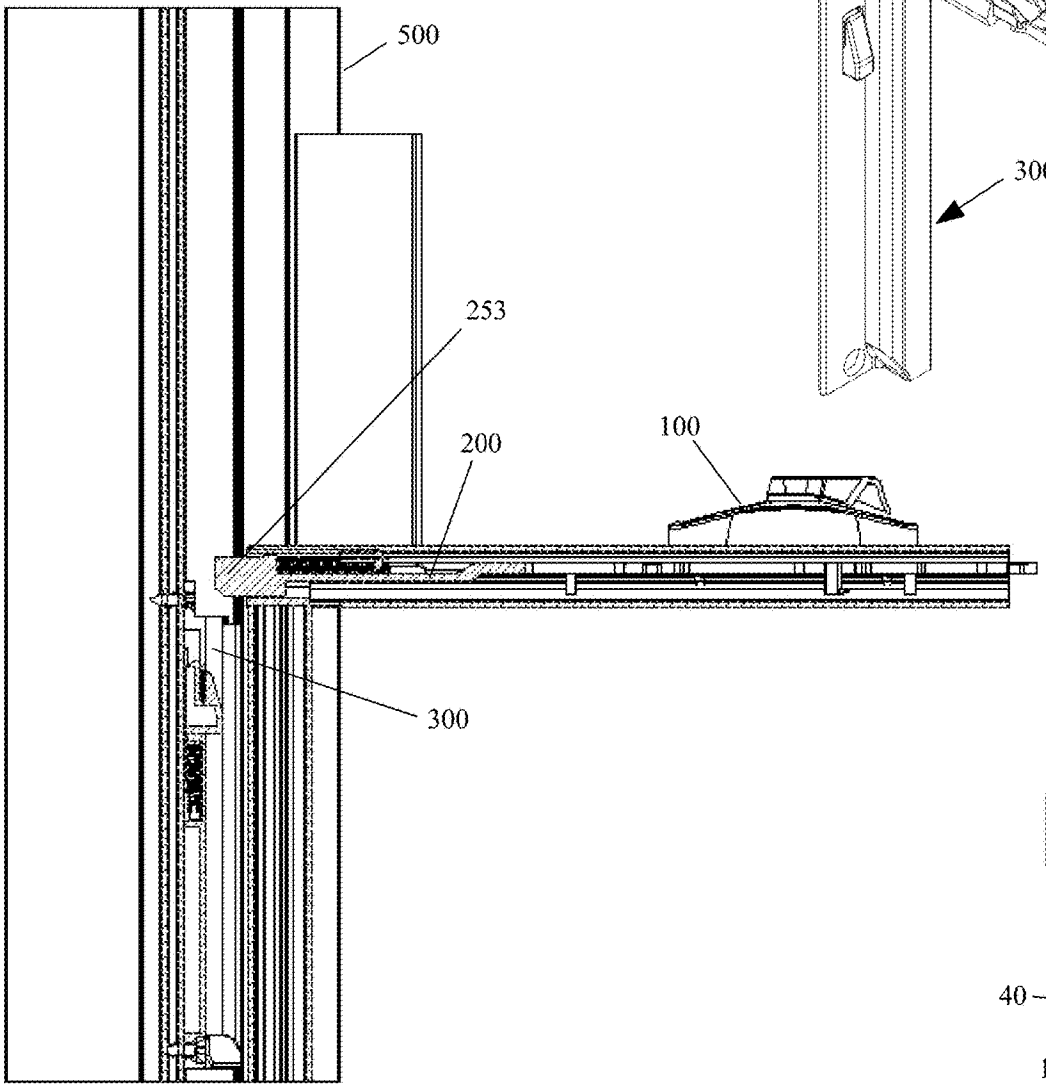
Figure 154:
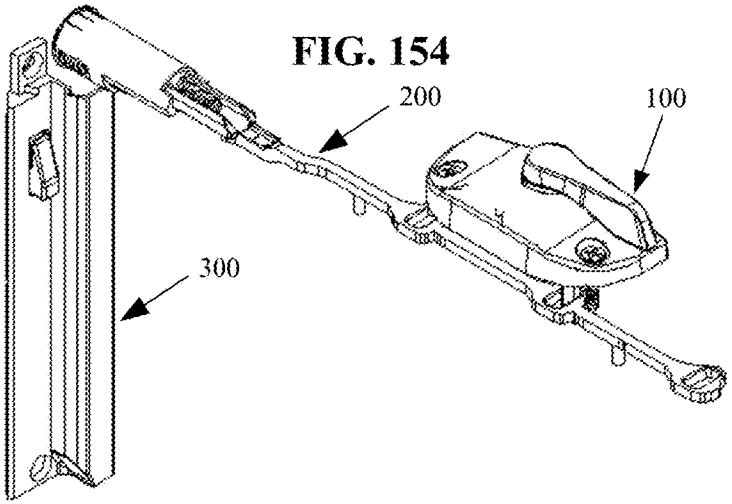
Figure 155:
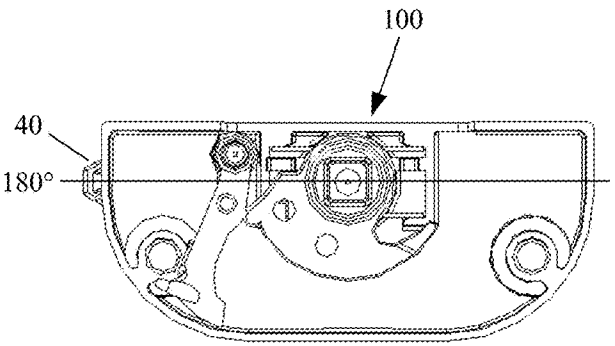
Figure 153:
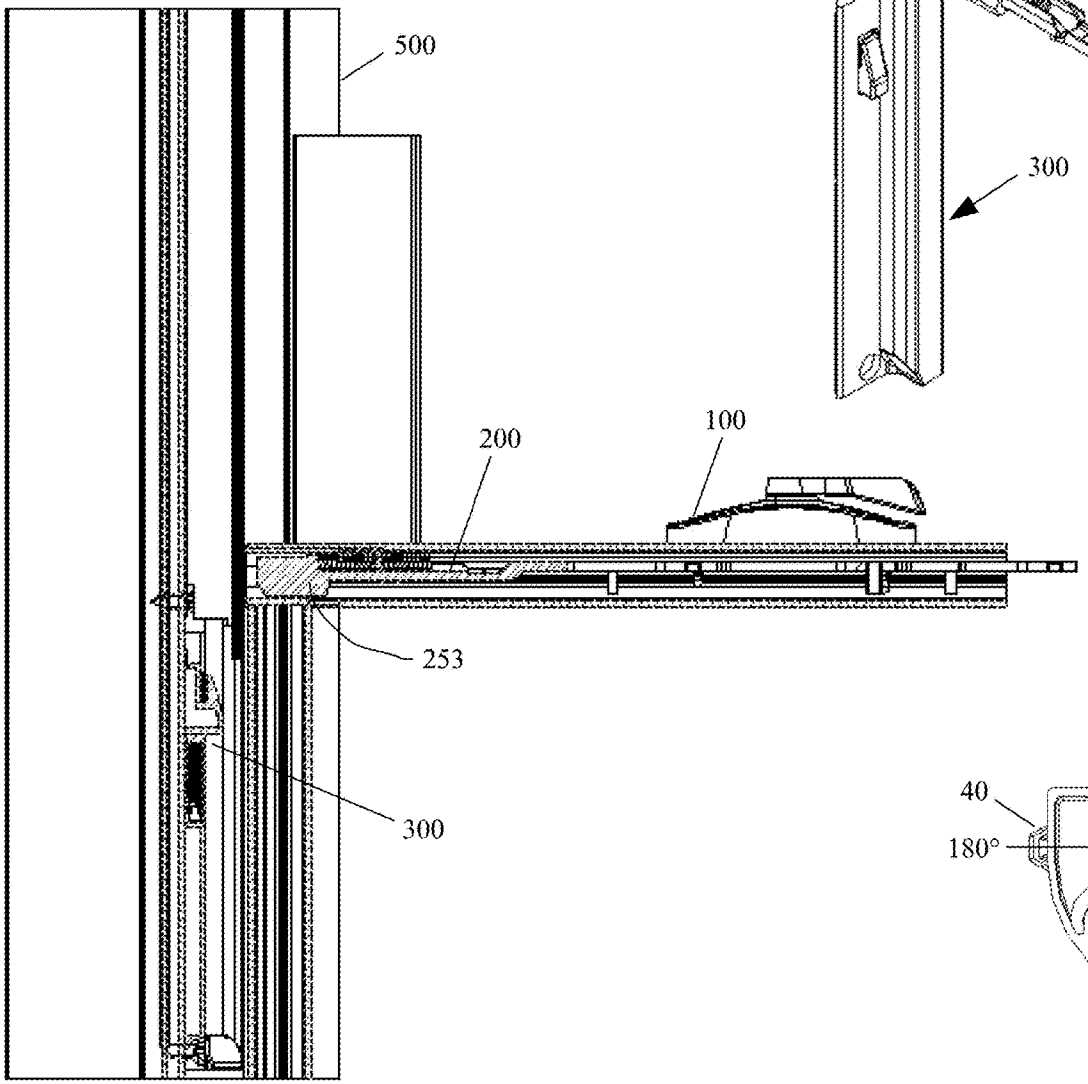
Figure 157:
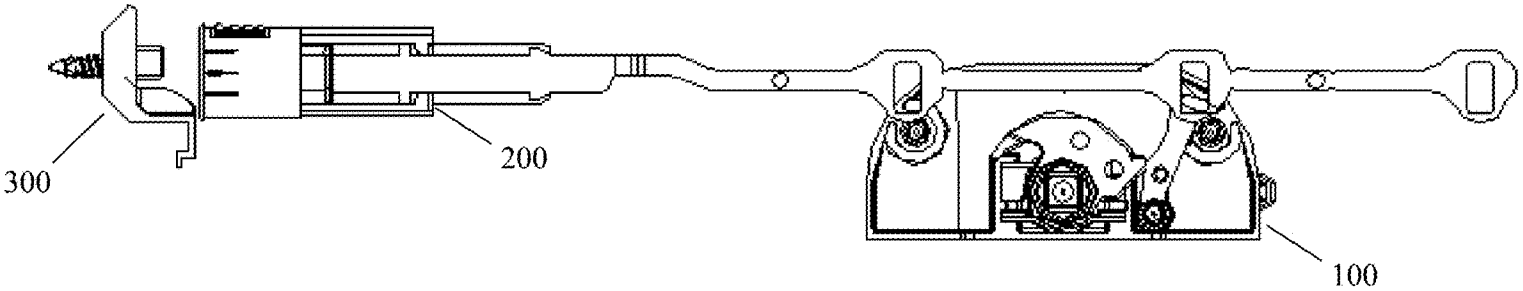
Figure 156:
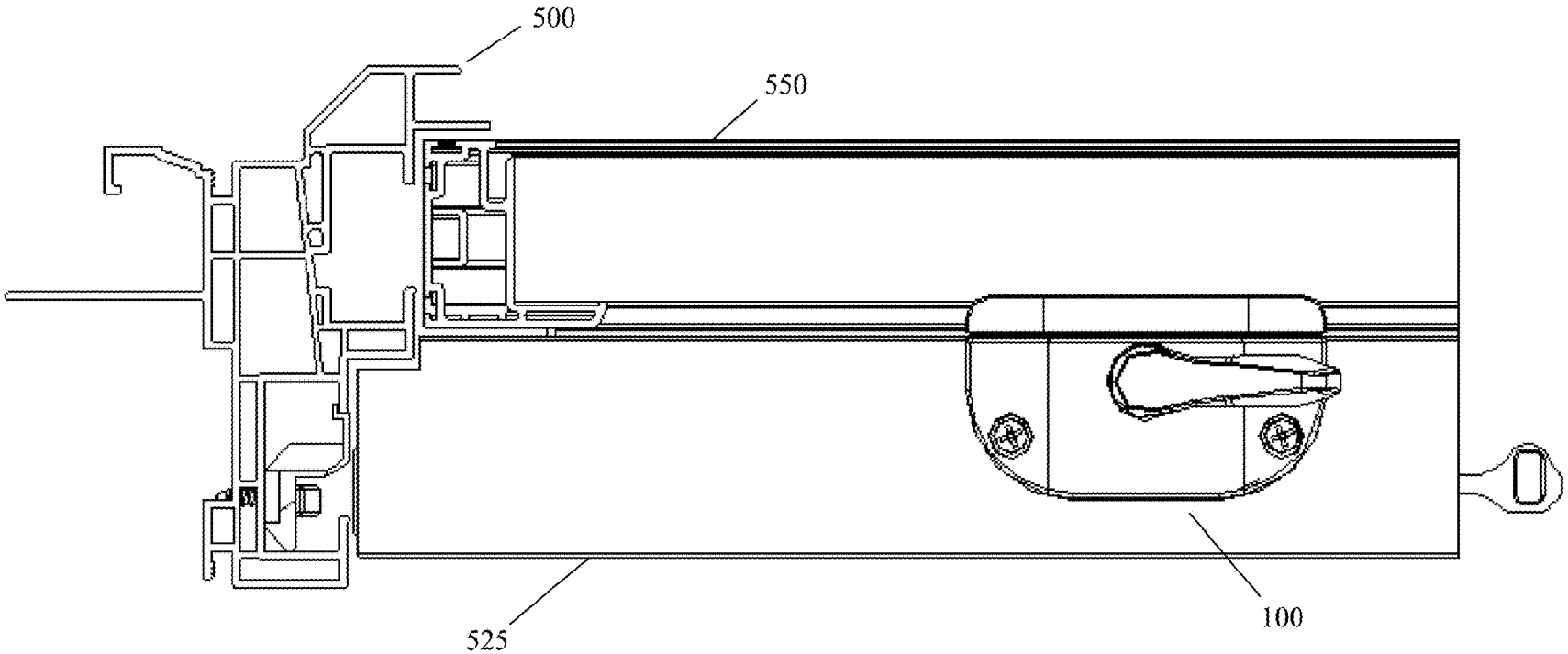
Figure 159:
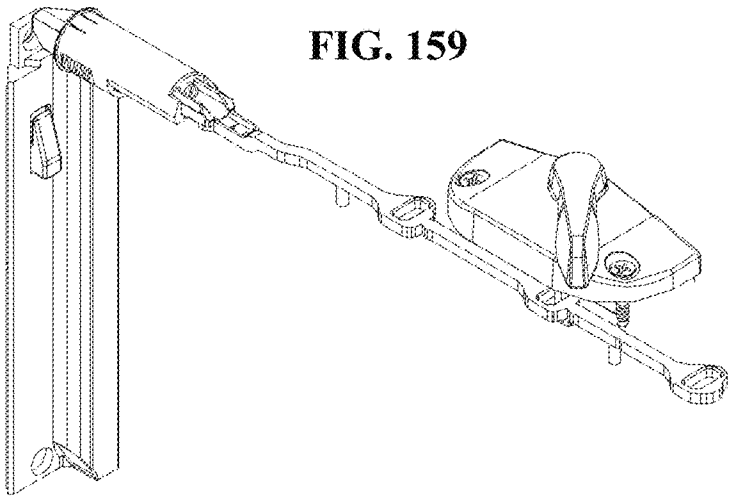
Figure 160:
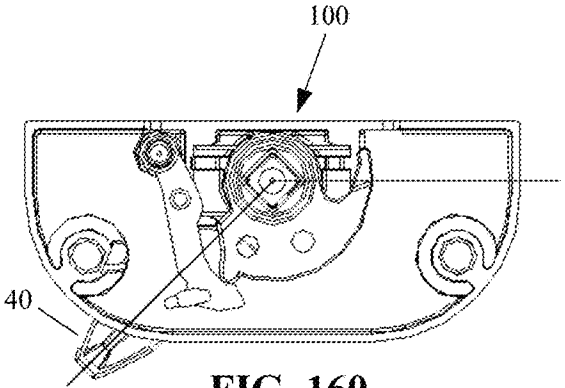
Figure 158:
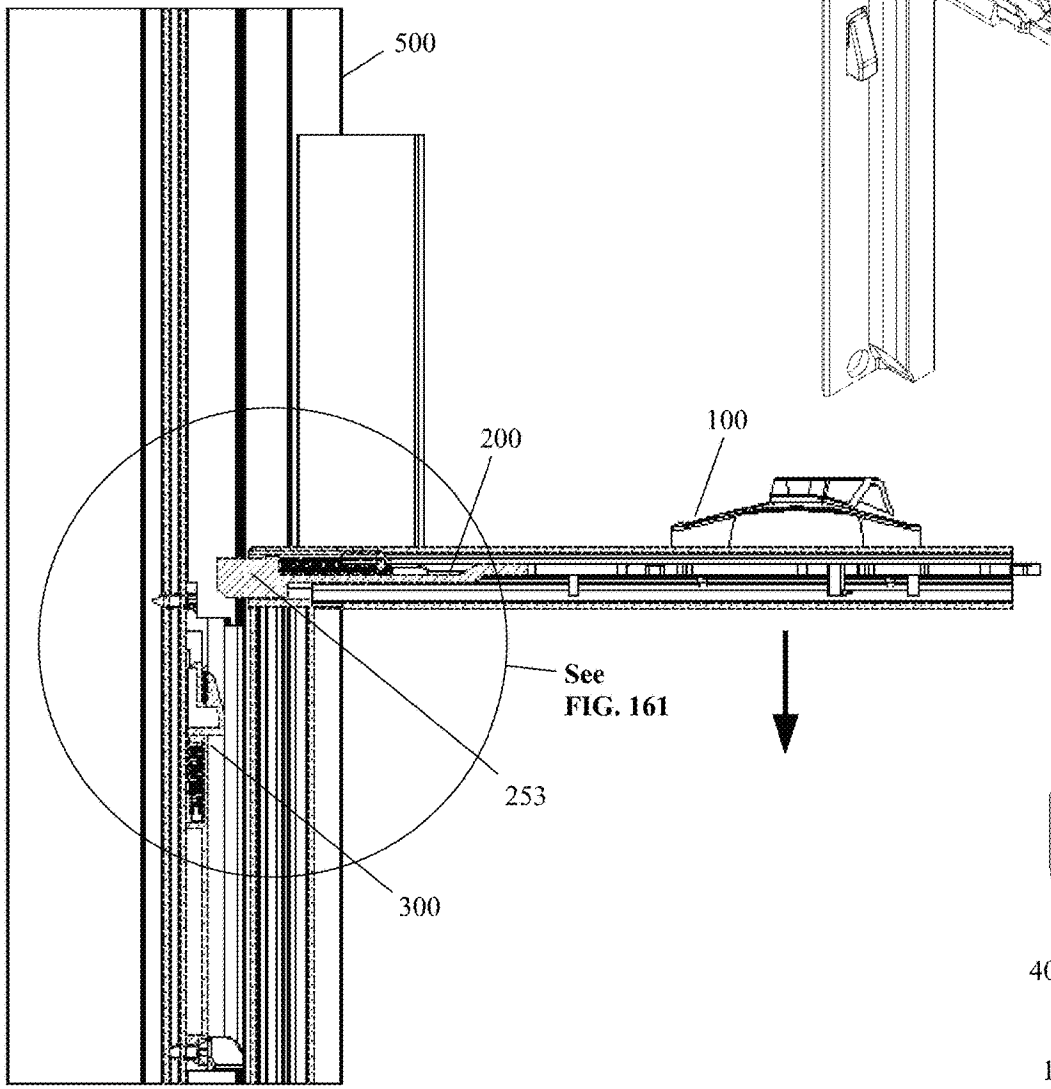
Figure 161B:
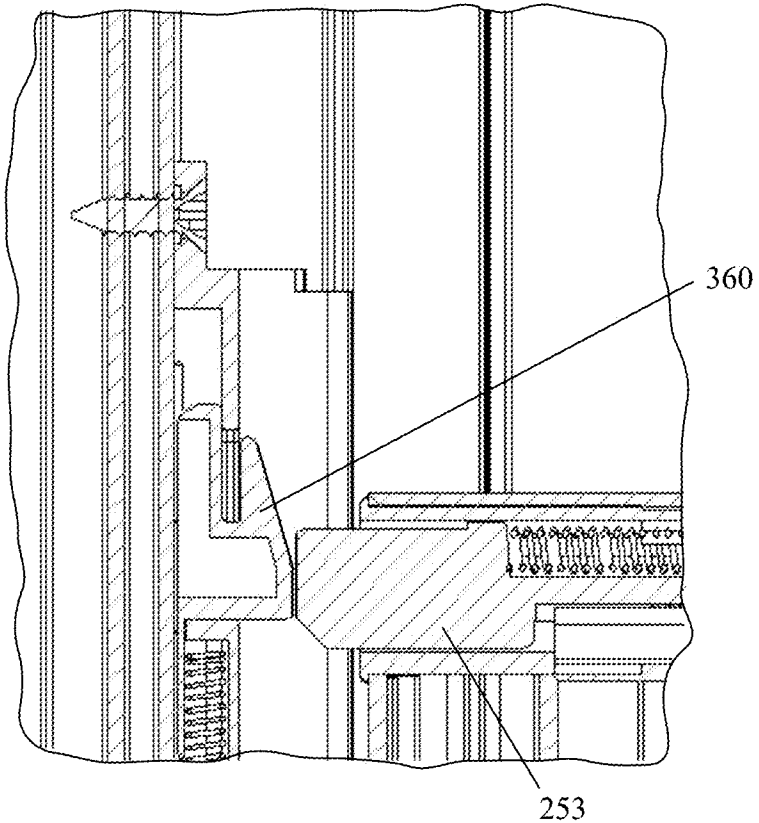
Figure 161A:
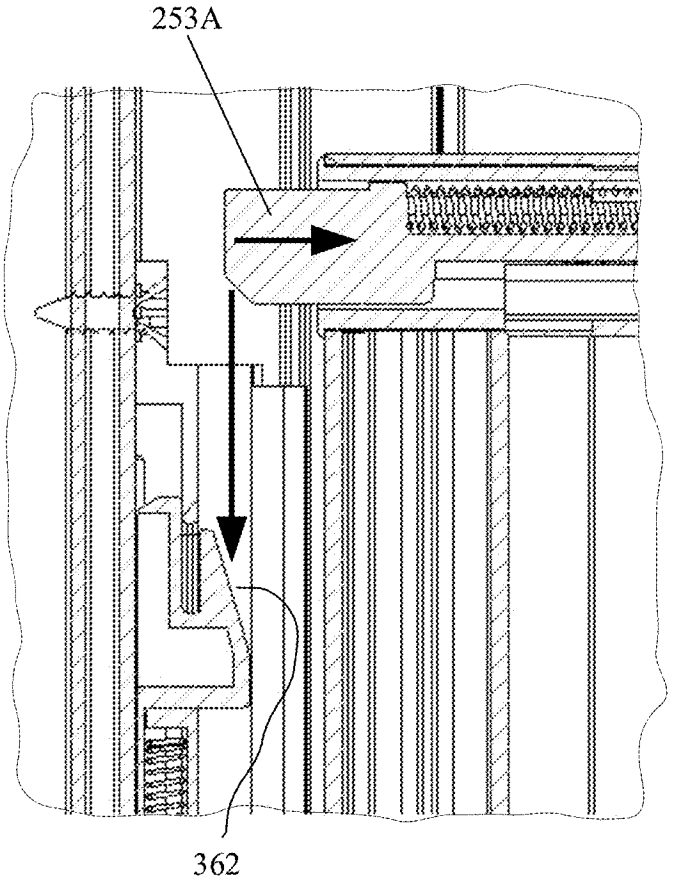
Figure 162:
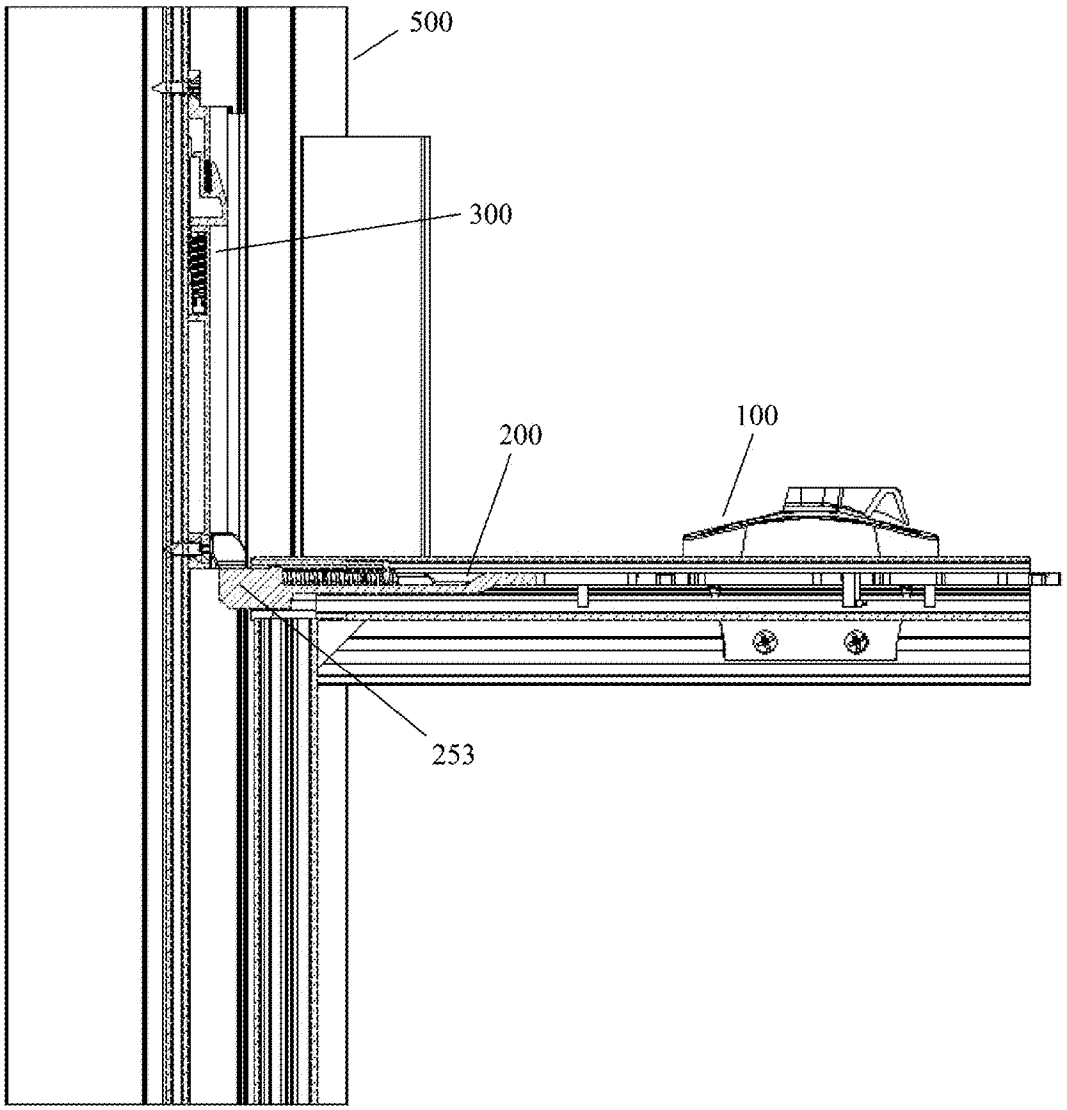
Figure 163:
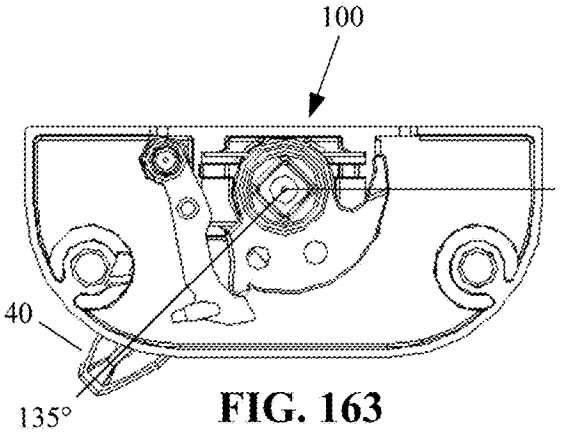
Figure 165:
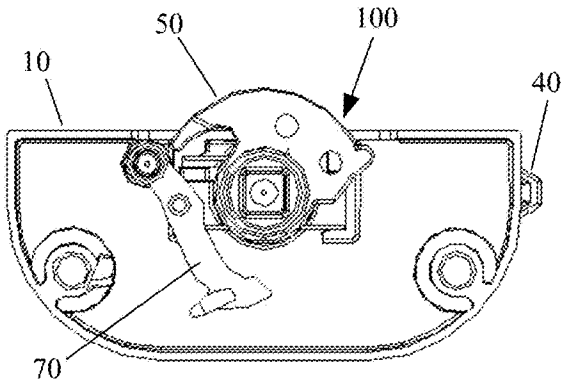
Figure 164:
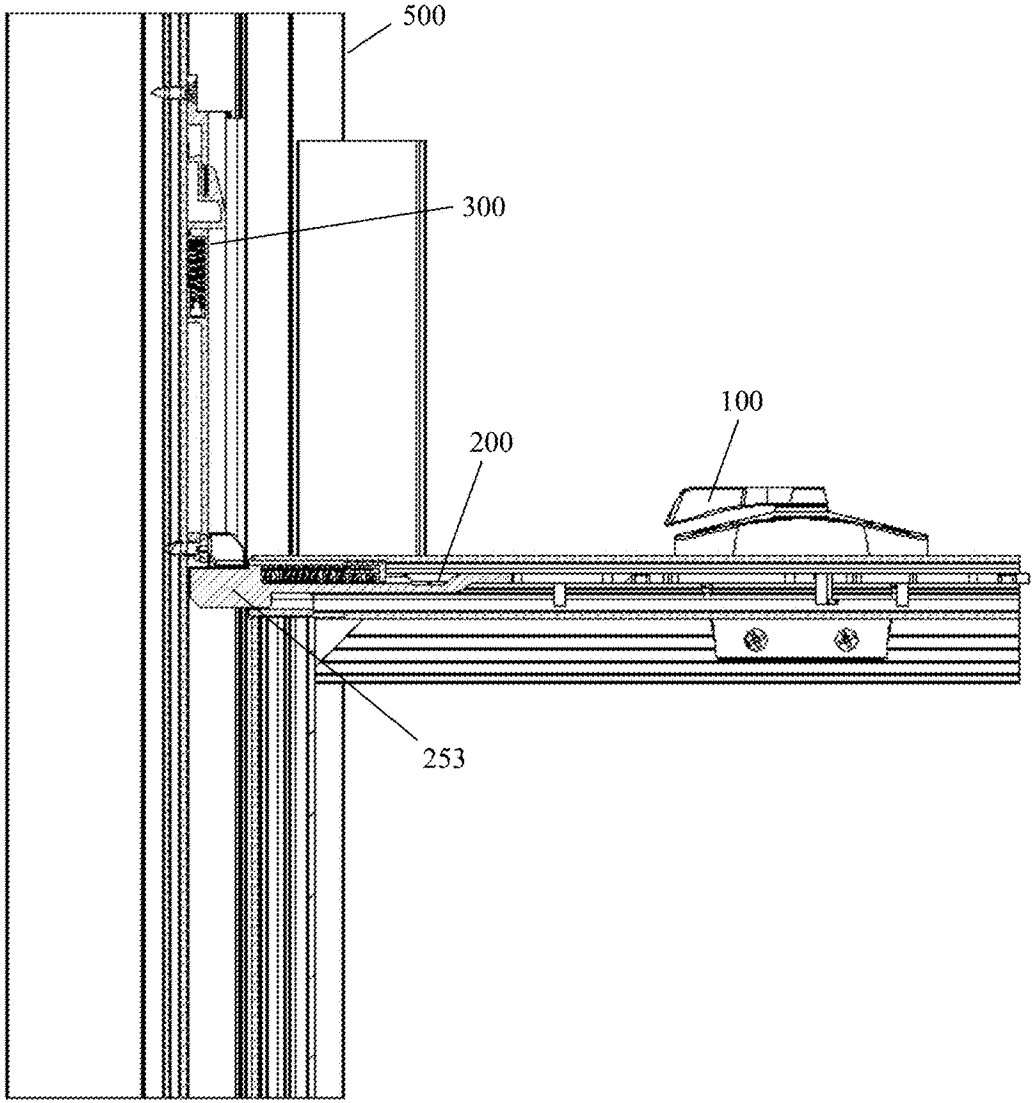

FIG. 117 a rear view of the keeper of FIG. 111;

FIG. 118 is a perspective view of a meeting rail of a sash window frame engaged with a master window frame (or a second sash window frame) in the closed window position, and showing a cutout on the top of the meeting rail to receive the lever arm of the sash lock of FIG. 44, a pair of holes on the top of the meeting rail to receive a pairs of screws for mounting of the sash lock thereto, and an opening in the side of the window frame to receive the latch assembly of FIG. 74 therein;

FIG. 119 is a front view of the meeting rail engaged with a master window frame, as shown in FIG. 118;

FIG. 120 is an end view of the meeting rail engaged with the master window frame, as shown in FIG. 118;

FIG. 121 is a top view of the meeting rail engaged with the master window frame, as shown in FIG. 118;

FIG. 122 is a cross-sectional view through the meeting rail engaged with the master window frame, as shown in FIG. 118;

FIG. 123 is an exploded view showing the sash window frame engaged with the master window frame, as shown in FIG. 118, and also showing the latch assembly of FIG. 74, the sash lock of FIG. 44, and the keeper of FIG. 111, prior to respective installation with respect to the sash window frame and the master window frame;

FIG. 124 shows the perspective view of the meeting rail of the sash window engaged with the master window frame, as seen in FIG. 118, but after installation of the tilt latch and the sash lock with respect to the sash window frame, and after installation of the keeper upon the master window frame;

FIG. 125 is a cross-sectional view taken normal to the axis of the meeting rail of the sash window engaged with the master window frame, after installation of the tilt latch, the sash lock, and the keeper, as shown in FIG. 124;

FIG. 126 is a cross-sectional view taken parallel to the axis of the meeting rail of the sash window engaged with the master window frame, after installation of the tilt latch, the sash lock, and the keeper, as shown in FIG. 124;

FIG. 127 is a cross-sectional view taken through one side of the master window frame, also showing a corresponding cross-sectional view of the stop assembly of FIG. 1, prior to being secured to the master window frame;

FIG. 128 is the cross-sectional view of the master window frame and stop assembly as seen in FIG. 127, but shown after the stop assembly is secured to the master window frame;

FIG. 129 is a perspective view of a side of the master window frame of FIG. 128, with the stop assembly secured to the master window frame;

FIG. 130 is the cross-sectional view of FIG. 125, but includes the side of the master window frame and showing the stop assembly mounted thereto;

FIG. 131 is a cross-sectional view taken parallel to the axis of the meeting rail of the sash window engaged with the master window frame, after installation of the tilt latch, the sash lock, and the keeper, as shown in FIG. 126, and with the shaft/handle member at zero degrees of rotation for the cam of the sash lock assembly to be in the extended locked position with respect to the keeper, and the latch member in the corresponding extended position, to engage a bottom surface of a first portion of the stop assembly to redundantly lock the window in the closed window position;

FIG. 132 is a perspective view of the arrangement shown in FIG. 131, being on the left-hand side of the sash window;

FIG. 133 is a perspective view of a mirrored version of the sash lock and tilt latch arrangement of FIG. 132, being installed on the right-hand side of the window;

FIG. 134 is a cross-sectional view looking down on the top of the meeting rail and the sash lock assembly of the arrangement shown in FIG. 131, with the shaft/handle member at zero degrees of rotation for the cam of the sash lock assembly to be in the extended locked position with respect to the keeper;

FIG. 135 is a view looking up at the bottom of the sash lock assembly, the tilt latch, and the stop assembly as shown in FIG. 131, with the latch member in the extended position, to engage a bottom surface of the housing of the stop assembly;

FIG. 136 is the cross-sectional view of FIG. 131, but is shown with the shaft/handle member at 135 degrees of rotation for the cam of the sash lock assembly to be in a first retracted position, being unlocked with respect to the keeper, and with the latch member correspondingly moved into a first retracted position, being moved clear of the bottom surface of the housing of the stop assembly;

FIG. 137 is the cross-sectional view of FIG. 134, but shown with the shaft/handle member at 135 degrees of rotation;

FIG. 138 is the view looking up at the bottom of the sash lock assembly, the tilt latch, and the stop assembly as shown in FIG. 135, but shown with the shaft/handle member at 135 degrees of rotation, and with the latch member in the first retracted position, to be clear of the bottom surface of the housing of the stop assembly;

FIG. 139A is a perspective view of the sash lock assembly, the tilt latch, and the stop assembly as shown in FIG. 131, with the latch member in the extended position, to engage a bottom surface of the housing of the stop assembly;

FIG. 139B is a bottom view of the sash lock assembly, as shown in FIG. 137A, with the shaft/handle member at zero degrees of rotation for the cam to be in the extended locked position with respect to the keeper;

FIG. 140A is a perspective view of the sash lock assembly, the tilt latch, and the stop assembly as shown in FIG. 136, with the latch member in the first retracted position, being moved clear of the bottom surface of the housing of the stop assembly;

FIG. 140B is a bottom view of the sash lock assembly, as shown in FIG. 138A, with the shaft/handle member at 135 degrees of rotation for the cam to be in the first retracted position, being unlocked with respect to the keeper;

FIG. 141 is the cross-sectional view of FIG. 136, but is shown with the sash window having been opened/elevated partially, for the top surface of the tongue of the latch member to just contact the bottom surface of the slidable stop member of the stop assembly, with the slidable stop member still biased into its first position;

FIG. 142 is the cross-sectional view of FIG. 141, but is shown with the sash window having been opened/elevated even further, such that the top surface of the tongue of the latch member contacting the bottom surface of the slidable stop member of the stop assembly has caused the slidable stop member to be moved to a second position, where it may inhibit any further opening of the sash window;

FIG. 143A is an enlarged detail view of FIG. 141;

FIG. 143B is an enlarged detail view of FIG. 142;

FIG. 144A is a perspective view of the sash lock assembly, the tilt latch, and the stop assembly as shown in FIG. 141, with the latch member in the first retracted position, and with its tongue contacting the bottom surface of the slidable stop member of the stop assembly, while in its first position;

FIG. 144B is a perspective view of the sash lock assembly, the tilt latch, and the stop assembly as shown in FIG. 142, with the latch member in the first retracted position, and with its tongue still in contact with the bottom surface of the slidable stop member of the stop assembly, but after driving it into its second position;

FIG. 145 is the cross-sectional view of FIG. 142, but is shown with the shaft/handle member at 165 degrees of rotation for the cam of the sash lock assembly to be in a second retracted position, being unlocked with respect to the keeper, and with the latch member correspondingly moved into a second retracted position, being moved clear of the bottom surface of the slidable stop member of the stop assembly, so that it may no longer inhibit further opening of the sash window;

FIG. 145A is a bottom view of the sash lock assembly, as shown in FIG. 140B, but with the shaft/handle member shown at 165 degrees of rotation;

FIG. 146 is the cross-sectional view of FIG. 137, but shown with the shaft/handle member at 165 degrees of rotation;

FIG. 147 is the view looking up at the bottom of the sash lock assembly, the tilt latch, and the stop assembly as shown in FIG. 138, but shown with the shaft/handle member at 165 degrees of rotation, and with the latch member in the second retracted position, to be clear of the bottom surface of the slidable stop member of the stop assembly;

FIG. 148 is the cross-sectional view of FIG. 145, but is shown after the slidable stop member of the stop assembly has been biased back to its first position;

FIG. 149A is a perspective view of the sash lock assembly, the tilt latch, and the stop assembly as shown in FIG. 145, with the latch member in the second retracted position, and with its tongue moved clear of the bottom surface of the slidable stop member of the stop assembly, while still in its second position;

FIG. 149B is a perspective view of the sash lock assembly, the tilt latch, and the stop assembly as shown in FIG. 148, with the latch member in the second retracted position, and with its tongue clear of the bottom surface of the slidable stop member of the stop assembly that has been biased back into its first position;

FIG. 150 is the cross-sectional view of FIG. 148, but is shown after the shaft/handle member has been released by the user and is biased from the 165 degree position to the 135 degree position, for the cam to return to the first retracted position, and the latch member to also return to the first retracted position;

FIG. 151 is a perspective view of the sash lock assembly, the tilt latch, and the stop assembly as shown in FIG. 150, with the latch member in the first retracted position and at an elevated position with respect to the slidable stop member of the stop assembly;

FIG. 152 is a bottom view of the sash lock assembly, as shown in FIG. 145A, but with the shaft/handle member shown back at the 135 degrees position;

FIG. 153 is the cross-sectional view of FIG. 153, but is shown after the shaft/handle member has been actuated by the user into the 180 degree position, for the cam to occupy a third retracted position, and the latch member to also occupy a corresponding third retracted position, at which hit may be fully retracted within the latch housing;

FIG. 154 is a perspective view of the sash lock assembly, the tilt latch, and the stop assembly as shown in FIG. 153, with the latch member in the third retracted position;

FIG. 155 is a bottom view of the sash lock assembly, as shown in FIG. 152, but with the shaft/handle member shown at the 180 degree position;

FIG. 156 is the cross-sectional view of FIG. 146, but shown with the shaft/handle member at 180 degrees of rotation;

FIG. 157 is the view looking up at the bottom of the sash lock assembly, the tilt latch, and the stop assembly as shown in FIG. 147, but shown with the shaft/handle member at 180 degrees of rotation, and with the latch member in the third retracted position, to be clear of the master window to permit tilting of the sash window;

FIG. 158 is the cross-sectional view of FIG. 153, but is shown after the shat/handle member has been released by the user, and is biased from the 180 degree position to the 135 degree position, for the cam to return to the first retracted position, and the latch member to also return to the first retracted position;

FIG. 159 is a perspective view of the sash lock assembly, the tilt latch, and the stop assembly as shown in FIG. 158, with the latch member in the first retracted position;

FIG. 160 is a bottom view of the sash lock assembly, as shown in FIG. 155, but with the shaft/handle member shown at the 135 degree position;

FIG. 161A is an enlarged detail view of FIG. 158;

FIG. 161B is the enlarged detail view of FIG. 161A, after the sash window has been lowered to cause contact between the tongue of the latch member and the sliding member of the stop assembly, to cause retraction of the latch member;

FIG. 162 is the cross-sectional view of FIG. 161B, shown after the sash window has been moved into the closed window position, and the latch has returned to the first retracted position;

FIG. 163 is the bottom view of the sash lock assembly, as shown in FIG. 160, with the shaft/handle member still at the 135 degree position;

FIG. 164 is the cross-sectional view of FIG. 162, shown after the shaft/handle member has been actuated to be at the zero degree position for the cam of the sash lock assembly to be in the extended locked position with respect to the keeper, and the latch member in the corresponding extended position, to again engage a bottom surface of a first portion of the stop assembly to redundantly lock the window in the closed window position; and FIG. 165 is the bottom view of the sash lock assembly, as shown in FIG. 163, with the shaft/handle member still at the zero degree position.

DETAILED DESCRIPTION OF THE INVENTION

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one", "one or more", and "and/or" are open-ended expressions that are both conjunctive and disjunctive in operation. For example, each of the expressions "at least one of A, B and C", "one or more of A, B, and C", and "A, B and/or C" mean all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference.

Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of multiple individual tolerances.

Any use of a friction fit (i.e., an interface fit) between two mating parts described herein may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator." available at: www.engineersedge.com/calculators/machine-design/press-fit/press-fit-calculator.htm).

It is further noted that any use herein of relative terms such as "top," "bottom," "upper," "lower," "vertical," and "horizontal" are merely intended to be descriptive for the reader, based on the depiction of those features within the figures for one particular position of the device, and such terms are not intended to limit the orientation with which the device of the present invention may be utilized.

FIG. 1 shows an embodiment of the Applicant's combination sash lock assembly 100, tilt latch assembly 200, and stop assembly 30, all of which may be used in conjunction with a sash window that is designed to be slidable and tiltable with respect to a master window frame.

Figure 9:
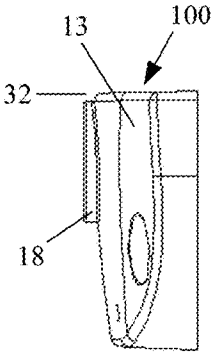
FIG. 9 is a first end view of the sash lock housing of FIG. 2.
Figure 11:
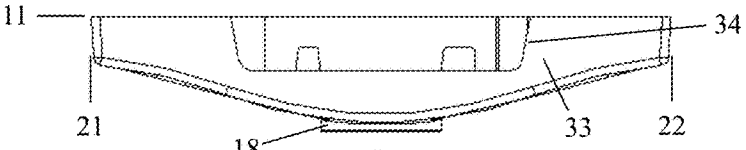
FIG. 11 is a rear view of the sash lock housing of FIG. 2.
Figure 7:
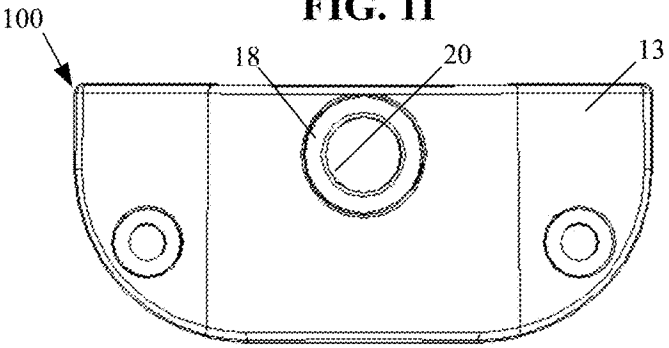
FIG. 7 is a top view of the sash lock housing of FIG. 2.
Figure 6:
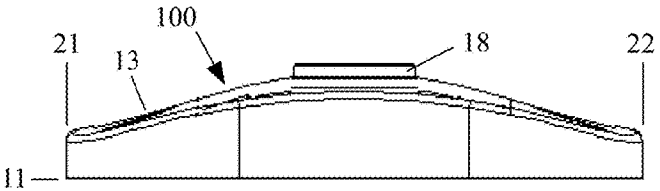
FIG. 6 is a front view of the sash lock housing of FIG. 2.
Figure 8:
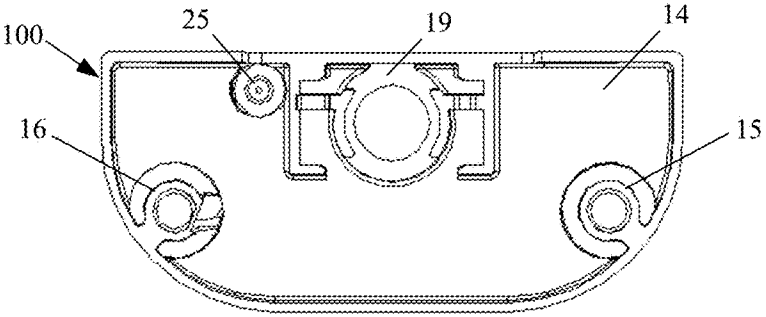
FIG. 8 is a bottom view of the sash lock housing of FIG. 2.
Figure 10:
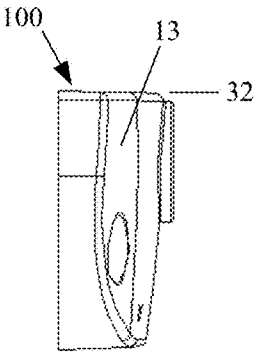
FIG. 10 is a second end view of the sash lock housing of FIG. 2.
Figure 12:
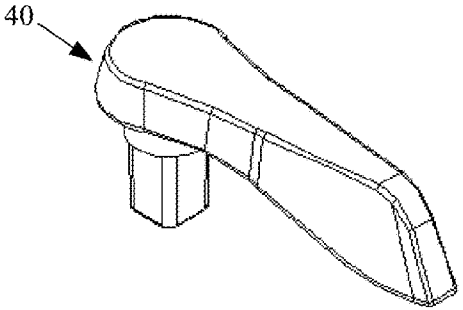
FIG. 12 is a first perspective view of the shaft/handle member of the sash lock assembly of FIG. 1.
Figure 19:
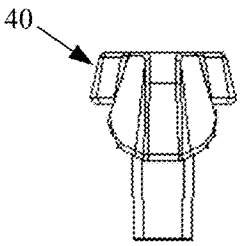
FIG. 19 is a second end view of the shaft/handle member of FIG. 12.
Figure 16:
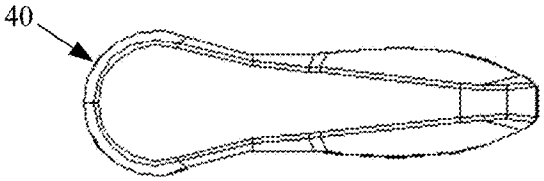
FIG. 16 is a top view of the shaft/handle member of FIG. 12.
Figure 15:
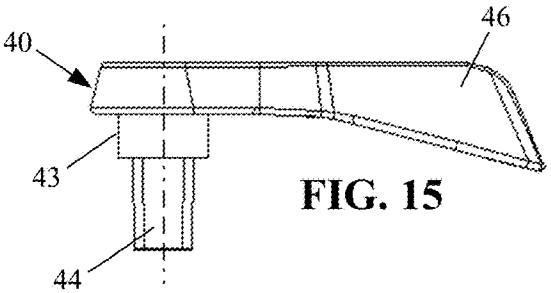
FIG. 15 is a side view of the shaft/handle member of FIG. 12.
Figure 17:
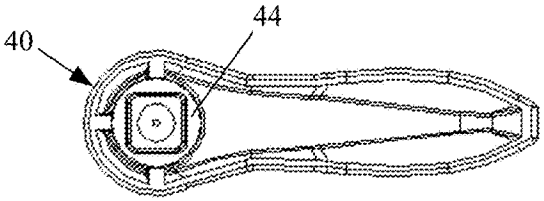
FIG. 17 is a bottom view of the shaft/handle member of FIG. 12.
Figure 13:
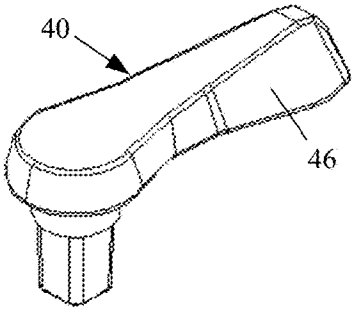
FIG. 13 is a second perspective view of the shaft/handle member of FIG. 12.
Figure 18:
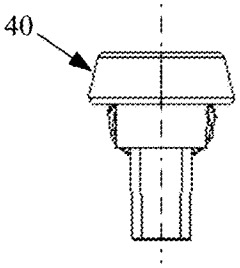
FIG. 18 is a first end view of the shaft/handle member of FIG. 12.
Figure 14:
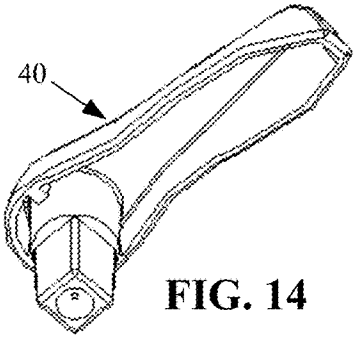
FIG. 14 is a third perspective view of the shaft/handle member shown in FIG. 12.
Figure 20:
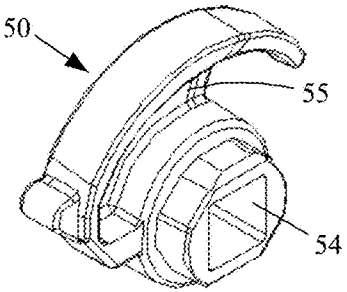
FIG. 20 is a first perspective view of the cam of the sash lock assembly of FIG. 1.
Figure 21:
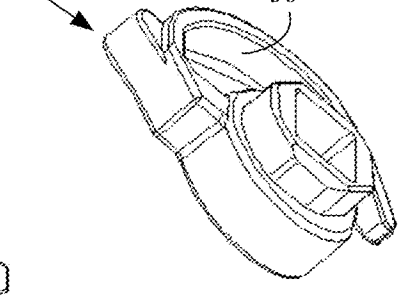
FIG. 21 is a second perspective view of the cam shown in FIG. 20.
Figure 27:
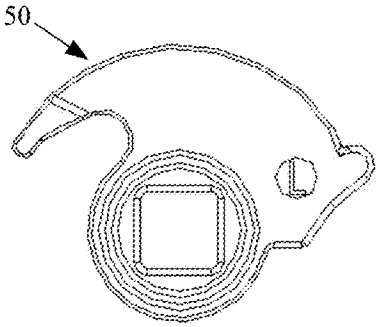
FIG. 27 is a bottom view of the locking cam of FIG. 20.
Figure 26:
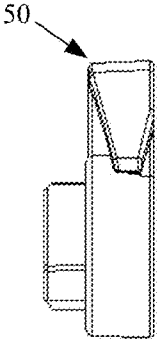
FIG. 26 is a second end view of the locking cam of FIG. 20.
Figure 24:
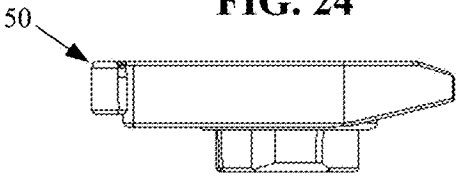
FIG. 24 is a second side view of the locking cam of FIG. 20.

Perspective views of the housing 10 of the sash lock assembly 100 are shown in FIGS. 2-5, while corresponding orthogonal views are shown in FIGS. 6-11. The housing 10 is not limited to the shape illustrated within FIGS. 6-11, and could take on many different suitable shapes, including a rectangular shape, an irregular shape, etc. However, the housing 10 may be desirably shaped to have a generally curved outer surface 13, spanning from a first end 21 to the second end 22. The curvature of surface 13 may terminate at a generally flat bottom surface 11. The curvature of surface 13 may also transition, as seen in FIG. 9, into a generally flat surface 32, at which a wall 33 may be formed (FIG. 11). The housing 10 may be hollowed out to form an interior surface 14, and the wall 33 may have an opening 34 into the interior cavity of the housing.

Extending outwardly from the interior surface 14 of the housing 10 may be at least one hollow cylindrical protrusion that may be used to secure the sash lock assembly 100 to the sash window. In one embodiment of the housing, two hollow cylindrical protrusions 15 and 16 may be used, and each may be configured to respectively receive a screw or other fastener for mounting of the sash lock assembly 100 to the meeting rail of the sliding sash window.

Extending outwardly from the interior surface 14 of the housing 10 may also be a shaft 25, which may be hollow and may be used for pivotal mounting of a lever arm to the housing.

The housing 10 may have a cylindrical boss 18 extending upwardly from the outer surface 13, and may also have a cylindrical boss 19 extending downwardly from the interior surface 14, into the housing cavity, which may be joined and may constitute a single boss. The housing may have a hole 20 through the cylindrical boss 18 and boss 19. The hole 20 may be used for pivotal mounting of a shaft that may extend from a portion of a locking cam, or alternatively, the hole 20 may be used for pivotal mounting of a separate shaft/handle member, to which the locking cam may instead be fixedly secured, as described hereinafter.

As seen in FIGS. 13-19, a shaft/handle member 40 may have a cylindrical shaft 43, one end of which may have a keyed protrusion 44 extending therefrom, with an orifice therein. The other end of the shaft 43 may have a graspable handle portion 46 that may extend generally orthogonally with respect to the axis of shaft 43. The shaft 43 may be configured to be pivotally received within the hole 20 of the housing 10. The keyed protrusion 44 may be any suitable cross-sectional shape, and in this example, the keyed protrusion is formed using a rectangular shape.

The locking cam 50, illustrated in FIGS. 20-27, may have a cylindrical hub 53, with a keyed opening 54 that may be shaped to match the keyed protrusion 44 of the shaft/handle member 40. Extending laterally away from the hub 53 may be a wall 55, and extending laterally away from the wall 55 may be a curved cam wall 56, which may be used to engage and lock with respect to the key of a corresponding keeper, and to draw the sliding sash window in closer proximity to the master window frame (or to the other sash window for a double-hung arrangement). The curved cam wall 56 may have a curved protrusion 56P protruding laterally therefrom, which may be a semi-cylindrical protrusion, with a surface having a radius 56PR. The axis of the semi-cylindrical protrusion 56P may be substantially parallel to the axis of the hub 53.

Protruding away from the hub 53 may be a cylindrical member 57, the axis of which may be generally concentric with the axis of the hub. The cylindrical member 57 may have a first flat 58A formed thereon, and a second flat 58B may be formed thereon to be clocked 180 degrees away from the first fat 58A. The fats 58A and 58B may co-act with respect to the leaf spring 90 shown in FIGS. 38-40, and may operate as a detent mechanism to releasably secure the cam 50 at an extended (locking) position and a third retracted (e.g., a third unlocked) position, which positions are discussed hereinafter with respect to FIGS. 53A to 53E.

Figure 22:
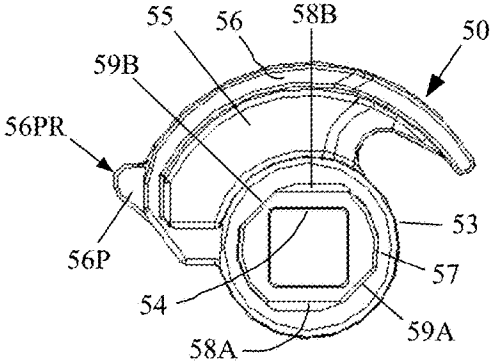
FIG. 22 is a top view of the locking cam of FIG. 20.
Figure 23:
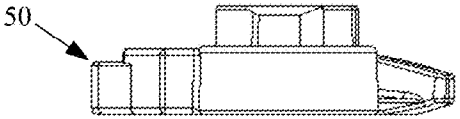
FIG. 23 is a first side view of the locking cam of FIG. 20.
Figure 25:
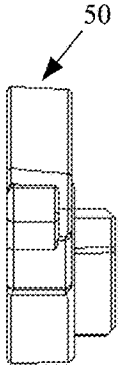
FIG. 25 is a first end view of the locking cam of FIG. 20.
Figure 28:
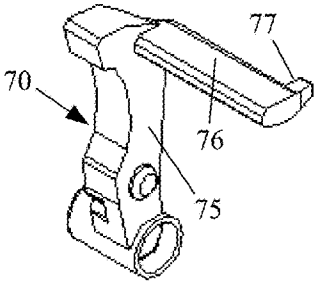
FIG. 28 is a first perspective view of the lever arm of the sash lock assembly of FIG. 1.
Figure 29:
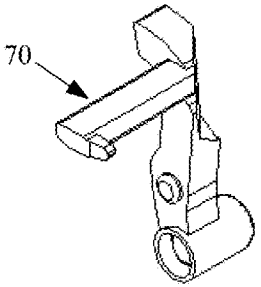
FIG. 29 is a second perspective view of the lever arm of FIG. 28.
Figure 34:
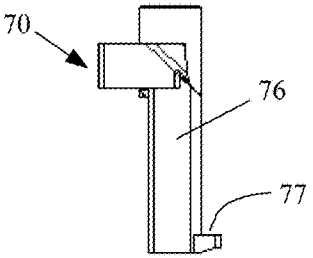
FIG. 34 is a second side view of the lever arm of FIG. 28.
Figure 37:
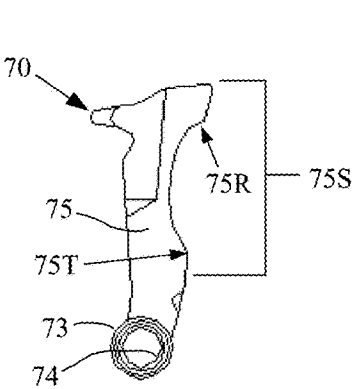
FIG. 37 is a bottom view of the lever arm of FIG. 28.
Figure 36:
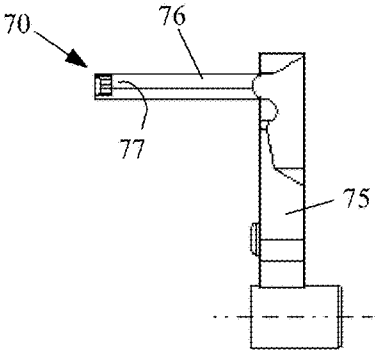
FIG. 36 is a second end view of the lever arm of FIG. 28.
Figure 32:
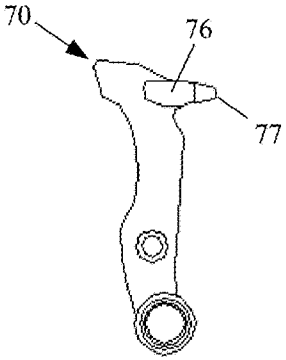
FIG. 32 is a top view of the lever arm of FIG. 28.
Figure 35:
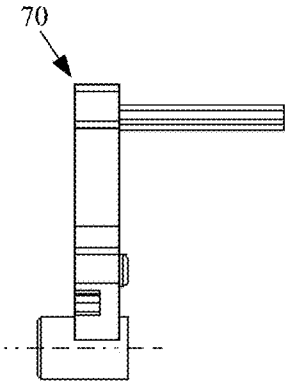
FIG. 35 is a first end view of the lever arm of FIG. 28.
Figure 30:
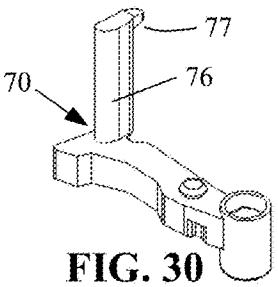
FIG. 30 is a third perspective view of the lever arm of FIG. 28.
Figure 31:
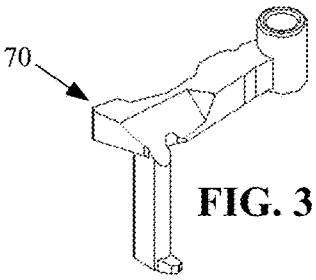
FIG. 31 is a fourth perspective view of the lever arm of FIG. 28.
Figure 33:
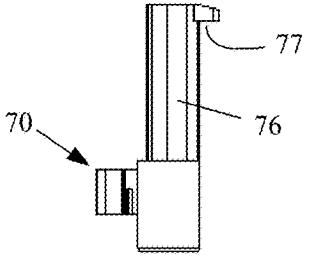
FIG. 33 is a first side view of the lever arm of FIG. 28.

The cylindrical member 57 may also have a third flat 59A formed thereon, as seen in FIG. 22, at a position that may be clocked roughly 135 degrees from the first flat 58A. The flat 59A may also co-act with respect to a leaf spring 90 to operate as a detent mechanism to releasably secure the cam 50 at another sash unlocked position, termed herein, with respect to the operation of the sash lock and sash window, as a first retracted (unlock) position. For greater stability of the cam in being releasably retained at this unlocked position, a fourth flat 59B may be positioned on the cylindrical member 57 at a position that is clocked roughly 180 degrees from the third flat 59A, which may releasably engage a second leaf spring.

In another embodiment of the cam, the cylindrical member 7 may also have a flat formed thereon, at a position that is clocked at about 165 degrees from the first flat 58A, which flat may also co-act with respect to the leaf spring 90 to operate as a detent mechanism to releasably secure the cam 50 at yet another sash unlocked position, termed herein as a second retracted (unlock) position. A sixth flat may be positioned on the cylindrical member 57 at a position that may be clocked at about 180 degrees from the flat at 165 degrees from the first flat 58A, and which may releasably engage a leaf spring where the dual leaf spring arrangement is used.

Interaction between the sash lock assembly 100, once installed upon the meeting rail of the sliding sash window, and the installed latch assembly 200, may be through the use of a lever arm 70 that may be pivotally mounted to the housing 10. The lever arm 70 is shown within FIGS. 28-37. Lever arm 70 may include a hub 73, with a mounting hole 74 therein. Extending laterally away from the axis of the hub 73 may be an arm 75, which may have a sculpted surface 75S (a follower portion), and which may include a small radiused step 75T that may serve as a shallow detent. The sculpted surface 75S may include a radiused concave feature 75R, which is discussed hereinafter. The radiused feature 75R may be formed with a radius being substantially equal to, or slightly larger than, the radius 56PR of the protrusion 56P on cam 50, for engagement therebetween. The sculpted surface 75S is shaped to be selectively driven through contact resulting from rotation of the semi-cylindrical protrusion 56P of the locking cam 50, as discussed hereinafter. The arm 75 may transition into a post 76 that may be generally orthogonal to the arm 75, and may be generally parallel to the axis of the hub 73. A protrusion 77 may protrude from the post 76.

Figure 38:
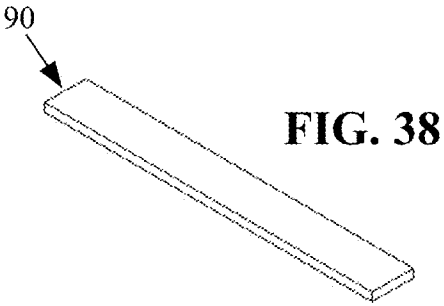
FIG. 38 is a perspective view of a leaf spring used in the sash lock assembly of FIG. 1.
Figure 40:
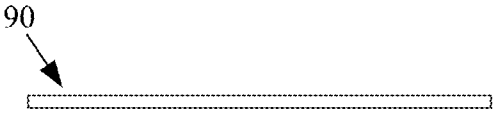
FIG. 40 is a side view of the leaf spring of FIG. 39.
Figure 39:
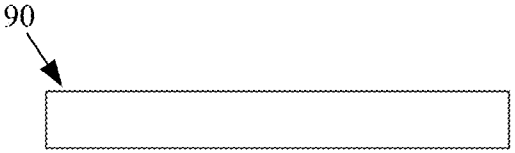
FIG. 39 is a top view of the leaf spring of FIG. 38.
Figure 41:
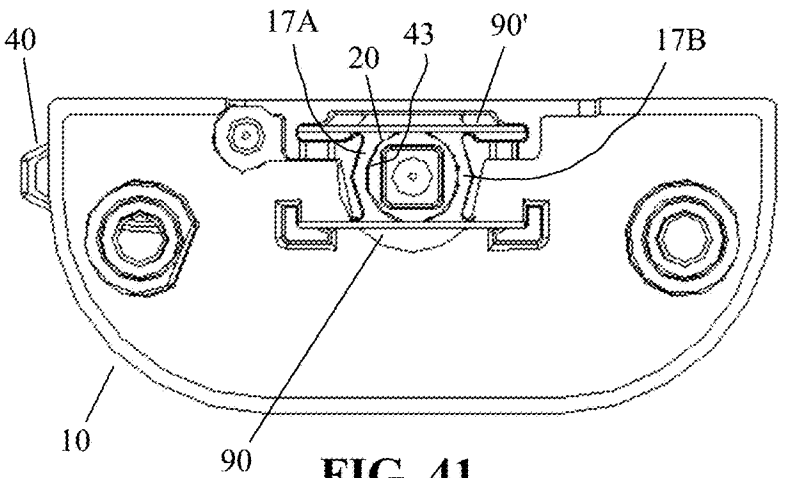
FIG. 41 is a bottom view of the housing of FIG. 2, shown with two of the leaf springs of FIG. 38 and the shaft/handle member of FIG. 12 installed with respect to the housing.

Initial assembly of sash lock assembly 100 is shown in FIG. 41. The leaf spring 90, which may be a generally flat elongated flexible member, as seen in FIGS. 38-40, may be installed into the housing interior. The ends of leaf spring 90 may be fixedly received within a pair of corresponding recesses in the housing, using a friction fit, or using adhesive, or mechanical fasteners, etc., or any combination thereof. As mentioned above, a second leaf spring 90' may be used, and may similarly be secured within the housing cavity, to be at a distance away from the first leaf spring 90 that is roughly the same as the distance between each of the pairs of flats (e.g., flats 58A and 58B, and flats 59A and 59B). The cylindrical shaft 43 of the shaft/handle member 40 may then be pivotally received in hole 20 of housing 10.

Figure 42:
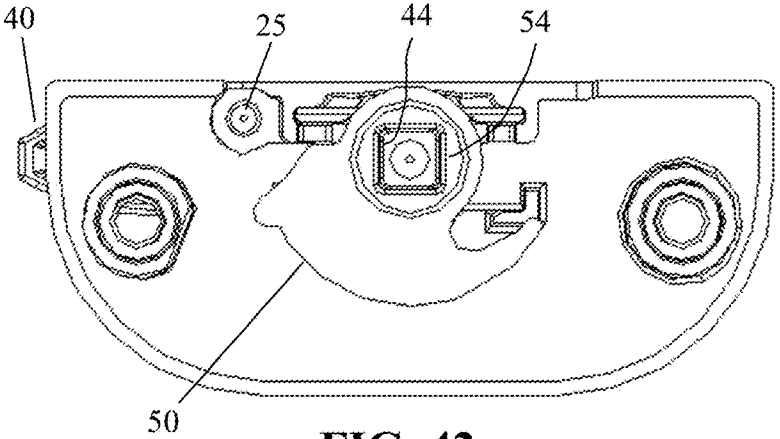
FIG. 42 is the bottom view of FIG. 41, but shown with the cam of FIG. 20 fixedly secured to the shaft/handle member.
Figure 49:
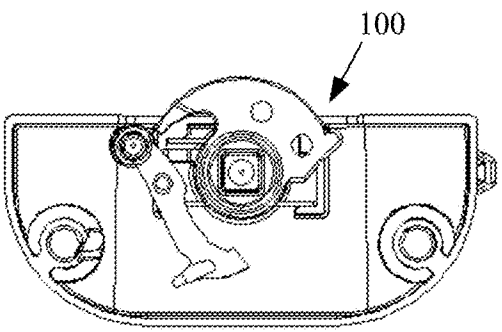
FIG. 49 is a bottom view of the sash lock assembly of FIG. 44.
Figure 48:
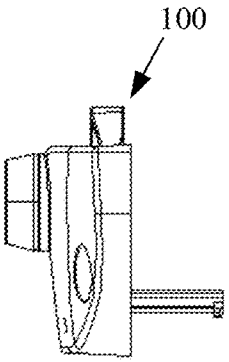
FIG. 48 is a second end view of the sash lock assembly of FIG. 44.
Figure 45:
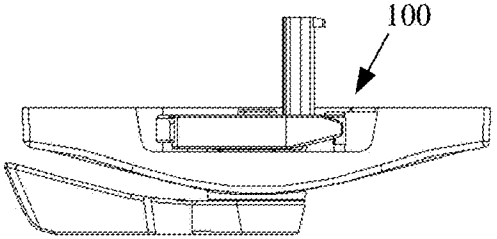
FIG. 45 is a front view of the sash lock assembly of FIG. 44.

As seen in FIG. 42, the locking cam 50 may then be joined to the shaft/handle member 40, with the keyed protrusion 44 of the shaft member 40 being received within the keyed opening 54 of locking cam 50, and being secured thereat using a friction fit, adhesive, mechanical fasteners, or by being welded thereto, or by using any combination thereof, or any other suitable means of securing the two parts together. Note that additional pivotal support for the cam 50 may be provided by the curved housing walls 17A and 17B (FIG. 4 and FIG. 41) supporting the hub 53 of the cam therebetween.

Figure 43:
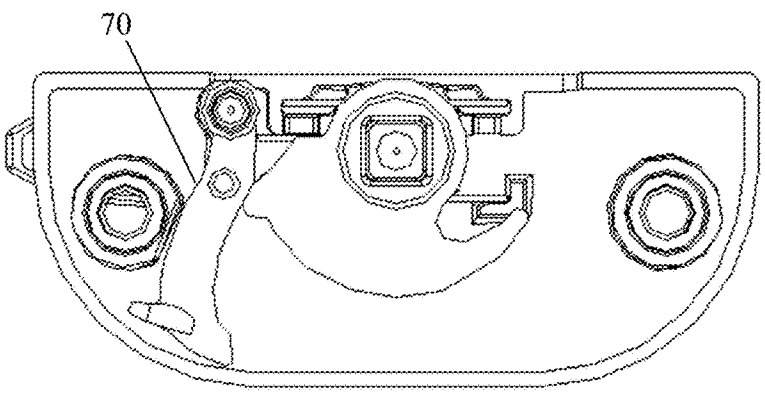
FIG. 43 is the bottom view of FIG. 42, but shown with the lever arm of FIG. 28 pivotally installed therein, and with the cam shown in a retracted position.

Next, as seen in FIGS. 42 and 43, the hole 74 of the hub 73 of the lever arm 70 may be pivotally received upon the shaft 25 that may protrude out from the interior surface 14 of the housing. To pivotally secure the lever arm 70 thereto, the end of the shaft 25 may be bucked like a rivet, to form a head to prevent the lever arm from slipping off of the post. Alternatively, a screw or other mechanical fastener may be used for pivotally securing the hub 73 of the lever arm 70 to the shaft 25 of the housing 10.

FIGS. 44-52 show various views of the sash lock assembly with the cam in the extended (lock) position.

FIGS. 53A-53E show four key positions and one intermediate position that may be occupied by the components of the assembled sash lock 100.

Figure 53E:
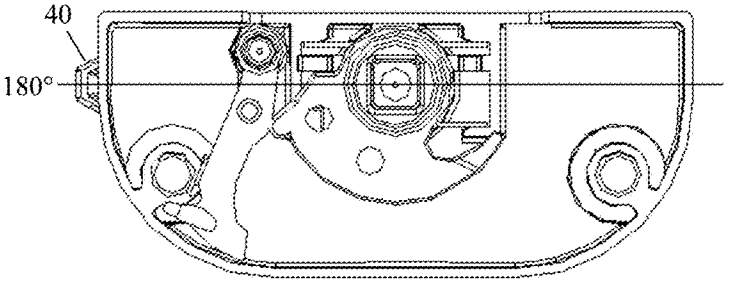
FIG. 53E is the bottom view of FIG. 53D, but is shown with the cam having been moved into the third retracted position (i.e., shaft/handle at 180 degrees of rotation), and with the protrusion on the cam having correspondingly driven the follower portion of the lever arm.
Figure 53D:
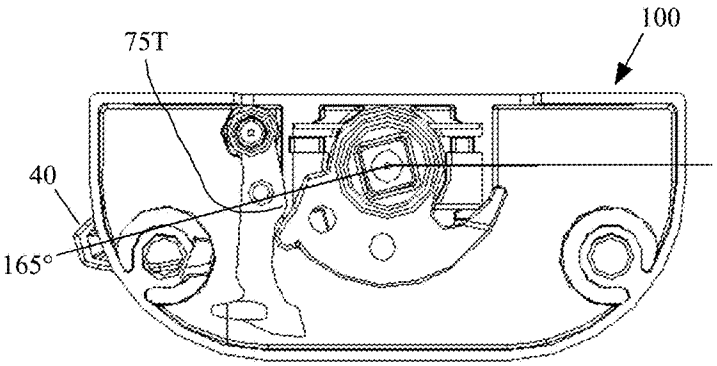
FIG. 53D is the bottom view of FIG. 53C, but is shown with the cam having been moved into the second retracted position (i.e., shaft/handle at 165 degrees of rotation), and with the protrusion on the cam having further driven the follower portion of the lever arm.
Figure 53A:
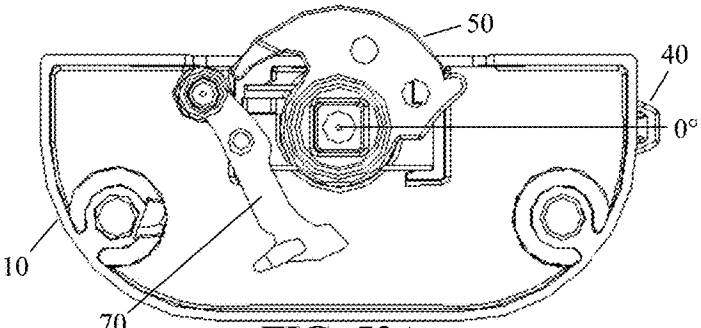
FIG. 53A is the bottom view of the sash lock of FIG. 49 shown with the cam in the extended position (i.e., shaft/handle at zero degrees of rotation)
Figure 53B:
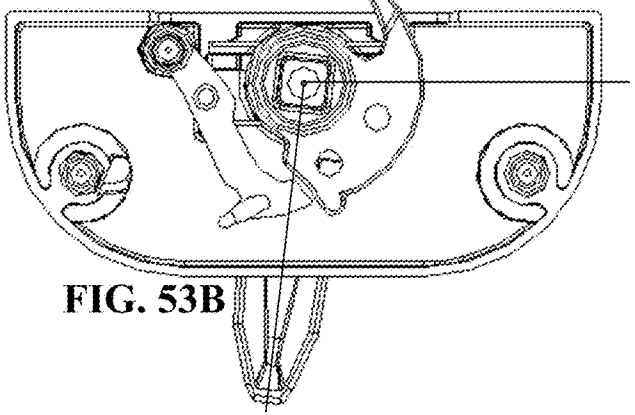
FIG. 53B is the bottom view of FIG. 53A, but is shown with the cam having been moved to where it initially contacts the lever arm (i.e., shaft/handle at roughly 95 degrees of rotation)

FIG. 53A shows the sash lock assembly 100 in the extended locking position, where the curved wall 56 of cam 50 protrudes out from the housing 10, and may engage the key (or "tooth") of a keeper to secure the sliding sash window from sliding within the track of the master window frame, as discussed hereinafter. The lever arm 70 shown therein, is unaffected by the cam 50 in this position, and the lever arm is biased into the position shown by its interconnection with the biased latch member of the latch assembly, as discussed hereinafter. As the shaft/handle member 40 and the cam 50 are rotated away from the zero degree position shown in FIG. 53A, and reach roughly 95 degrees of rotation, as shown in FIG. 53B, the cam will contact and drive the lever arm 70 to co-rotate.

Figure 53C:
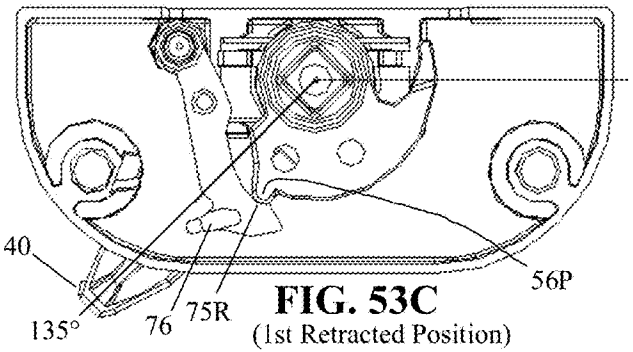
FIG. 53C is the bottom view of FIG. 53A, but is shown with the cam having been moved into the first retracted position (i.e., shaft/handle at 135 degrees of rotation), and with the protrusion on the cam having contacted and actuated the follower portion of the lever arm.

FIG. 53C shows the sash lock assembly 100 in the first retracted (first cam unlocked) position, where the shaft/handle member 40 has been rotated 135 degrees from the extended locking position, for the curved wall 56 of cam 50 to disengage from the keeper and be retracted within the cavity of the housing 10, to permit the sash window to slide in the master window frame away from the closed window position. During a final portion of the 135 degrees of rotation for the cam to reach the first retracted unlock position, the semi-cylindrical protrusion 56P of the locking cam 50 may contact the lever arm 70 and may continue to cause it to similarly rotate, until the radiused surface 56$P_R$ of protrusion 56P on cam 50 may nest within the radiused feature 75R of the arm 70, for releasable engagement/contact therebetween. With this arrangement of the lever arm 70 and cam 50 at the first retracted (unlock) position (to serve as the window vent stop discussed hereinafter), if a force is applied to the post 76 of the arm by the latch, counter-rotation of the arm about its hub would be reacted/prevented by its engagement with the cam, and would be further reacted, in part, through the pivotal mounting of the cam.

FIG. 53D shows the sash lock assembly 100 with the cam 50 in the second retracted (second unlock) position, where the shaft/handle member 40 has been rotated an additional 30 degrees from the first retracted position (i.e., is rotated 165 degrees from the locked position). During those 30 degrees of rotation for the cam to reach the second retracted position, the semi-cylindrical protrusion 56P of the locking cam 50 may disengage from its position with respect to the radiused feature 75R of the arm (FIG. 53C), and may drive the lever arm 70 to further co-rotate, after which the semi-cylindrical protrusion 56P of the locking cam may rest against the step 75T to provide a tactile indication of such positioning.

FIG. 53E shows the sash lock assembly 100 with the cam 50 in the third retracted (third unlock) position, where the shaft/handle member 40 has been rotated an additional 15 degrees past the second retracted position (i.e., is rotated 180 degrees from the locking position). During those 15 degrees of rotation for the cam to reach the third retracted position, the semi-cylindrical protrusion 56P of the locking cam 50 may pass over the step 75T (FIG. 53D), and may drive the lever arm 70 to further co-rotate. (Note that the each of the herein described rotational amounts—e.g., 135 degrees, 165 degrees, 180 degrees, etc., are merely exemplary, and the sash lock assembly may be constructed so that other rotational amounts to reach those positions may alternatively be used).

The clocking of the flat 58A on the cylindrical member 57 on the hub 53 of locking cam 50 may contact and be flush with the leaf spring 90, to releasably restrain the locking cam 50 from rotating out of the extended locking position (zero degrees of cam rotation), unless being deliberately moved therefrom by the user. Alternatively, such contact therebetween may be so slight as to merely provide tactile indication of such positioning, without offering a significant retraining force. The flat 58A on the cylindrical member 57 on the hub 53 of locking cam 50 may also contact and be flush with the leaf spring 90', to releasably restrain and/or provide tactile indication of the locking cam 50 upon reaching the third retracted unlock position (i.e., 180 degrees of cam rotation).

Also, the clocking of the flat 59A (and the flat 59B where used) of the cylindrical member 57 on the hub 53 of locking cam 50 may be engaged by the flexible leaf spring 90 (and spring 90') when the cam is at the first retracted (unlocked) position (i.e., 135 degrees of cam rotation). Note, to increase flexibility of the leaf springs 90 and 90', only one end of each leaf spring may be fixedly mounted in the housing, to permit some lateral deflection of the leaf springs, but without permitting them to become loosened or disconnected from proper positioning within the housing adjacent to the locking cam, or alternatively both ends may be mounted therein as shown. Also note that since the angle at which the flats 59A/59B were clocked from the flats 58A/58B was approximately 135 degrees, the shaft/handle 40 will need to rotate approximately 135 degrees to actuate the sash lock assembly 100 from the extended lock position to the first retracted (unlock) position. This is shown by the movement of the handle portion 46 of the shaft/handle 40 in FIGS. 53A and 53C. As noted above, angular displacements other than 135 degrees are also possible, as long as the rotational movement is sufficient to move the curved wall 56 of cam 50 far enough away from the keeper to permit sliding movement of the sash window, and although it may be desirable, the cam need not even be fully retracted within the housing 10 at the first retraced unlock position.

In another embodiment, the shaft/handle 40 and cam 50 may also be releasably secured at the second retracted (unlocked) position using the same detent mechanism, where the leaf spring 90 may engage appropriately clocked flats on the hub 53 of locking cam 50.

The above noted interconnection between the sash lock assembly 100 and the latch assembly 200 may be through the use of the following latch assembly configuration.

The latch assembly 200 may include a latch housing 210, shown in FIGS. 54 to 62, which may have a simple exterior surface (e.g., generally cylindrical), the complement of which may be easily formed (e.g., bored) in the sliding sash window frame, to permit ease of its installation therein. However, the housing 210 is not limited to the shape illustrated within those figures, and could take on many different appropriate shapes, including an elongated rectangular shape. However, at least a portion of the housing 210 may be desirably shaped to have a cylindrical outer surface 213, which may span from a first end 211 to second end 212 (FIG. 58). At the first end 211 of the housing 210, the cylindrical outer surface 213 may transition into a protruding lip 211C. A portion of the cylindrical outer surface 213 may also have a series of successive teeth (e.g., 214A, 214B, 214C, 214D, etc.) formed thereon, for securing of the housing within the hole that is formed in the sash window frame. The housing 210 may be hollowed out to form an interior surface 215 (FIGS. 61 and 62). Protruding inward towards the interior surface 215 may be one stop 216A or a pair of stops (e.g., 216A and 216B). A wall 218 may protrude inward to obstruct a portion of the hollowed out interior between the first end 211 and the second end 212. The housing 210 being so formed may slidably receive a latch member 250 therein.

Figure 63:
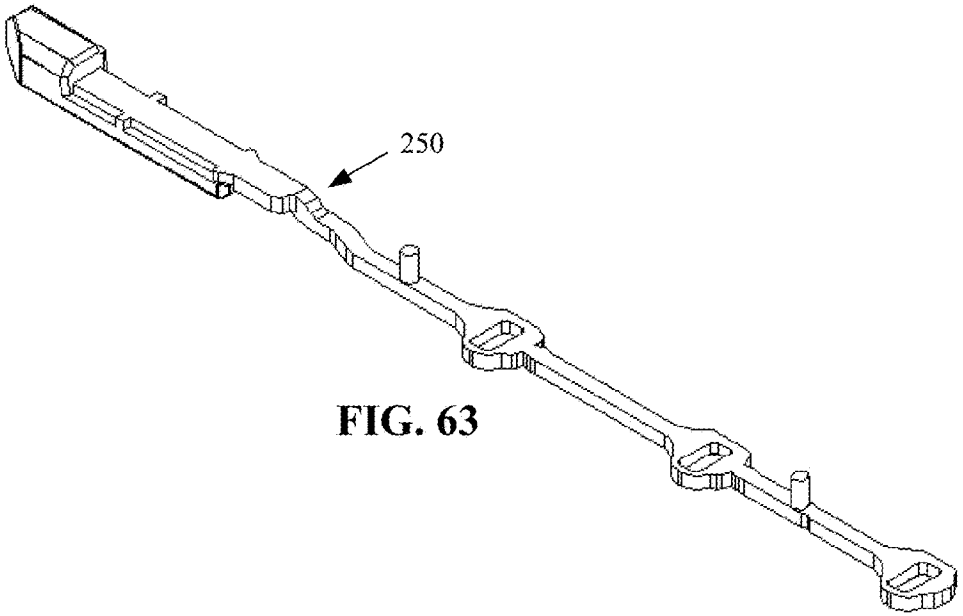
FIG. 63 is a first perspective view of a latch member used in the latch assembly of FIG. 1.
Figure 64:
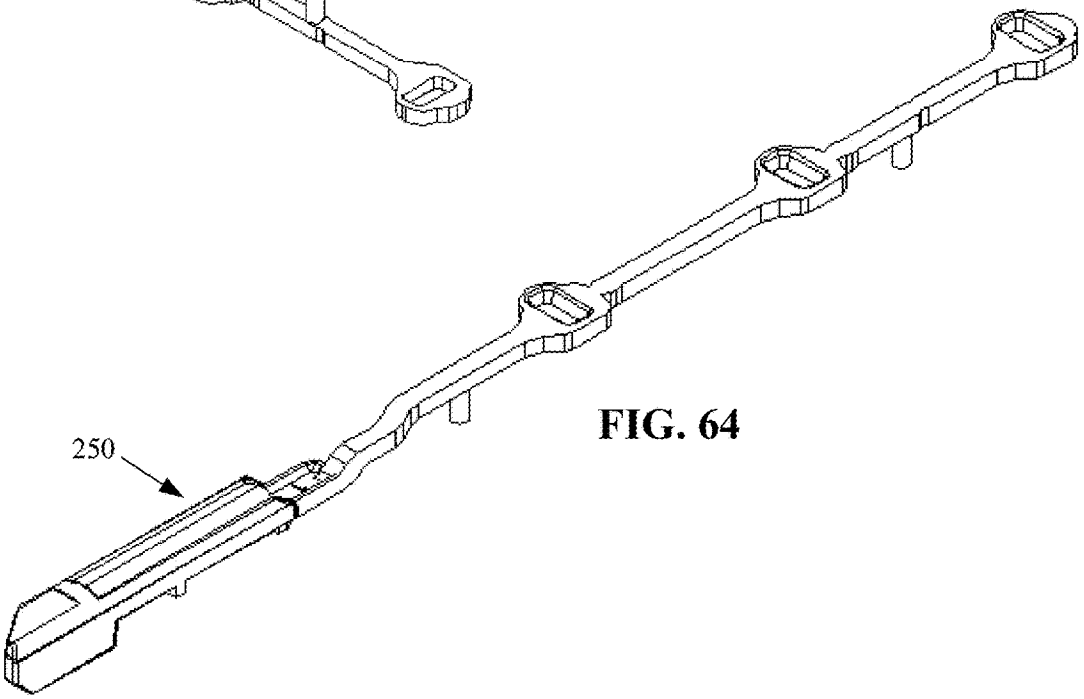
FIG. 64 is a second perspective view of the latch member shown in FIG. 63.
Figure 71:
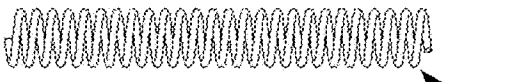
FIG. 71 is a side view of the spring of FIG. 70.
Figure 72:
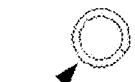
FIG. 72 is an end view of the spring of FIG. 70.
Figure 70:
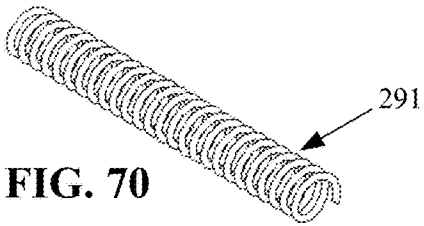
FIG. 70 is a perspective view of a spring used in the latch assembly of FIG. 1.

Perspective views of the latch member 250 are shown in FIGS. 63-64, while corresponding orthogonal views are shown in FIGS. 65-69. The latch member 250 may extend from first end 251 to second end 252, and may include a tongue 253 that may begin at the first end of the latch member and extend only part way to its second end. The tongue 253 may have a generally flat engagement surface 254E that may engage the track of the master window frame to prevent outward tilting of the sliding sash window, and it may also have an angled surface 254A that may taper toward the engagement surface 254E to create an apex 254P. The angled surface 254A may be used, when pivoting the window from being tilted out of the master window frame back to a non-tilted position, so that upon contact with the master window frame, it may oppose biasing of the latch member and may assist in driving it into a retracted position, until the tongue re-enters the track of the master window frame, and is biased into its extended position to have the engagement surface 254E re-engage with the track. The bottom of tongue 253 may have an angled bypass surface 253A formed thereon (FIG. 67). The tongue 253 may also have one stop 266A protruding therefrom (FIG. 65) or a pair of stops (e.g., 266A and 266B). Extending away from the tongue 253 may be an elongated beam 255 that may be flexible.

The beam 255, which may be generally slender, may transition and widen to form peripheral walls about an opening 275A, the size of which may depend upon the cross-sectional shape of the post 76 of lever arm 70 of the lock assembly 100, to provide for engagement of the post with the latch member 250. The opening 275A may be an elongated shape, which may, for example, be generally rectangular-shaped, as shown in FIG. 65. The elongated opening may be oriented so that the longer direction of the opening is substantially perpendicular to the axis 255X of the beam 255. The rectangular opening 275A may therefore have a length 275L extending substantially perpendicular to the axial direction 255X of the beam, and a width 275W extending substantially parallel to the axial direction of the beam. The internal corners of the rectangular opening 275A may be radiused.

Extending away from the far end of the peripheral walls formed about opening 275A may be a secondary beam 255A that may be formed substantially the same as beam 255, and the distal end of which may similarly widen to form peripheral walls about an opening 275B that may be constructed the same as opening 275A. The connection of the beam 255A with the peripheral walls about opening 275A may include a first notch 255N1 on a first side of the beam and a second notch 255N2 on a second side of the beam, to produce a cross-sectional area that may be weakened. The weakened area may be used to sever the secondary beam 255A from the peripheral walls associated with the opening 275A of beam 255, where it is necessary/desirable to use the first opening 275A for receiving the post 76 of the lever arm 70 of the sash lock 100, with respect to mounting upon a meeting mail of a window of a particular size. A third beam 255B with peripheral walls about an opening 275C may be similarly formed. An additional pair of notches (255BN1 and 255BN2) may be similarly formed, or may instead be formed in its central region, to permit severing of the most distal portion of the beam, being just beyond the cylindrical protrusion 255P2.

Biasing of the slidable latch member 250 relative to the housing 210 may be through the use of a suitably arranged tension spring, or by using a compression spring. To simplify the presentation, the figures herein only depict an embodiment where a compression spring is utilized.

Figure 73:
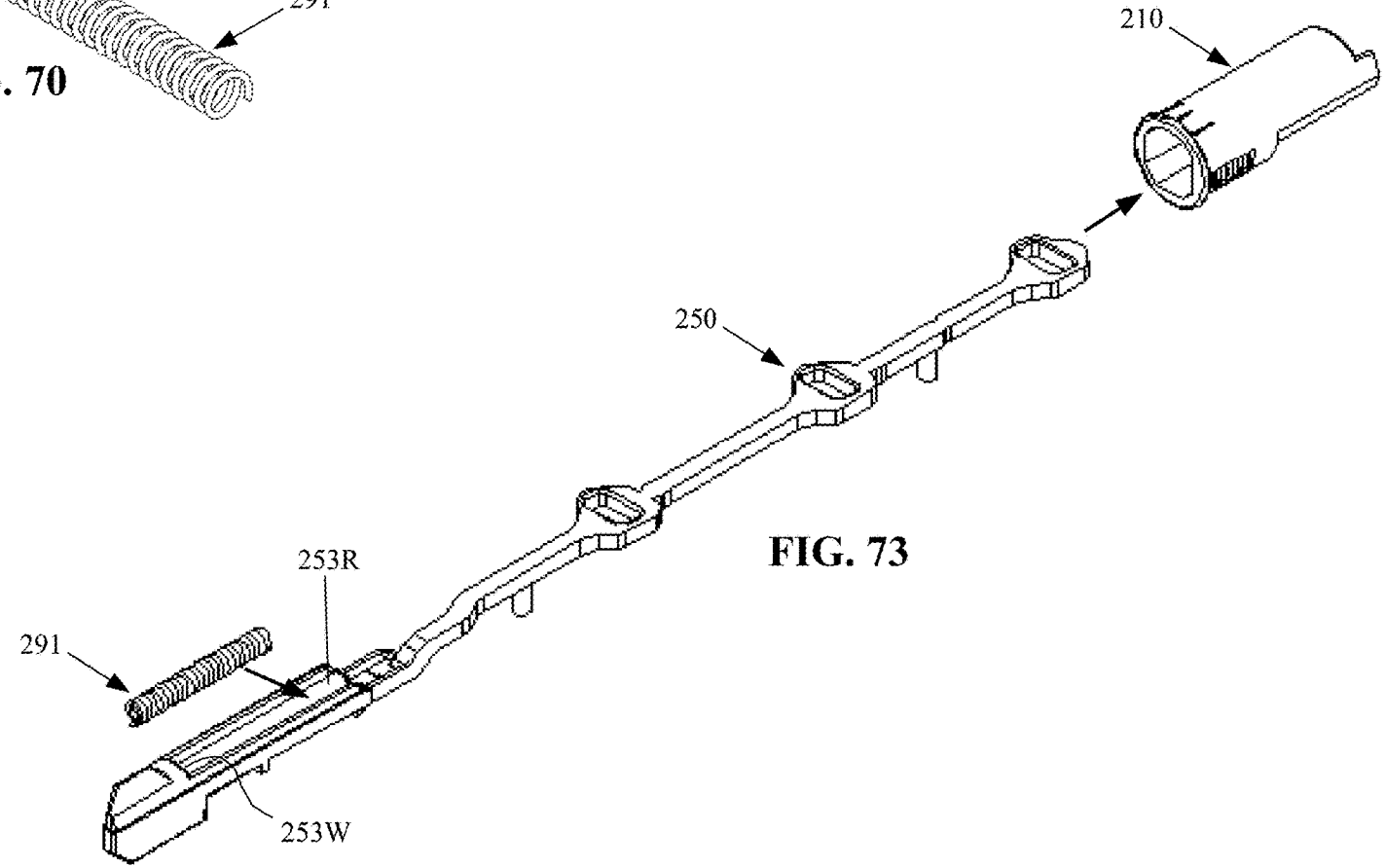
FIG. 73 is an exploded view showing the latch member of FIG. 63, the latch housing of FIG. 54, and the helical spring of FIG. 70, prior to assembly to form the latch assembly of FIG. 1.
Figure 76:
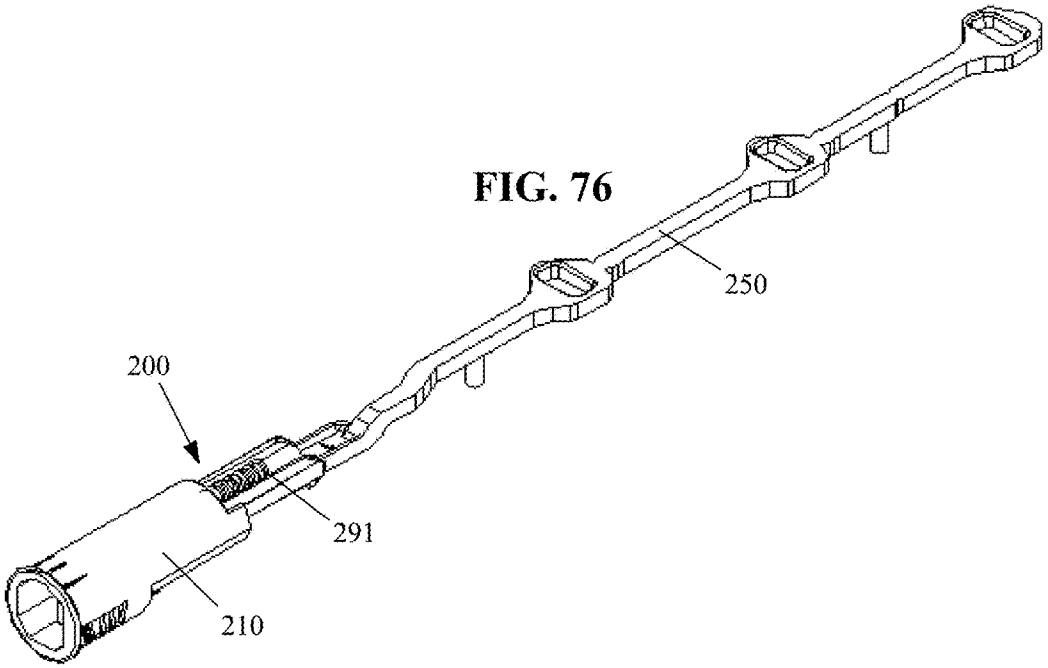
FIG. 76 is the perspective view of FIG. 75, but showing the latch member in a fully retracted position.
Figure 81:
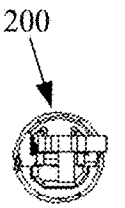
FIG. 81 is a second end view of the latch assembly shown in FIG. 74.
Figure 78:
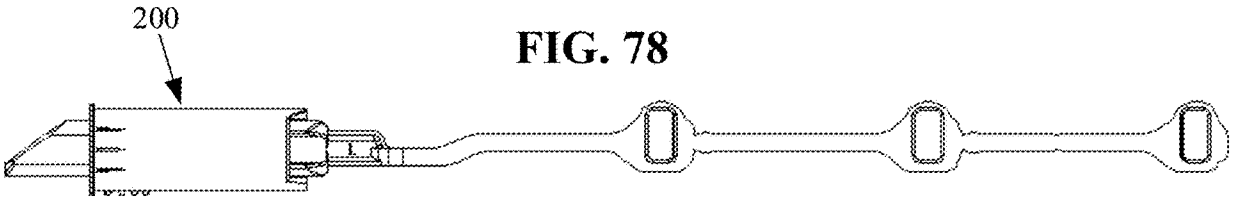
FIG. 78 is a top view of the latch assembly shown in FIG. 74.
Figure 77:
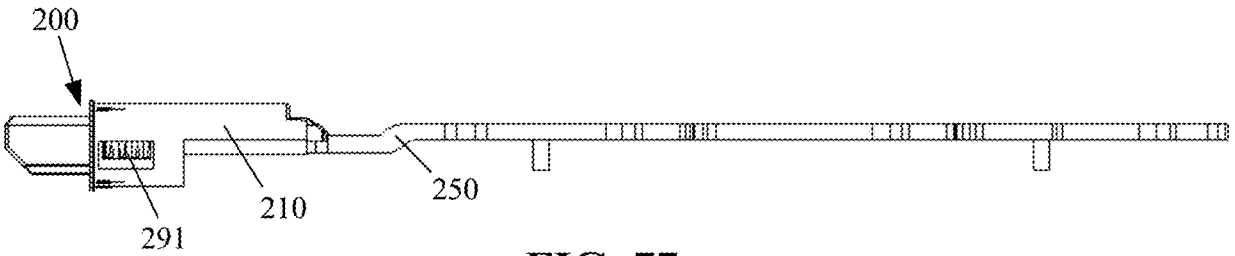
FIG. 77 is a side view of the latch assembly shown in FIG. 74.
Figure 79:
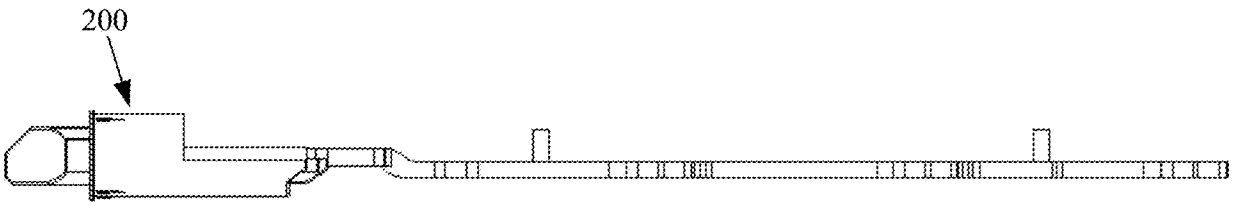
FIG. 79 is a bottom view of the latch assembly shown in FIG. 74.
Figure 80:
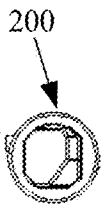
FIG. 80 is a first end view of the latch assembly shown in FIG. 74.
Figure 89:
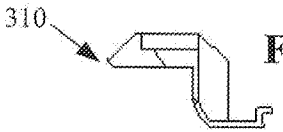
FIG. 89 is a second end view of the housing of FIG. 82.
Figure 87:
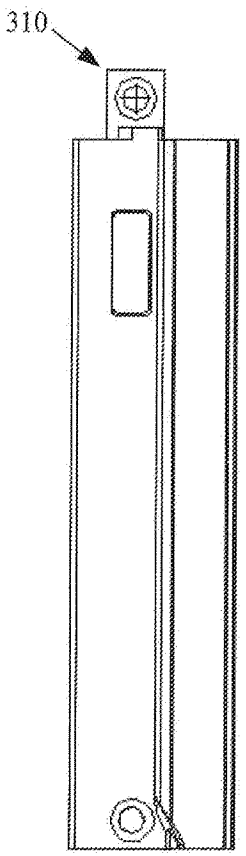
FIG. 87 is a front view of the housing of FIG. 82.
Figure 90:
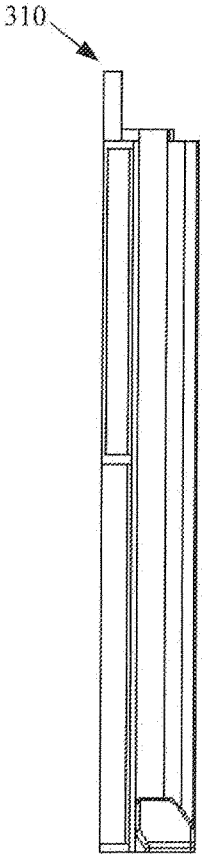
FIG. 90 is a first side view of the housing of FIG. 82.
Figure 92:
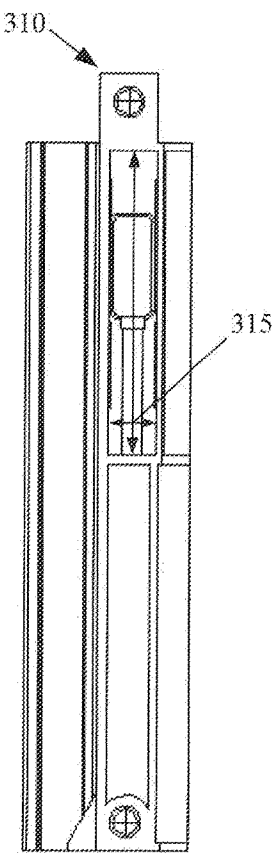
FIG. 92 is a rear view of the housing of FIG. 82.
Figure 91:
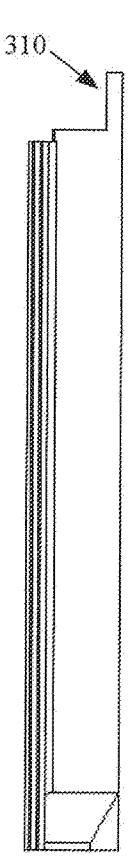
FIG. 91 is a second side view of the housing of FIG. 82.
Figure 88:
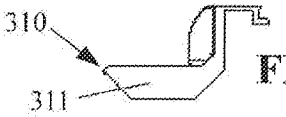
FIG. 88 is a first end view of the housing of FIG. 82.
Figure 94:
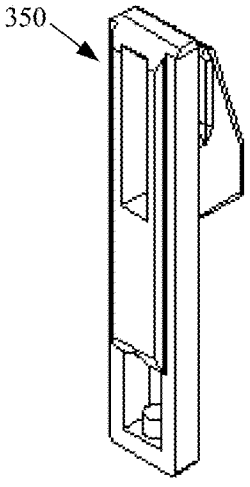
FIG. 94 is a second perspective view of the slidable stop member of FIG. 93.
Figure 93:
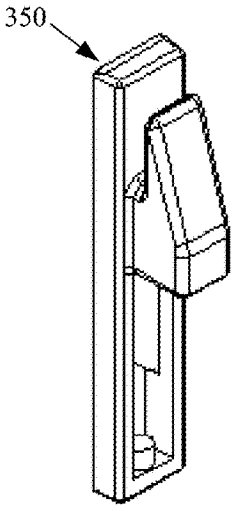
FIG. 93 is a first perspective view of a slidable stop member used with respect to the housing of the stop assembly of FIG. 1.
Figure 100:
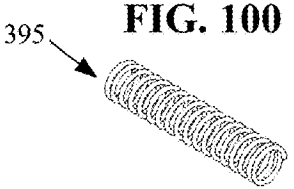
FIG. 100 is a first perspective view of a spring used to bias the slidable stop member of FIG. 93 with respect to the housing of FIG. 82 of the stop assembly of FIG. 1.
Figures 101, 102:
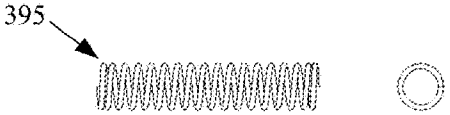
FIG. 101 is a side view of the spring of FIG. 100.
FIG. 102 is an end view of the spring of FIG. 100.
Figure 99:
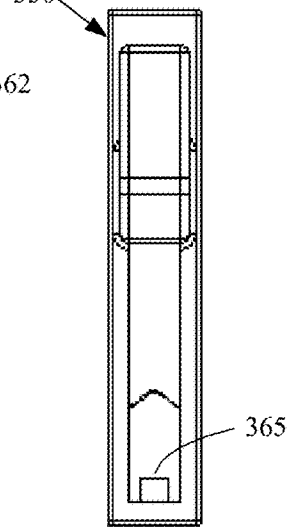
FIG. 99 is a front view of the slidable stop member of FIG. 93.
Figure 97:
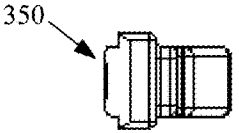
FIG. 97 is a second end view of the slidable stop member of FIG. 93.
Figure 95:
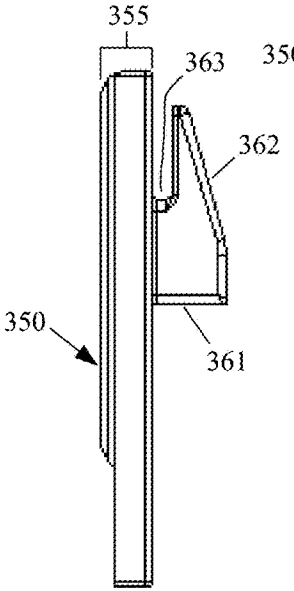
FIG. 95 is a side view of the slidable stop member of FIG. 93.
Figure 96:
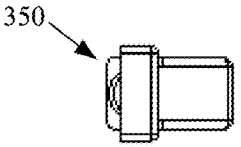
FIG. 96 is a first end view of the slidable stop member of FIG. 93.
Figure 98:
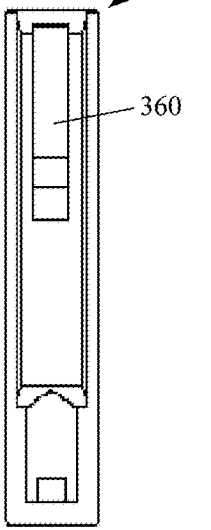
FIG. 98 is a rear view of the slidable stop member of FIG. 93.

The latch assembly 200 is shown in FIGS. 74-81, and assembly of the helical compression spring 291 and the latch member 250 into the housing 210 is illustrated by the exploded view of FIG. 73. The helical spring 291 may be nested in a recess 253R proximate to the tongue 253 of latch member 250. One end of the spring 291 may act upon the wall 253W of the tongue 253, while the other end of the compression spring may act upon the wall 218 of the housing 210 (see FIG. 62), to bias the latch member so that a portion of its tongue, including its apex, may protrude out from the latch housing, as seen in FIG. 74. The extent that biasing by spring 291 may cause the tongue 253 to protrude out from the housing 210 may be limited by the stops 266A and 266B on the tongue (FIG. 65) contacting the stops 216A and 216B on the housing (FIG. 58). Actuation of the latch member 251 relative to the housing 210 may cause the apex 254P of the tongue 253 to retract within the hollow interior of the housing, as seen in FIG. 76.

A keeper 400 that may be engaged by the cam 50 of the sash lock assembly 100 is shown in FIGS. 111-117, the installation of which, upon the master window frame, may be seen in FIGS. 123 to 125.

One configuration for a stop assembly 300, for use in combination with the latch assembly 200 disclosed herein, is shown in FIGS. 106-110, and may include a housing 310, a slidable stop member 350, and a spring 395. However, other arrangements may be suitably configured for slidably mounting the stop member 350 with respect to the master window frame, and is not limited to the embodiment that uses the herein disclosed housing 310. The embodiment using a housing may have the housing formed as shown in FIGS. 82-92 for housing 310, having an elongated opening 315 on one side that defines a cavity (FIG. 84) that may be configured to slidably receive the cross-sectional shape of the stop member 350 therein. A second opening 325 may be formed on a second side of the housing 310, and may interconnect with the cavity formed by the elongated opening 315. The housing 310 may be secured to the master window frame using any technique known in the art, including, but not limited to, using an adhesive, welding, using mechanical fasteners, etc. In the embodiment shown in the figures, one or more holes may be formed in the housing 310 to receive a corresponding screw or screws for mounting of the stop assembly 300 to the master window frame.

One embodiment of the slidable stop member 350 is shown in FIGS. 93-99. The slidable stop member 350 may be formed to include a shaped portion 355 that may be slidably received in the cavity defined by the opening 315 of housing 310. The shaped portion may be formed to be cylindrical, or octagonal, or any other shape that may suitably slide in a correspondingly shaped cavity formed in the housing 310. In the embodiment shown in FIGS. 93-99, the shaped portion 355 of the slidable stop member 350 may be formed to be a rectangular shape, and the cavity in the housing 310 defined by the opening 315 may also be rectangular, and may provide a slight clearance fit therebetween. A protrusion 360 may protrude from the shaped portion 355 and may have a generally flat bottom engagement surface 361, and an angled upper bypass surface 362. An opening defining a recess 363 may be formed in the top of the protrusion 360.

Figure 104:
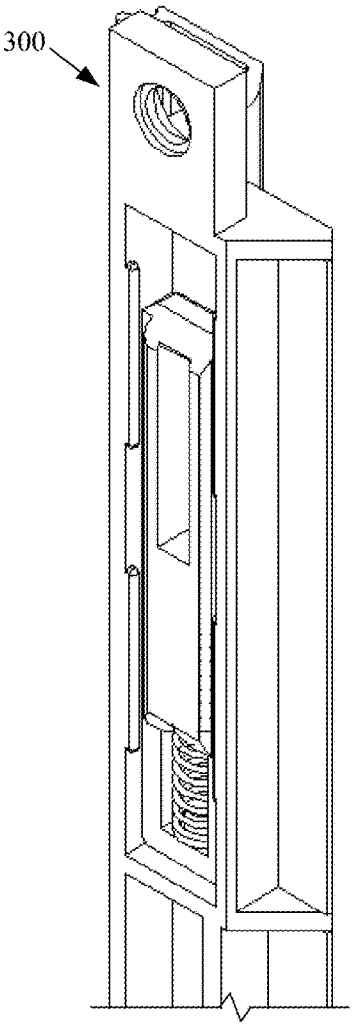
FIG. 104 is a first perspective view showing the spring of FIG. 100, the slidable stop member of FIG. 93, and the housing of FIG. 82, after being assembled to form the stop assembly of FIG. 1.
Figure 103:
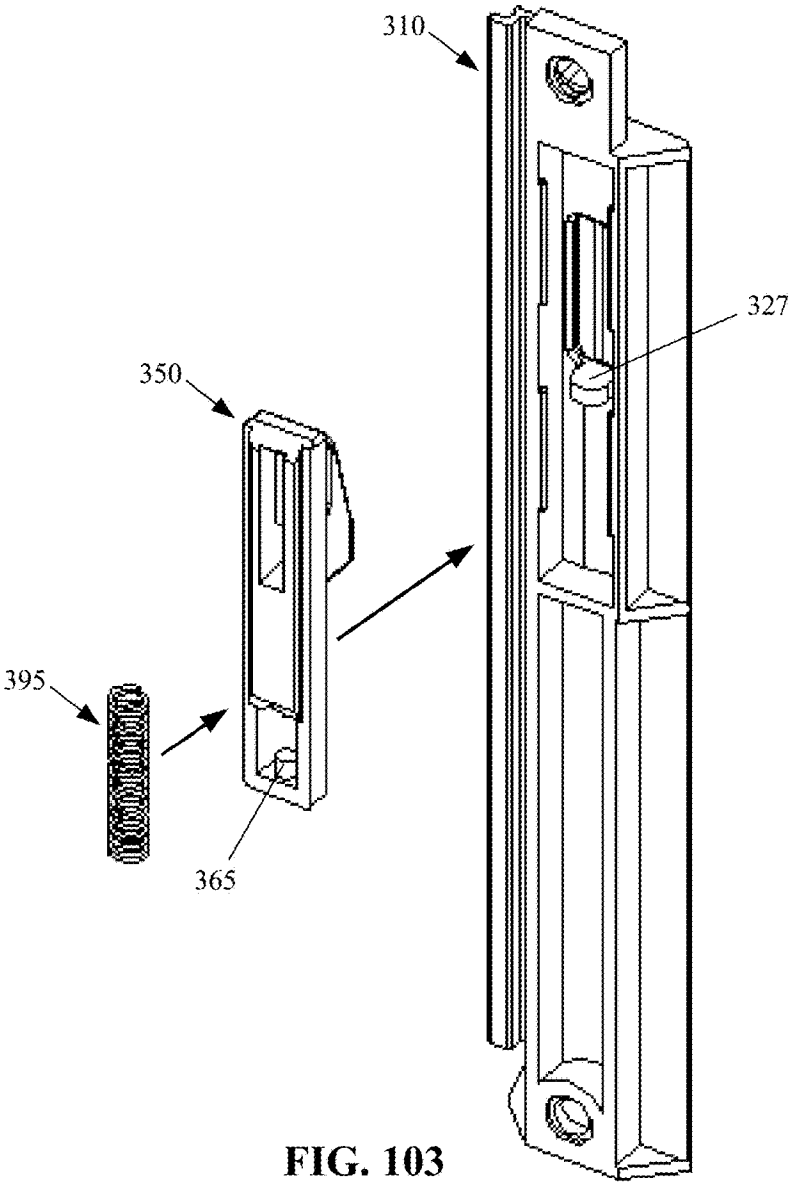
FIG. 103 is an exploded view of the spring of FIG. 100, the slidable stop member of FIG. 93, and the housing of FIG. 82, prior to being assembled to form the stop assembly of FIG. 1.

Assembly of the slidable stop member 350 and spring 395 into the housing 310 may be seen in FIGS. 103-104. The helical spring 395 may mount in any manner so as to provide for biasing of the slidable stop member 350 away from the upper (second) position shown in FIG. 105B towards the lower (first) position shown in FIG. 105A. In one embodiment, to provide secure support for the spring 395, a post 365 may be formed in a recess in the slidable stop member 350 (see FIGS. 99 and 103) to receive one end of the spring thereon, and a wall 327 may protrude into the cavity of the housing 310 to support the other end of the spring, and which wall may also have a post formed thereon.

To accommodate installation of the latch assembly 200, the sash window frame 525, as seen in FIGS. 118-122, may have an opening 526 on one side. The sliding sash window frame 525 may have a horizontal meeting rail 525M, a first vertical stile extending downward therefrom, a second stile, and a bottom rail, which may form a framed enclosure to support the glazing therein.

To accommodate installation of the sash lock assembly 100, the top of the meeting rail 525M may have an elongated opening 525ME formed therein, adjacent to which may be a first hole 525A, and a second hole 525B. The elongated opening 525ME may be shaped and positioned to provide suitable clearance for the post 76 of the lever arm 70, and for its movement between the extended locking position (FIG. 53A) and the third retracted unlock position (FIG. 55D).

The initial installation of the latch assembly 200 is shown in FIG. 123. The end of the latch assembly 200 may be received through the opening 526 in the sash window frame 525, to be as seen in FIGS. 124-126.

One or more of the beams (255, 255A, and 255B) of the latch member 250 may be formed to include a vertical protrusion. For example, beams 255 and 255B of the latch member 250 may each formed to each include a respective vertical protrusion 255P1/255P2 that may protrude down from the bottom surface of the beam. The protrusions 255P1/255P2, which may be cylindrical, may be formed of a selective length so as to contact the bottom wall of the meeting rail 525M to provide support for the beam of the latch member to be maintained at a substantially horizontal position, which may be a substantially central position within the hollow meeting rail of the sash window, or may be just a desired height above the bottom wall of the meeting rail. The protrusions 255P1/255P2 may also serve to prevent disengagement of the post 76 of the lever arm 70 from the opening 275A (or from openings 275B/275C, whichever is utilized), which may co-act in combination with the protrusion 77 of the post 76 of the lever arm 70.

One of the openings 275A, 275B, 275C on one of the beams (e.g., 255, 255A, or 255B) of the latch assembly 200 may be coordinated with and properly positioned for alignment below the opening 525ME in the meeting rail 525M of the sash window frame 525 (see FIG. 126). For the window frame 525 shown in FIG. 126, the elongated opening 525ME in the meeting rail 525M may be positioned a particular distance away from the end of the window frame, which may accommodate alignment with opening 275B of the latch assembly 200 shown therein. In this case, the beam 255B could be removed using the notches 255BN1 and 255BN2, leaving the protrusion 266P2 to support the end of the latch member. For a larger window, the elongated opening in the top of the meeting rail may be more appropriately positioned to be a greater distance away from the end of the window frame, and may thus be positioned for alignment with opening 275C of the latch assembly 200. Similarly, for a smaller window, the elongated opening in the top of the meeting rail may be positioned a smaller distance away from the end of the window frame, and may be positioned for alignment with opening 275A of the latch assembly 200. In the latter example, the connection of the beam 255A with the peripheral walls formed about opening 275A may be severed using notches 255N1 and 255N2.

The initial installation of the sash lock assembly 100 upon the sash window frame 525 is also illustrated in the exploded view of FIG. 123. The post 76 of the lever arm 70 of the sash lock assembly 100 may be received through the elongated opening 525ME in the top of the meeting rail 525M. However, because of the elongated cross-sectional shape of the post 76 (see FIG. 30), and because of the protrusion 77 protruding laterally therefrom, in order for the post to be also be received through the elongated opening 275B of the latch member 250 of the latch assembly 200, the lock assembly should be positioned substantially transverse to the axial direction 525AX of the meeting rail 525M. Such initial positioning may orient the long transverse direction of the post 76 and the protrusion 77 of lever arm 70 to be perpendicular to the axial direction 525AX of the meeting rail 525M, so that it may be generally in-line with the lengthwise side 275L of the rectangular opening 275B in the latch member 250.

After insertion of the post 76 through the opening 525ME in the top of the meeting rail 525M and into the rectangular opening 275B of the latch beam, the sash lock assembly 100 may then be rotated roughly 90 degrees. Next the sash lock 100 may be lowered for the bottom surface 11 of the sash lock housing 10 to contact and be flush with the top of the meeting rail, and be fastened to the holes 525A and 525B therein, using fasteners through the hollow cylindrical protrusions 15 and 16 of the housing 10. The 90 degree rotation of the sash lock assembly 100 just prior to its securement to the meeting rail may orient the long transverse direction of the post 76 of lever arm 70 to be parallel to the axial direction 525AX of the meeting rail 525M, so that it may be generally in-line with the shorter width 275W of the rectangular opening 275A in the latch member 250.

The width 275W of the rectangular opening 275A in the latch member 250 may be just slightly larger than the long transverse direction of the post 76 of the lever arm 70 positioned therein, so that movement of the post actuates the latch member of the latch assembly, to provide the above noted interconnection therebetween. The protrusion 77 may redundantly serve to prevent disconnection of the post 76 of the lever arm from the opening 275B in the latch member (i.e., preventing the latch member from falling off of the post). The protrusions 2551 and 255P2 on the latch beams 255 etc. may serve to maintain the latch beam(s) (e.g., 255, 255A, and 255B) at the proper elevation within the meeting rail, to redundantly prevent such disconnection.

The sash lock assembly 100 and the latch assembly 200 are shown installed with respect to the sliding sash window frame 525M, in FIGS. 124-126, with the sash window slidably installed and shown closed with respect to a second sash member 550.

FIG. 129 is a perspective view of a side of the master window frame 500 that slidably supports the sash window frame 525. FIG. 127 is a cross-sectional view taken through the master window frame 500, and also shows a corresponding cross-sectional view of the stop assembly 300, prior to being secured to the master window frame, while FIG. 128 shows the stop assembly after it is secured to the master window frame.

FIGS. 130-131 show the stop assembly 300 installed within a track of the master window frame 500—the track within which the tongue of the latch member 200 may move for the sash window frame 525 to be slidable with respect to the master window frame. The sash lock assembly 100 is shown locked (i.e., zero degrees of shaft-handle rotation), and the sash window is prevented from either sliding or tilting, as the cam 50 is in the extended lock position (FIG. 53A) where it engages the keeper 400, and where the post 76 of the lever arm 70 of the sash lock assembly 100 is free to pivot and does not oppose the spring 291 from biasing the latch member 250 into its corresponding extended position, so that a portion of tongue 253 is disposed within track 450T. The sash window frame 525 may be redundantly locked and prevented from sliding, as a bottom engagement surface 311 (FIG. 88) of a portion of the housing 310 of the stop assembly 300 may be positioned just above the top of the tongue 253 of the latch member 250 (see FIG. 131 and FIG. 135), to block any upward movement of the sash window frame 525 from its closed position.

In FIG. 136 the shaft/handle member 40 has been rotated from the zero-degree position (see FIG. 139B) to the 135 degree position for the cam 50 of the sash lock assembly 100 to rotate into a first retracted (unlocked) position (FIG. 53C and FIG. 140B), being unlocked (disengaged) with respect to the keeper 400. The tongue 253 of the latch assembly 200 has correspondingly translated from the extended position (FIG. 139A) into a first retracted position (FIG. 140A), as a result of the latch member 250 being driven by the interconnection with the post 76 of the lever arm 70. When the latch member 250 translates from the extended position (FIG. 139A) to its first retracted position (FIG. 140A), the apex 254P of the tongue 253 of the latch member 250 has moved clear of the bottom engagement surface 311 of the housing of the stop assembly.

With both the cam 50 disengaged from the keeper 400 and the tongue 253 of the latch member 250 moved clear of the housing 310 of the stop assembly 300, the sash window frame may slide away from the closed window position. The tongue 253 in its first retracted position still has a portion thereof disposed within track of the master window frame 500 to prevent tilting during such sliding.

As the sash window frame 525 continues to slide open the top engagement surface 254T of the tongue 253 (FIG. 66) of the latch member 250 approaches and contacts the bottom stop surface 361 of the protrusion 360 of the slidable stop member 350, which is biased into its first (lower) position (FIG. 141 and FIG. 105A). This contact causes the slidable stop member 350 to also slide upwardly in opposition to the biasing provided by spring 395, until reaching its second position (FIG. 142 and FIG. 105B), where further sliding movement is inhibit by contact of a portion of the slidable stop member 350 with the housing 310 of the stop assembly 300. The movement and initial contact of the top surface 254T of the tongue 253 of the latch member 250 with the slidable stop member 350, and its subsequent motion being restricted may respectively be seen in the enlarged detail views of FIG. 143A and FIG. 143B (see also FIGS. 144A and 144B). It should be noted that in order for the apex 254P of the tongue 253 of the latch member 250 to be unrestricted with respect to the bottom surface 311 of the housing 310, when in the first retracted position, but be restricted by the bottom surface 361 of the protrusion 360 of the slidable stop member 350, the protrusion 360 will protrude farther away from the wall of the track of the master window frame than does the surface 311 of the housing 310.

Also, in order for a child to be prevented from egressing through an opening between the bottom of the sash window frame 525 and a corresponding bottom portion of the master window frame 500, the sash window at the restricted open window position of FIG. 142 must provide a very small gap, being less than 1-4 inches in one embodiment, and less than 5 inches in another embodiment, and less than 6 inches in yet another embodiment. Other gaps may also be used. The smaller the gap provided by the restricted open window position, the less ventilation may thereby be provided, however, it may be safer with respect to preventing a very small child from egressing therefrom. Therefore, to provide for such embodiments with corresponding gaps for the restricted open window position, the distance D (see FIG. 105B) between the bottom surface 311 of the housing 310 and the bottom surface 361 of the protrusion 360 of the slidable stop member 350, is particularly formed to accommodate the desired gap. For example, where it may be desired to permit the sash window frame 525 to open to a restricted open window position that provides a gap of four inches, the stop assembly 300 may be formed such that the distance D is roughly equal to four inches. Since the sash window frame 525 in the closed window position may be nested within the master window frame by about one-half of an inch, the distance D may need to be formed to be closer to 4.5 inches to provide for an actual gap for air flow of four inches.

It is further noted that the stop assembly may include multiple slidable stop members to provide for multiple restricted window open positions (e.g., two slidable stop members that respectively provide a first window open gap of 3 inches and a second window open gap of 6 inches).

When the user desires to open the sash window frame 525 beyond the restricted window open position shown in FIG. 142, the shaft handle member 40 may be rotated to the 165 degree position (i.e., the second retracted unlocked cam position shown in FIGS. 145A and 53D), during which rotation the cam 50 may drive the lever arm 70, which may cause the latch member 250 to retract into a corresponding second retracted position, shown in FIG. 145. As the latch member 250 is moved into its second retracted position, the apex 254P of the tongue 253 of the latch member 250 will move clear of the bottom surface 361 of the protrusion 360 of the slidable stop member 350, and further opening of the sash window frame 525 is no longer inhibited. As may be seen in FIGS. 149A and 149B, as soon as the apex 254P of the tongue 253 of the latch member 250 is moved clear of the bottom surface 361 of the protrusion 360 of the slidable stop member 350, the spring 395 will bias the slidable stop member to move back to its first position (FIG. 148). The abrupt stopping of the biased movement of the stop member 350 at its first position may produce a snapping sound that may serve to audibly alert the user that the window opening control feature is no longer active The window may be open further, as shown by FIGS. 150 and 151.

With the tongue 253 of the latch member 250 in its second retracted position, a portion thereof still remains disposed within the track of the master window frame 500 (FIG. 150) to prevent tilting of the sash window frame 525. However, when the user desires to tilt the sash window frame 525 out of the master window frame 500 for any reason (e.g., to permit the portion of the glazing exposed to the exterior to be easily cleaned), the shaft/handle member 40 may be rotated to the 180 degree position (i.e., the third retracted cam position shown in FIGS. 155 and 53E). During rotation of the shaft/handle member 40 to the 180 degree position, the cam 50 may drive the lever arm 70 to rotate even further, which may cause the latch member 250 to retract into a corresponding third retracted position, shown in FIG. 153. When the latch member 250 is in the third retracted position, its tongue 253 is no longer disposed within the track of the master window frame 500, and thus it no longer prevents tilting of the sash window frame 525. After the window is tilted out of the master window frame, the shaft/handle member 40 may be released and the cam may be driven into the second retracted (unlocked) position by the interconnection with the biased latch member.

Once the outside of the glazing of the window has been cleaned, the shaft/handle member 40 may again be rotated to the 180 degree position so that the sash window frame 525 may be pivoted back into the master window frame 500. Upon releasing of the shaft/handle member 40 it may again be biased back into the second retracted position or back into the first retracted unlock position, depending upon the degree of latch spring biasing and the shape of the follower surface of the cam (see FIGS. 158-159), to again permit sliding of the sash window frame 525, and to once again prevent it from inadvertently tilting away from the master window frame 500

As seen in FIG. 158, a user may apply a downward force to the sash window frame 525 (indicated by the downward pointing arrow), so that it may be lowered to a position at or below the restricted window open position, without having to actuate the shaft/handle member 40 of sash lock 100. As seen in the enlarged detail view of FIG. 161A, the angled bottom bypass surface 253A of the tongue 253 (FIG. 161A and FIG. 67) may contact the angled upper bypass surface 362 of the protrusion 360 of the slidable stop member 350 of the stop assembly 300, and the contact therebetween may create a horizontal force component in the latch member 250. The horizontal force component may oppose the biasing of the latch member provided thereto by spring 291 and the restraining force of the detent mechanism when used, and may drive the latch member 250 to retract. This retraction of the latch member 250 may be transmitted to the post 76 of the lever arm 70 by the interconnection therebetween, which may drive the cam 50 to correspondingly counter-rotate. The latch member 250 may remain retracted as the tongue 253 passes over the protrusion 360 (FIG. 161B), after which it may be biased by spring 291 back to the first retracted unlock position so that it may again serve in combination with the stop member 350 to limit the opening of the window.

When the user no longer desires to ventilate the room, the sash window 525 may be lowered into the closed window position, and the shaft/handle member 40 may be returned to the zero degree position to once again lock the cam 50 with respect to the keeper 400, as seen in FIGS. 164-165. Once the cam 50 no longer drives the lever arm 70 to overcome the bias provided to the latch member 250 by spring 291, the spring biases the tongue 253 to once again be positioned below the lower surface 311 of the housing 310 of the stop member 300, to redundantly lock the sash window fame 525.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A window fastener, for use with a sash window configured to slide and tilt with respect to a master window frame, said window fastener comprising:

a sash lock comprising a lock housing, a cam, and an arm; said cam mounted to said lock housing to pivot between a locked position where said cam engages a keeper to lock the sash window in a closed window position to inhibit sliding window movement, a first unlocked position, and a second unlocked position;

a tilt latch assembly comprising a latch housing, a latch member slidable within said latch housing and interconnected with said arm, and a latch spring configured to bias a tongue portion of said latch member to normally protrude out from said latch housing to prevent the sash window from being tilted; wherein said cam drives said arm to position said latch member at a first retracted latch position when said cam is at said first unlocked position; and wherein said cam drives said arm to position said latch member at a second retracted latch position when said cam is at said second unlocked position;

a stop assembly configured to be mounted to the master window frame, said stop assembly comprising:

a stop housing with an engagement surface configured to protrude a first distance away from the master window frame;

a stop member slidably mounted to a portion of said stop housing to be slidable between a first stop member position and a second stop member position; said stop member comprising a stop surface configured to protrude a second distance away from the master window frame, said second distance being greater than said first distance; and a stop spring positioned to bias said stop member from said second stop member position toward said first stop member position;

wherein said engagement surface is engaged by said tongue portion to redundantly lock the sash window in the closed window position, when said cam is in said locked position;

wherein said stop surface is engaged by said tongue portion to restrict travel of the sash window to a limited open position, when said cam is in said first unlocked position; and wherein said tongue portion is disengaged from said stop surface to permit unrestricted travel of the sash window when said cam is in said second unlocked position.

2. The window fastener according to claim 1 wherein said stop member makes a snapping sound when biased by said stop spring into said first stop member position after said cam is moved from said first unlocked position to said second unlocked position.

3. The window fastener according to claim 1 wherein said tongue portion comprises an angled bypass surface and said stop member comprises an angled bypass surface; and wherein said angled bypass surface of said tongue contacts said angled bypass surface of said stop member to counter said bias of said latch spring to cause said latch member to retract to bypass said stop member, when the sash window is moved past the limited open position toward the closed window position.

4. The window fastener according to claim 1, wherein said cam is mounted to said lock housing to pivot from said second unlocked position to a third unlocked position;

wherein said cam drives said arm to position said latch member at a third retracted latch position when said cam is at said third unlocked position; and wherein said tongue portion is disengaged from the master window frame to permit the sash window to tilt, when said cam is in said third unlocked position.

5. A stop assembly, said stop assembly configured to mount to a master window frame of a sliding sash window assembly and to dampen sash window movement prior to releasably limiting the movement of the sash window to a limited open window position, said stop assembly comprising:

a stop housing, said stop housing having a front side, a rear side, and an engagement surface, said engagement surface configured to protrude a first distance away from the master window frame when said stop assembly is mounted to the master window frame; said stop housing comprising:

an elongated opening on said rear side defining a cavity;

a second opening formed on said front side that interconnects with said cavity;

a stop member, said stop member comprising an elongated body; said elongated body of said stop member received through said elongated opening into said cavity of said stop housing, and being configured to slide in said cavity between a first stop member position and a second stop member position;

wherein said stop member comprises: a protrusion; said protrusion comprising: a stop surface configured to protrude a second distance away from the master window frame when said stop assembly is mounted to the master window frame, said second distance being greater than said first distance;

a spring, said spring positioned to bias said stop member from said second stop member position toward said first stop member position;

wherein said engagement surface of sais top housing is configured for engagement by a tongue portion of a tilt latch of the sash window assembly to redundantly lock the sash window in a closed window position;

wherein said stop surface of said protrusion of said stop assembly is configured for engagement by the tongue portion of the tilt latch to restrict travel of the sash window to a limited open position; and wherein said spring dampens sash window movement prior to releasably limiting the movement of the sash window to the limited open window position.

6. The stop assembly according to claim 5, wherein said stop member comprises: an angled bypass surface, said angled bypass surface configured to contact the tongue portion of the tilt latch to cause the latch member to translate to bypass said stop member, when the sash window is moved from an open window positon past the limited open position toward the closed window position.

7. The stop assembly according to claim 5, wherein said spring comprises a helical spring.

8. The stop assembly according to claim 7, wherein said helical spring is positioned in said cavity of said housing.

9. The stop assembly according to claim 5, wherein said elongated body of said stop member comprises a rectangular cross-sectional shape.

10. The stop assembly according to claim 5, further comprising: one or more holes in said housing, said one or more holes configured to receive one or more corresponding screws to mount said stop assembly to the master window frame.

* * * * *